US009670566B2

(12) United States Patent
Murray et al.

(10) Patent No.: US 9,670,566 B2
(45) Date of Patent: Jun. 6, 2017

(54) WHITE ANTIMICROBIAL COPPER ALLOY

(71) Applicant: Sloan Valve Company, Franklin Park, IL (US)

(72) Inventors: Michael Murray, Franklin Park, IL (US); Mahi Sahoo, Ottawa (CA)

(73) Assignee: SLOAN VALVE COMPANY, Franklin Park, IL (US)

( * ) Notice: Subject to any disclaimer, the term of this patent is extended or adjusted under 35 U.S.C. 154(b) by 0 days.

(21) Appl. No.: 14/175,802

(22) Filed: Feb. 7, 2014

(65) Prior Publication Data

US 2014/0147332 A1 May 29, 2014

Related U.S. Application Data

(63) Continuation-in-part of application No. PCT/US2013/066601, filed on Oct. 24, 2013.

(60) Provisional application No. 61/718,857, filed on Oct. 26, 2012.

(51) Int. Cl.

| | |
|---|---|
| ***C22C 9/04*** | (2006.01) |
| ***C22C 9/05*** | (2006.01) |
| ***C22C 9/06*** | (2006.01) |
| ***C22F 1/08*** | (2006.01) |

(52) U.S. Cl.

CPC ..... *C22C 9/06* (2013.01); *C22C 9/04* (2013.01); *C22C 9/05* (2013.01); *C22F 1/08* (2013.01)

(58) Field of Classification Search

CPC .... C22C 9/00; C22C 9/04; C22C 9/05; C22C 9/06; C22F 1/08

See application file for complete search history.

(56) References Cited

U.S. PATENT DOCUMENTS 2,101,087 A 12/1937 Munson
2,445,868 A * 7/1948 Berwick ..... C22C 9/04 420/481
3,778,236 A * 12/1973 Goldman ..... C22C 9/04 428/673
3,880,678 A * 4/1975 Shapiro ..... C22F 1/08 148/434
4,003,715 A * 1/1977 Cascone ..... B23K 35/302 219/146.32
4,038,068 A 7/1977 Tyler et al.
4,525,434 A * 6/1985 Morikawa ..... B32B 15/01 428/674
4,589,938 A 5/1986 Drosdick
4,632,806 A * 12/1986 Morikawa ..... B32B 15/01 420/471

(Continued)

FOREIGN PATENT DOCUMENTS

CN 1382818 12/2002
CN 102149834 8/2011

(Continued)

OTHER PUBLICATIONS

Lee et al., WO 2011/155648 A1, published Dec. 15, 2011. (machine translation).*

(Continued)

*Primary Examiner* — Jessee Roe
*Assistant Examiner* — John Hevey
(74) *Attorney, Agent, or Firm* — Foley & Lardner LLP

(57) ABSTRACT

Copper based alloys exhibiting a white/silver hue. The alloys contain copper, nickel, zinc, manganese, tin, sulfur, and antimony.

14 Claims, 71 Drawing Sheets

SAND CASTING, C99760

| HEAT NO. | Cu | Ni | Zn | Mn | S | Sb | Sn | Fe | Al | P | Pb | Si | C |
|---|---|---|---|---|---|---|---|---|---|---|---|---|---|
| AIM | 61-67 | 8-12 | 8-14 | 10-15 | 0.25 | 0.1-1.0 | 0.2-1.0 | 0.6 | 0.6 | 0.05 | 0.09 | 0.05 | 0.10 |
| 99X02-090612-H1P1-7-C | 65.22 | 9.96 | 12.45 | 10.25 | 0.013 | 0.460 | 0.695 | 0.400 | 0.470 | 0.026 | 0.008 | 0.029 | 0.008 |
| 99X02-090612-H1P2-7-C | 64.86 | 10.69 | 12.13 | 10.12 | 0.018 | 0.580 | 0.639 | 0.402 | 0.479 | 0.017 | 0.015 | 0.028 | 0.008 |
| 99760-022713-P3H1C-7* | 64.47 | 10.52 | 10.24 | 12.56 | 0.043 | 0.389 | 0.623 | 0.811* | 0.264 | 0.032 | 0.006 | 0.022 | 0.010 |
| 99760-022713-P3H2C-7 | 63.05 | 10.71 | 10.36 | 13.87 | 0.023 | 0.369 | 0.630 | 0.578 | 0.342 | 0.031 | 0.005 | 0.006 | 0.016 |
| 99760-022713-P3H3C-7 | 62.77 | 10.57 | 10.55 | 14.08 | 0.016 | 0.335 | 0.634 | 0.632 | 0.344 | 0.033 | 0.006 | 0.006 | 0.014 |
| 99760-040413-P3H5C-7 | 62.95 | 10.21 | 10.97 | 13.97 | 0.022 | 0.437 | 0.661 | 0.387 | 0.293 | 0.038 | 0.007 | 0.031 | 0.010 |
| 99760-042513-P3H6C-27 | 63.25 | 10.18 | 10.46 | 14.23 | 0.010 | 0.355 | 0.646 | 0.481 | 0.288 | 0.035 | 0.006 | 0.033 | 0.012 |
| 99760-072313-P13H1-7 | 65.32 | 8.77 | 11.96 | 12.29 | 0.008 | 0.214 | 0.868 | 0.197 | 0.296 | 0.052 | 0.007 | 0.002 | 0.004 |
| 99760-072313-P13H2-7 | 63.84 | 11.64 | 9.40 | 13.49 | 0.010 | 0.257 | 0.699 | 0.186 | 0.398 | 0.052 | 0.008 | 0.002 | 0.006 |
| 99760-072313-P13H3-7 | 63.73 | 9.35 | 12.52 | 12.65 | 0.010 | 0.239 | 0.800 | 0.219 | 0.404 | 0.050 | 0.007 | 0.003 | 0.005 |
| 99760-072313-P13H4-7 | 65.97 | 11.10 | 11.83 | 9.92 | 0.011 | 0.277 | 0.427 | 0.197 | 0.194 | 0.048 | 0.008 | 0.002 | 0.004 |
| 99760-072313-P13H5-7 | 66.65 | 10.08 | 9.54 | 12.14 | 0.012 | 0.257 | 0.745 | 0.205 | 0.293 | 0.052 | 0.006 | 0.002 | 0.004 |
| 99760-072313-P13H6-7** | 67.62 | 10.70 | 8.74 | 11.30 | 0.012 | 0.272 | 0.867 | 0.047 | 0.362 | 0.054 | 0.007 | 0.002 | 0.005 |
| 99760-091013-P13H13-7 | 63.62 | 8.70 | 12.34 | 13.16 | 0.017 | 0.714 | 0.847 | 0.316 | 0.223 | 0.036 | 0.008 | 0.002 | 0.007 |
| 99760-091013-P13H15-7 | 65.78 | 9.99 | 10.70 | 11.21 | 0.029 | 0.664 | 0.786 | 0.426 | 0.351 | 0.038 | 0.008 | 0.002 | 0.005 |

*Fe IS HIGHER THAN THE 0.6% MAX **COPPER IS OVER THE UPPER LIMIT OF 67%

(56) References Cited

U.S. PATENT DOCUMENTS

| | | | | |
|---|---|---|---|---|
| 6,149,739 | A | 11/2000 | Smith | |
| 6,254,701 | B1 | 7/2001 | Oshiro et al. | |
| 6,432,556 | B1 | 8/2002 | Brauer et al. | |
| 7,351,372 | B2 | 4/2008 | Inohana et al. | |
| 2009/0317290 | A1 | 12/2009 | Ababneh et al. | |
| 2010/0061884 | A1* | 3/2010 | Clark | C22C 9/05 420/472 |
| 2011/0165013 | A1 | 7/2011 | Trybus et al. | |
| 2012/0121455 | A1 | 5/2012 | Murray et al. | |

FOREIGN PATENT DOCUMENTS

| | | | | |
|---|---|---|---|---|
| CN | 102618749 | | 8/2012 | |
| CN | 102618749.1 | A | 8/2012 | |
| JP | S55-141540 | | 11/1980 | |
| JP | H06-192772 | A | 7/1994 | |
| JP | H099-249924 | A | 9/1997 | |
| JP | 11-043730 | | 2/1999 | |
| JP | 11-293367 | | 10/1999 | |
| JP | 10-031379 | | 2/2010 | |
| TW | 201221661 | A1 | 6/2012 | |
| WO | WO-2010/030597 | | 3/2010 | |
| WO | WO 2011/155648 | A1 * | 12/2011 | C22C 9/05 |
| WO | WO-2012/058628 | A | 5/2012 | |

OTHER PUBLICATIONS

Notification of Transmittal of the International Search Report and the Written Opinion of the International Searching Authority for PCT/US2013/066601, dated Jan. 21, 2014, 10 pages.

AZO Materials. Copper Allow (UNS C99700). Jul. 15, 2013. [retrieved on Dec. 5, 2014]. Retrieved from the internet <URL:http://www.azom.com/article.aspx?ArticleID=9044>. entire document.

Copper Development Association, Inc. C99760. 2014 [retrieved on Dec. 5, 2014]. Retrieved from the Internet <URL: http://alloys.copper.org/alloy/C99760?referrer=facetedsearch>. entire document.

Copper Development Association, Inc. C99761. 2014 [retrieved on Dec. 5, 2014]. Retrieved from the Internet <URL: http://alloys.copper.org/alloy/C99761?referrer=facetedsearch>. entire document.

Copper Development Association, Inc. C99770. 2014 [retrieved on Dec. 5, 2014]. Retrieved from the Internet <URL: http://alloys.copper.org/alloy/C99770?referrer=facetedsearch>. entire document.

Copper Development Association, Inc. C99771. 2014 [retrieved on Dec. 5, 2014]. Retrieved from the Internet <URL: http://alloys.copper.org/alloy/C99771?referrer=facetedsearch>. entire document.

Notification of Transmittal of the International Search Report and the Written Opinion of the International Searching Authority, or the Declaration, for PCT/US2014/059496, dated Jan. 13, 2015, 8 pages.

English Translation of the First Office Action for CN Application No. 201380066619.6 issued on Apr. 27, 2016, 12 pages.

First Office Action for JP Application No. 2016-537029 dated Oct. 24, 2016, 7 pages (with English translation).

First Office Action and Search Report for TW Application No. 102138651 dated Nov. 29, 2016, 12 pages (with partial English translation).

* cited by examiner

| CDA NO. | Cu | Ni | Zn | Mn | S | Sb | Sn | Fe | Al | P | Pb | Si | Bi | C | Bi |
|---|---|---|---|---|---|---|---|---|---|---|---|---|---|---|---|
| C99700 | 54 min | 4.0–6.0 | 19.0–25.0 | 11.0–15.0 | | | 1.0 | 1.0 | 0.50–3.0 | – | 2.0 | – | – | | |
| C99710 | 60 min | 4.0–6.0 | 19.0–25.0 | 11.0–15.0 | — | — | 1.0 | 1.0 | 1.0 | — | 0.09 | — | — | — | |
| C99720 | 54.0–59.0 | 5.0–6.0 | 18.0–24.0 | 11.0–14.0 | | | 1.5–2.0 | 0.6–1.0 | 1.0–1.4 | 0.005 | 0.005 | 0.005 | 2.0–3.0 | | |
| C99730 | 62.0–66.0 | 4.0–6.0 | 16.0–20.0 | 12.0–15.0 | | | 0.5–2.0 | 0.5 | 0.30–1.0 | 0.05 | 0.05 | 0.05 | 0.50–2.0 | | |
| C99740 | 55.0–60.0 | 5.0–6.0 | 17.0–23.0 | 11.0–14.0 | | | 1.5–2.0 | 0.6–1.0 | 1.0–1.4 | 0.05 | 0.05 | 0.05 | 3.0–4.0 | | |
| C99750 | 55.0–61.0 | 5.0 | 17.0–23.0 | 17.0–23.0 | | | – | 1.0 | 0.25–3.0 | – | 0.50–2.5 | – | – | | |
| 6,149,739 | 53–59 | 5.0–7.0 | 18–24 | 11–15 | * | * | * | 0.8–2.0 | 1.0–3.0 | * | * | * | 2.0–4.0 | | |
| WHITE TOMBASIL | 58.0 | 5.0 | 22.0 | 12.0 | * | * | * | 1.0 max | 0.6–0.9 | * | 1.5–2.0 | * | | | |
| 8,097,208 | 61–66 | 4.0–6.0 | 16–20 | 11–15 | * | * | 0.5–2.0 | 0–0.5 | 0.3–1.5 | * | * | * | 0.5–2.0 | | |
| C99780 | 62–66 | 4–6 | 16–22 | 12–15 | | | 0.5–2.0 | 0.5 | 0.3–1.0 | 0.05 | 0.05 | 0.05 | | | 0.5–2.0 |

*INCIDENTAL

FIG. 1

SAND CASTING, C99760

| HEAT NO. | Cu | Ni | Zn | Mn | S | Sb | Sn | Fe | Al | P | Pb | Si | C |
|---|---|---|---|---|---|---|---|---|---|---|---|---|---|
| AIM | 61-67 | 8-12 | 8-14 | 10-16 | 0.25 | 0.1-1.0 | 0.2-1.0 | 0.6 | 0.6 | 0.05 | 0.09 | 0.05 | 0.10 |
| 99X102-090612-H1P1-7-C | 65.22 | 9.96 | 12.45 | 10.25 | 0.013 | 0.460 | 0.695 | 0.400 | 0.470 | 0.026 | 0.008 | 0.029 | 0.008 |
| 99X102-090612-H1P2-7-C | 64.86 | 10.69 | 12.13 | 10.12 | 0.018 | 0.580 | 0.639 | 0.402 | 0.479 | 0.017 | 0.015 | 0.028 | 0.008 |
| 99760-022713-P3H1C-7* | 64.47 | 10.52 | 10.24 | 12.56 | 0.043 | 0.389 | 0.623 | 0.811* | 0.264 | 0.032 | 0.006 | 0.022 | 0.010 |
| 99760-022713-P3H2C-7 | 63.05 | 10.71 | 10.36 | 13.87 | 0.023 | 0.369 | 0.630 | 0.578 | 0.342 | 0.031 | 0.005 | 0.006 | 0.016 |
| 99760-022713-P3H3C-7 | 62.77 | 10.57 | 10.55 | 14.08 | 0.016 | 0.335 | 0.634 | 0.632 | 0.344 | 0.033 | 0.006 | 0.006 | 0.014 |
| 99760-040413-P3H5C-7 | 62.95 | 10.21 | 10.97 | 13.97 | 0.022 | 0.437 | 0.661 | 0.387 | 0.293 | 0.038 | 0.007 | 0.031 | 0.010 |
| 99760-042513-P3H6C-27 | 63.25 | 10.18 | 10.46 | 14.23 | 0.010 | 0.355 | 0.646 | 0.481 | 0.288 | 0.035 | 0.006 | 0.033 | 0.012 |
| 99760-072313-P13H1-7 | 65.32 | 8.77 | 11.96 | 12.29 | 0.008 | 0.214 | 0.868 | 0.197 | 0.296 | 0.052 | 0.007 | 0.002 | 0.004 |
| 99760-072313-P13H2-7 | 63.84 | 11.64 | 9.40 | 13.49 | 0.010 | 0.257 | 0.699 | 0.186 | 0.398 | 0.052 | 0.008 | 0.002 | 0.006 |
| 99760-072313-P13H3-7 | 63.73 | 9.35 | 12.52 | 12.65 | 0.010 | 0.239 | 0.800 | 0.219 | 0.404 | 0.050 | 0.007 | 0.003 | 0.005 |
| 99760-072313-P13H4-7 | 65.97 | 11.10 | 11.83 | 9.92 | 0.011 | 0.277 | 0.427 | 0.197 | 0.194 | 0.048 | 0.008 | 0.002 | 0.004 |
| 99760-072313-P13H5-7 | 66.65 | 10.08 | 9.54 | 12.14 | 0.012 | 0.257 | 0.745 | 0.205 | 0.293 | 0.052 | 0.006 | 0.002 | 0.004 |
| 99760-072313-P13H6-7** | 67.62 ** | 10.70 | 8.74 | 11.30 | 0.012 | 0.272 | 0.867 | 0.047 | 0.362 | 0.054 | 0.007 | 0.002 | 0.005 |
| 99760-091013-P13H13-7 | 63.62 | 8.70 | 12.34 | 13.16 | 0.017 | 0.714 | 0.847 | 0.316 | 0.223 | 0.036 | 0.008 | 0.002 | 0.007 |
| 99760-091013-P13H15-7 | 65.78 | 9.99 | 10.70 | 11.21 | 0.029 | 0.664 | 0.786 | 0.426 | 0.351 | 0.038 | 0.008 | 0.002 | 0.005 |

*Fe IS HIGHER THAN THE 0.6% MAX **COPPER IS OVER THE UPPER LIMIT OF 67%

FIG. 2A

COMPOSITIONS AND MECHANICAL PROPERTIES, C99760, SAND CASTING

| HEAT NO | Cu | Ni | Zn | Mn | S | Sb | Sn | Al | UTS, ksi | YS, ksi | % ELONG | BHN | MoE, Mpsi |
|---|---|---|---|---|---|---|---|---|---|---|---|---|---|
| AIM | 61–67 | 8–12 | 8–14 | 10–16 | 0.25 | 0.1–1.0 | 0.2–1.0 | 0.6 | | | | | |
| 99X102-090612-HIP1-9A-C-BAR9 | 65.22 | 9.96 | 12.45 | 10.25 | .013 | .460 | .695 | .470 | 42.60 | 22.00 | 29 | 72 | 15.7 |
| 99X102-090612-HIP2-9A-C-BAR9 | 64.86 | 10.69 | 12.13 | 10.12 | .018 | .580 | .639 | .479 | 43.50 | 23.00 | 30 | 69 | 15.7 |
| 99760-022713-P3H1C-9B* | 64.47 | 10.52 | 10.24 | 12.56 | .043 | .389 | .623 | .264 | 47.20 | 21.90 | 38 | 74 | 16.0 |
| 99760-022713-P3H2C-9A | 63.05 | 10.71 | 10.36 | 13.87 | .023 | .369 | .630 | .342 | 46.80 | 21.40 | 39 | 74 | 16.0 |
| 99760-022713-P3H3C-9A | 62.77 | 10.57 | 10.55 | 14.08 | .016 | .335 | .634 | .344 | 47.60 | 22.20 | 39 | 72 | 16.1 |
| 99760-022713-P3H3C-9B | 62.77 | 10.57 | 10.55 | 14.08 | .016 | .335 | .634 | .344 | 48.50 | 22.50 | 39 | 69 | 16.0 |
| 99760-040413-P3H4C-1A | 63.58 | 9.79 | 11.13 | 13.58 | .025 | .463 | .656 | .203 | 44.10 | 24.10 | 24 | 80 | 15.4 |
| 99760-040413-P3H5C-1A | 62.95 | 10.21 | 10.97 | 13.97 | .022 | .437 | .661 | .293 | 42.10 | 21.60 | 28 | 76 | 15.3 |
| 99760-042513-P3H6C2-1A | 63.25 | 10.18 | 10.46 | 14.23 | 0.010 | 0.355 | 0.646 | .288 | 42.10 | 22.70 | 27 | 74 | 15.3 |
| 99760-042513-P3H6C2-1B | 63.25 | 10.18 | 10.46 | 14.23 | 0.010 | 0.355 | 0.646 | .288 | 47.00 | 22.90 | 35 | 74 | 15.2 |
| 99760-072313-P13H1-3A | 65.32 | 8.77 | 11.96 | 12.29 | 0.008 | 0.214 | 0.868 | .296 | 44.90 | 18.77 | 46 | 65 | 15.4 |
| 99760-072313-P13H2-3A | 63.84 | 11.64 | 9.40 | 13.49 | 0.010 | 0.257 | 0.699 | .398 | 47.20 | 20.90 | 45 | 69 | 15.6 |
| 99760-072313-P13H2-3B | 63.84 | 11.64 | 9.40 | 13.49 | 0.010 | 0.257 | 0.699 | .398 | 43.10 | 21.00 | 36 | 67 | 15.6 |
| 99760-072313-P13H3-3A | 63.73 | 9.35 | 12.52 | 12.65 | 0.010 | 0.239 | 0.800 | .404 | 44.30 | 19.77 | 41 | 69 | 15.4 |
| 99760-072313-P13H3-3B | 63.73 | 9.35 | 12.52 | 12.65 | 0.010 | 0.239 | 0.800 | .404 | 44.40 | 19.93 | 40 | 65 | 15.4 |
| 99760-072313-P13H5-3B | 66.65 | 10.08 | 9.54 | 12.14 | 0.012 | 0.257 | 0.745 | .293 | 45.60 | 20.20 | 40 | 69 | 15.5 |
| 99760-072313-P13H6-3A** | 67.62 | 10.70 | 8.74 | 11.30 | 0.012 | 0.272 | 0.867 | .362 | 45.30 | 21.00 | 35 | 69 | 15.5 |
| 99760-072313-P13H6-3B** | 67.62 | 10.70 | 8.74 | 11.30 | 0.012 | 0.272 | 0.867 | .362 | 45.70 | 20.00 | 43 | 69 | 15.5 |
| 99760-091013-P13H13-3A | 63.62 | 8.70 | 12.34 | 13.16 | 0.017 | 0.714 | 0.847 | .223 | 40.60 | 22.80 | 23 | 74 | 15.4 |
| 99760-091013-P13H13-3B | 63.62 | 8.70 | 12.34 | 13.16 | 0.017 | 0.714 | 0.847 | .223 | 45.40 | 23.00 | 31 | 74 | 15.3 |
| 99760-091013-P13H15-3A | 65.78 | 9.99 | 10.70 | 11.21 | 0.029 | 0.664 | 0.786 | .351 | 45.00 | 23.40 | 29 | 69 | 15.3 |
| 99760-091013-P13H15-3B | 65.78 | 9.99 | 10.70 | 11.21 | 0.029 | 0.664 | 0.786 | .351 | 44.00 | 23.20 | 29 | 69 | 15.3 |
| AVERAGE | | | | | | | | | 44.86 | 21.73 | 35 | 71 | 15.54 |

*Fe IS OVER THE 0.6% MAX
**COPPER IS OVER THE UPPER LIMIT

FIG. 2B

PM CASTING, C99760

| HEAT NO. | Cu | Ni | Zn | Mn | S | Sb | Sn | Fe | Al | P | Pb | Si | C |
|---|---|---|---|---|---|---|---|---|---|---|---|---|---|
| AIM | 61–67 | 8–12 | 8–14 | 10–16 | 0.25 | 0.1–1.0 | 0.2–1.0 | 0.6 | 0.6 | 0.05 | 0.09 | 0.05 | 0.10 |
| | | | | | | | | | | | | | |
| 99X102–090612–H1P4–1 | 65.80 | 9.74 | 12.75 | 9.82 | 0.010 | 0.525 | 0.622 | 0.285 | 0.355 | 0.026 | 0.015 | 0.036 | 0.006 |
| 99X103–090712–H9P1–1 | 64.93 | 9.77 | 12.86 | 10.01 | 0.027 | 0.547 | 1.03 | 0.270 | 0.547 | 0.024 | 0.015 | 0.038 | 0.005 |
| 99760–100913–P13H7–9 | 64.74 | 8.38 | 11.24 | 13.62 | .003 | .440 | .870 | .318 | .313 | .034 | .008 | .024 | .003 |
| 99760–101013–P13H8–9 | 63.19 | 11.54 | 9.22 | 14.07 | .003 | .547 | .764 | .285 | .307 | .036 | .007 | .014 | .006 |
| 99760–101013–P13H9–9 | 62.60 | 9.09 | 12.50 | 13.67 | .002 | .636 | .846 | .164 | .420 | .034 | .008 | .017 | .004 |
| 99760–101013–P13H10–9 | 65.74 | 10.83 | 10.99 | 10.35 | .008 | .508 | .808 | .289 | .406 | .035 | .0007 | .016 | .004 |
| 99760–101113–P13H11–9 | 66.12 | 9.26 | 9.64 | 12.77 | .005 | .637 | .888 | .277 | .335 | .034 | .005 | .016 | .007 |
| 99760–101213–P13H12–9 | 66.67 | 10.34 | 8.56 | 11.69 | .011 | .623 | .898 | .337 | .400 | .035 | .007 | .015 | .007 |
| | | | | | | | | | | | | | |

FIG. 2C

COMPOSITIONS AND MECHANICAL PROPERTIES, C99760, PM CASTING

| HEAT NO | Cu | Ni | Zn | Mn | S | Sb | Sn | Al | UTS, ksi | YS, ksi | % ELONG | BHN | MoE, Mpsi |
|---|---|---|---|---|---|---|---|---|---|---|---|---|---|
| AIM | 61–67 | 8–12 | 8–14 | 10–16 | 0.25 | 0.1–1.0 | 0.2–1.0 | 0.6 | | | | | |
| 99X102-090612-H1P4-2 | 65.80 | 9.74 | 12.75 | 9.82 | .010 | .525 | 0.622 | .355 | 40.80 | 26.00 | 11 | 86 | 14.6 |
| 99X102-090612-H1P4-3 | 65.80 | 9.74 | 12.75 | 9.82 | .010 | .525 | 0.622 | .355 | 46.10 | 26.10 | 18 | 80 | 14.4 |
| 99X103-090712-H9P1-2 | 64.93 | 9.77 | 12.86 | 10.01 | .027 | .464 | 1.03 | .547 | 40.60 | 26.40 | 13 | 86 | 14.4 |
| 99X103-090712-H9P1-3 | 64.93 | 9.77 | 12.86 | 10.01 | .027 | .464 | 1.03 | .547 | 41.80 | 27.40 | 12 | 86 | 14.8 |
| 99760-100913-P13H7-2 | 64.74 | 8.38 | 11.24 | 13.62 | .003 | .440 | .870 | .313 | 41.30 | 25.80 | 12 | 80 | 15.5 |
| 99760-100913-P13H7-3 | 64.74 | 8.38 | 11.24 | 13.62 | .003 | .440 | .870 | .313 | 47.60 | 25.80 | 16 | 81 | 15.4 |
| 99760-100913-P13H7-5 | 64.74 | 8.38 | 11.24 | 13.62 | .003 | .440 | .870 | .313 | 45.50 | 26.20 | 14 | 82 | 15.4 |
| 99760-101013-P13H8-2 | 63.19 | 11.54 | 9.22 | 14.07 | .003 | .547 | .764 | .307 | 39.90 | 26.30 | 9 | 83 | 15.5 |
| 99760-101013-P13H8-5 | 63.19 | 11.54 | 9.22 | 14.07 | .003 | .547 | .764 | .307 | 39.60 | 26.00 | 9 | 83 | 15.4 |
| 99760-101013-P13H9-2 | 62.60 | 9.09 | 12.50 | 13.67 | .002 | .636 | .846 | .420 | 47.10 | 26.80 | 14 | 80 | 15.3 |
| 99760-101013-P13H9-3 | 62.60 | 9.09 | 12.50 | 13.67 | .002 | .636 | .846 | .420 | 47.80 | 27.00 | 13 | 81 | 15.4 |
| 99760-101013-P13H9-4 | 62.60 | 9.09 | 12.50 | 13.67 | .002 | .636 | .846 | .420 | 44.80 | 26.70 | 12 | 80 | 15.4 |
| 99760-101013-P13H9-5 | 62.60 | 9.09 | 12.50 | 13.67 | .002 | .636 | .846 | .420 | 45.00 | 26.50 | 13 | 82 | 15.4 |
| 99760-101013-P13H10-3 | 65.74 | 10.83 | 10.99 | 10.35 | .008 | .508 | .808 | .406 | 45.00 | 25.00 | 15 | 80 | 15.3 |
| 99760-101013-P13H10-4 | 65.74 | 10.83 | 10.99 | 10.35 | .008 | .508 | .808 | .406 | 47.00 | 24.90 | 16 | 81 | 15.3 |
| 99760-101013-P13H10-5 | 65.74 | 10.83 | 10.99 | 10.35 | .008 | .508 | .808 | .406 | 48.40 | 24.90 | 19 | 80 | 15.4 |
| 99760-101113-P13H11-5 | 66.12 | 9.26 | 9.64 | 12.77 | .005 | .637 | .888 | .335 | 45.40 | 25.90 | 14 | 82 | 15.2 |
| 99760-101213-P13H12-3 | 66.67 | 10.34 | 8.56 | 11.69 | .011 | .623 | .898 | .400 | 41.50 | 25.60 | 12 | 80 | 15.0 |
| 99760-101213-P13H12-5 | 66.67 | 10.34 | 8.56 | 11.69 | .011 | .623 | .898 | .400 | 49.90 | 26.70 | 12 | 82 | 15.5 |
| AVERAGE | | | | | | | | | 44.50 | 26.10 | 13 | 82 | 15.189 |

FIG. 2D

SAND CASTING, C99770

| HEAT NO. | Cu | Ni | Zn | Mn | S | Sb | Sn | Fe | Al | P | Pb | Si | C |
|---|---|---|---|---|---|---|---|---|---|---|---|---|---|
| AIM | 66–70 | 3–6 | 8–14 | 10–16 | 0.25 | 0.1–1.0 | 0.2–1.0 | 0.6 | 0.6 | 0.05 | 0.09 | 0.05 | 0.10 |
| 99770–052313–P7H1–7 | 67.71 | 5.32 | 11.99 | 12.88 | .011 | .514 | .669 | .508 | .344 | .031 | .007 | .002 | .004 |
| 99770–052313–P7H2–7 | 67.59 | 5.49 | 11.92 | 12.96 | .015 | .487 | .641 | .517 | .323 | .032 | .006 | .002 | .009 |
| 99770–052313–P7H3–7 | 67.78 | 5.23 | 12.00 | 12.94 | .012 | .494 | .653 | .522 | .317 | .031 | .007 | .002 | .004 |
| 99770–052313–P7H4–7 | 67.86 | 5.15 | 11.94 | 13.02 | .012 | .540 | .628 | .422 | .376 | .033 | .007 | .002 | .003 |
| 99770–052313–P7H5–7 | 67.83 | 5.25 | 12.01 | 12.83 | .014 | .585 | .615 | .447 | .364 | .030 | .008 | .002 | .003 |
| 99770–052313–P7H6–7 | 68.05 | 5.13 | 11.85 | 12.85 | .009 | .535 | .612 | .523 | .393 | .030 | .007 | .002 | .002 |
| 99770–081513–P10H1A–7 | 70.43 | 4.49 | 10.87 | 12.12 | .023 | .919 | .585 | .232 | .257 | .048 | .007 | .002 | .004 |
| 99770–081513–P10H2–7* | 71.42 | 3.89 | 9.12 | 13.76 | .019 | .567 | .616 | .194 | .339 | .050 | .007 | .002 | .003 |
| 99770–081513–P10H3–7 | 68.59 | 5.37 | 10.95 | 13.17 | .012 | .635 | .693 | .150 | .353 | .052 | .009 | .001 | .002 |
| 99770–081613–P10H4–7 | 70.38 | 4.80 | 13.07 | 10.02 | .019 | .573 | .632 | .196 | .253 | .038 | .007 | .003 | .001 |
| 99770–081613–P10H6–7* | 71.26 | 3.60 | 9.12 | 13.93 | .022 | .539 | .930 | .232 | .294 | .042 | .008 | .007 | .004 |
| 99770–081913–P10H7–7 | 68.58 | 5.15 | 13.00 | 11.01 | .016 | .693 | .940 | .198 | .343 | .048 | .008 | .003 | .003 |
| 99770–081913–P10H8–7 | 70.04 | 5.55 | 8.86 | 13.65 | .015 | .525 | .815 | .174 | .295 | .048 | .009 | .002 | .004 |
| 99770–081913–P10H9–7 | 69.88 | 5.30 | 12.06 | 10.62 | .025 | .625 | .834 | .273 | .306 | .049 | .010 | .003 | .002 |
| 99770–081913–P10H10–7* | 71.82 | 4.13 | 9.06 | 13.31 | .014 | .488 | .614 | .181 | .309 | .052 | .009 | .002 | .002 |
| 99770–091213–P10H21–7 | 67.43 | 4.65 | 13.27 | 12.65 | .017 | .871 | .586 | .232 | .229 | .040 | .009 | .002 | .001 |
| 99770–091213–P10H22–7 | 67.42 | 4.20 | 12.31 | 14.11 | .013 | .625 | .536 | .220 | .308 | .038 | .008 | .002 | .002 |
| 99770–091313–P10H23–7 | 68.62 | 3.74 | 12.52 | 13.12 | .010 | .703 | .822 | .201 | .202 | .040 | .010 | .001 | .001 |
| 99770–091313–P10H24–7 | 68.39 | 3.59 | 11.97 | 14.13 | .011 | .453 | .864 | .191 | .341 | .038 | .009 | .002 | .001 |
| 99770–091313–P10H25–7 | 68.46 | 4.66 | 10.23 | 14.60 | .012 | .580 | .826 | .221 | .348 | .039 | .009 | .001 | .001 |

*Cu CONTENT IS HIGHER THAN THE 70% SPECIFICATION.

FIG. 3A

| HEAT NO. | Cu | Ni | Zn | Mn | S | Sb | Sn | Al | UTS, | YS, ksi | %ELONG | BHN | MoE, |
|---|---|---|---|---|---|---|---|---|---|---|---|---|---|
| AIM | 66–70 | 3–6 | 8–14 | 10–16 | 0.25 | 0.1–1.0 | 0.2–1.0 | 0.6 | | | | | |
| 99770-052313-P7H1-2A | 67.71 | 5.32 | 11.99 | 12.88 | .011 | .514 | .669 | .344 | 44.70 | 20.50 | 34 | 65 | 15.4 |
| 99770-052313-P7H1-2B | 67.71 | 5.32 | 11.99 | 12.88 | .011 | .514 | .669 | .344 | 47.50 | 20.30 | 44 | 65 | 15.3 |
| 99770-052313-P7H2-2A | 67.59 | 5.49 | 11.92 | 12.96 | .015 | .487 | .641 | .323 | 47.10 | 20.40 | 40 | 69 | 15.3 |
| 99770-052313-P7H2-2B | 67.59 | 5.49 | 11.92 | 12.96 | .015 | .487 | .641 | .323 | 49.00 | 20.70 | 45 | 61 | 15.4 |
| 99770-052313-P7H3-2B | 67.78 | 5.23 | 12.00 | 12.94 | .012 | .494 | .653 | .317 | 47.70 | 20.80 | 36 | 69 | 15.3 |
| 99770-052313-P7H4-2A | 67.86 | 5.15 | 11.94 | 13.02 | .012 | .540 | .628 | .376 | 46.70 | 19.37 | 42 | 65 | 15.2 |
| 99770-052313-P7H5-2A | 67.83 | 5.25 | 12.01 | 12.83 | .014 | .585 | .615 | .364 | 46.70 | 20.30 | 38 | 62 | 15.3 |
| 99770-052313-P7H5-2B | 67.83 | 5.25 | 12.01 | 12.83 | .014 | .585 | .615 | .364 | 46.80 | 20.40 | 40 | 65 | 15.3 |
| 99770-052313-P7H6-2A | 68.05 | 5.13 | 11.85 | 12.85 | .009 | .535 | .612 | .393 | 47.60 | 20.60 | 41 | 65 | 15.3 |
| 99770-052313-P7H6-2B | 68.05 | 5.13 | 11.85 | 12.85 | .009 | .535 | .612 | .393 | 46.00 | 21.10 | 35 | 69 | 15.4 |
| 99770-081513-P10H1A-2B | 70.43 | 4.49 | 10.87 | 12.12 | .023 | .919 | .585 | .257 | 39.50 | 18.63 | 30 | 65 | 15.0 |
| 99770-081513-P10H2-2B* | 71.42 | 3.89 | 9.12 | 13.76 | .019 | .567 | .616 | .339 | 46.10 | 19.55 | 42 | 64 | 15.2 |
| 99770-081513-P10H3-2A | 68.59 | 5.37 | 10.95 | 13.17 | .012 | .635 | .693 | .353 | 44.20 | 19.15 | 36 | 65 | 15.0 |
| 99770-081613-P10H4-2A | 70.38 | 4.80 | 13.07 | 10.02 | .019 | .573 | .632 | .253 | 41.10 | 18.16 | 34 | 64 | 15.1 |
| 99770-081613-P10H4-2B | 70.38 | 4.80 | 13.07 | 10.02 | .019 | .573 | .632 | .253 | 40.20 | 18.21 | 31 | 65 | 15.0 |
| 99770-081613-P10H6-2A* | 71.26 | 3.60 | 9.12 | 13.93 | .022 | .539 | .930 | .294 | 40.70 | 19.63 | 29 | 65 | 15.2 |
| 99770-081613-P10H6-2B* | 71.26 | 3.60 | 9.12 | 13.93 | .022 | .539 | .930 | .294 | 45.20 | 19.12 | 37 | 65 | 15.2 |
| 99770-081913-P10H7-2A | 68.58 | 5.15 | 13.00 | 11.01 | .016 | .693 | .940 | .343 | 41.80 | 18.82 | 27 | 67 | 15.2 |
| 99770-081913-P10H7-2B | 68.58 | 5.15 | 13.00 | 11.01 | .016 | .693 | .940 | .343 | 40.50 | 19.45 | 29 | 69 | 15.2 |
| 99770-081913-P10H8-2A | 70.04 | 5.55 | 8.86 | 13.65 | .015 | .525 | .815 | .295 | 44.80 | 18.87 | 38 | 65 | 15.1 |
| 99770-081913-P10H8-2B | 70.04 | 5.55 | 8.86 | 13.65 | .015 | .525 | .815 | .295 | 41.90 | 18.74 | 35 | 65 | 15.1 |
| 99770-081913-P10H9-2A | 69.88 | 5.30 | 12.06 | 10.62 | .025 | .625 | .834 | .306 | 43.70 | 18.06 | 39 | 65 | 15.0 |
| 99770-081913-P10H9-2B | 69.88 | 5.30 | 12.06 | 10.62 | .025 | .625 | .834 | .306 | 40.20 | 18.00 | 32 | 69 | 15.0 |
| 99770-081913-P10H10-2A | 71.82 | 4.13 | 9.06 | 13.31 | .014 | .488 | .614 | .309 | 43.20 | 17.73 | 39 | 65 | 15.0 |
| 99770-081913-P10H10-2B* | 71.82 | 4.13 | 9.06 | 13.31 | .014 | .488 | .614 | .309 | 42.30 | 18.42 | 34 | 65 | 15.1 |
| 99770-091213-P10H21-2A | 67.43 | 4.65 | 13.27 | 12.65 | .017 | .871 | .586 | .229 | 41.90 | 19.80 | 28 | 65 | 14.9 |
| 99770-091213-P10H21-2B | 67.43 | 4.65 | 13.27 | 12.65 | .017 | .871 | .586 | .229 | 41.70 | 19.55 | 28 | 65 | 15.1 |
| 99770-091213-P10H22-2A | 67.42 | 4.20 | 12.31 | 14.11 | .013 | .625 | .536 | .308 | 40.00 | 19.16 | 28 | 65 | 15.1 |
| 99770-091213-P10H22-2B | 67.42 | 4.20 | 12.31 | 14.11 | .013 | .625 | .536 | .308 | 44.90 | 18.92 | 39 | 69 | 14.9 |
| 99770-091313-P10H23-2A | 68.62 | 3.74 | 12.52 | 13.12 | .010 | .703 | .822 | .201 | 40.90 | 18.72 | 32 | 67 | 14.9 |
| 99770-091313-P10H23-2B | 68.62 | 3.74 | 12.52 | 13.12 | .010 | .703 | .822 | .201 | 42.90 | 18.78 | 36 | 65 | 14.9 |
| 99770-091313-P10H24-2A | 68.39 | 3.59 | 11.97 | 14.13 | .011 | .453 | .864 | .341 | 45.00 | 18.91 | 41 | 65 | 15.0 |
| 99770-091313-P10H24-2B | 68.39 | 3.59 | 11.97 | 14.13 | .011 | .453 | .864 | .341 | 45.30 | 19.05 | 44 | 67 | 15.0 |
| 99770-091313-P10H25-2A | 68.46 | 4.66 | 10.23 | 14.60 | .012 | .580 | .826 | .348 | 42.10 | 19.20 | 34 | 67 | 15.0 |
| 99770-091313-P10H25-2B | 68.46 | 4.66 | 10.23 | 14.60 | .012 | .580 | .826 | .348 | 44.00 | 18.73 | 39 | 66 | 14.9 |
| AVERAGE | | | | | | | | | 43.80 | 19.32 | 36 | 66 | 15.12 |

COMPOSITIONS AND MECHANICAL PROPERTIES C99770, SAND CASTING *Cu CONTENT IS HIGHER THAN THE 70% SPECIFICATION.

FIG. 3B

PERMANENT MOLD CASTING, C99770

| HEAT NO. | Cu | Ni | Zn | Mn | S | Sb | Sn | Fe | Al | P | Pb | Si | C |
|---|---|---|---|---|---|---|---|---|---|---|---|---|---|
| AIM | 66–70 | 3–6 | 8–14 | 10–16 | 0.25 | 0.1–1.0 | 0.2–1.0 | 0.6 | 0.6 | 0.05 | 0.09 | 0.05 | 0.10 |
| 99770-081513-P10H16-9 | 71.14 | 3.76 | 9.70 | 13.63 | .003 | .255 | .872 | .221 | .364 | .036 | .007 | .002 | .001 |
| 99770-100713-P10H12-9 | 69.64 | 4.14 | 9.51 | 14.84 | .003 | .462 | .634 | .294 | .403 | .036 | .009 | .019 | .003 |
| 99770-100813-P10H14-9 | 69.86 | 4.65 | 14.19 | 9.43 | .002 | .631 | .620 | .249 | .302 | .036 | .007 | .011 | .001 |
| 99770-100813-P10H15-9 | 69.35 | 3.52 | 13.85 | 11.36 | .001 | .626 | .770 | .240 | .219 | .034 | .008 | .011 | .001 |
| 99770-100813-P10H16-9 | 70.35 | 3.41 | 9.95 | 14.33 | .004 | .475 | .838 | .163 | .413 | .033 | .008 | .015 | .003 |
| 99770-100913-P10H19-9 | 67.92 | 5.33 | 12.76 | 11.74 | .004 | .664 | .827 | .292 | .398 | .034 | .006 | .012 | .003 |

FIG. 3C

COMPOSITIONS AND MECHANICAL PROPERTIES, C99770, PM CASTING

| HEAT NO | Cu | Ni | Zn | Mn | S | Sb | Sn | Al | UTS, ksi | YS, ksi | % ELONG | BHN | MoE, Mpsi |
|---|---|---|---|---|---|---|---|---|---|---|---|---|---|
| AIM | 66–70 | 3–6 | 8–14 | 10–16 | 0.25 | 0.1–1.0 | 0.2–1.0 | 0.6 | | | | | |
| 99770–081513–P10H16–1 | 71.14 | 3.76 | 9.70 | 13.63 | .003 | .255 | .872 | .364 | 41.00 | 23.10 | 15 | 80 | 15.6 |
| 99770–081513–P10H16–2 | 71.14 | 3.76 | 9.70 | 13.63 | .003 | .255 | .872 | .364 | 38.40 | 22.70 | 12 | 77 | 15.7 |
| 99770–081513–P10H16–3 | 71.14 | 3.76 | 9.70 | 13.63 | .003 | .255 | .872 | .364 | 44.20 | 22.90 | 18 | 80 | 15.8 |
| 99770–081513–P10H16–4 | 71.14 | 3.76 | 9.70 | 13.63 | .003 | .255 | .872 | .364 | 42.60 | 22.50 | 16 | 77 | 15.6 |
| 99770–100713–P10H12–2 | 69.64 | 4.14 | 9.51 | 14.84 | .003 | .462 | .634 | .403 | 49.10 | 24.00 | 20 | 74 | 15.4 |
| 99770-100713-P10H12-346.20 | 69.64 | 4.14 | 9.51 | 14.84 | .003 | .462 | .634 | .403 | 46.20 | 23.90 | 17 | 74 | 15.3 |
| 99770–100713–P10H12–3 | 69.64 | 4.14 | 9.51 | 14.84 | .003 | .462 | .634 | .403 | 42.10 | 22.80 | 15 | 76 | 15.1 |
| 99770–100713–P10H12–4 | 69.64 | 4.14 | 9.51 | 14.84 | .003 | .462 | .634 | .403 | 42.40 | 23.40 | 14 | 74 | 15.4 |
| 99770–100813–P10H14–3 | 69.86 | 4.65 | 14.19 | 9.43 | .002 | .631 | .620 | .302 | 39.00 | 22.20 | 13 | 74 | 15.1 |
| 99770–100813–P10H14–5 | 69.86 | 4.65 | 14.19 | 9.43 | .002 | .631 | .620 | .302 | 43.50 | 22.70 | 16 | 70 | 15.2 |
| 99770–100813–P10H15–2 | 69.35 | 3.52 | 13.85 | 11.36 | .001 | .626 | .770 | .219 | 48.50 | 23.00 | 20 | 72 | 15.3 |
| 99770–100813–P10H15–3 | 69.35 | 3.52 | 13.85 | 11.36 | .001 | .626 | .770 | .219 | 41.50 | 22.70 | 12 | 72 | 15.2 |
| 99770–100813–P10H15–4 | 69.35 | 3.52 | 13.85 | 11.36 | .001 | .626 | .770 | .219 | 38.30 | 22.30 | 15 | 65 | 15.2 |
| 99770–100813–P10H15–5 | 69.35 | 3.52 | 13.85 | 11.36 | .001 | .626 | .770 | .219 | 44.00 | 22.60 | 14 | 76 | 15.2 |
| 99770–100813–P10H16–2 | 70.35 | 3.41 | 9.95 | 14.33 | .004 | .475 | .838 | .413 | 49.30 | 23.10 | 23 | 77 | 15.1 |
| 99770–100813–P10H16–3 | 70.35 | 3.41 | 9.95 | 14.33 | .004 | .475 | .838 | .413 | 49.80 | 23.90 | 23 | 74 | 15.2 |
| 99770–100813–P10H16–4 | 70.35 | 3.41 | 9.95 | 14.33 | .004 | .475 | .838 | .413 | 50.90 | 23.90 | 22 | 74 | 15.3 |
| 99770–100813–P10H16–5 | 70.35 | 3.41 | 9.95 | 14.33 | .004 | .475 | .838 | .413 | 45.60 | 23.30 | 18 | 74 | 15.1 |
| 99770–100913–P10H19–2 | 67.92 | 5.33 | 12.76 | 11.74 | .004 | .664 | .827 | .398 | 44.10 | 24.50 | 14 | 76 | 15.3 |
| 99770–100913–P10H19–3 | 67.92 | 5.33 | 12.76 | 11.74 | .004 | .664 | .827 | .398 | 39.50 | 24.00 | 10 | 80 | 15.2 |
| AVERAGE | | | | | | | | | 44.00 | 23.20 | 16 | 71 | 15.315 |

FIG. 3D

WROUGHT COMPOSITIONS C79880

| ALLOY | Cu | Ni | Zn | Mn | S | Sb | Fe | Pb | P | C | Si |
|---|---|---|---|---|---|---|---|---|---|---|---|
| AIM | 66.0–70.0 | 3.0–6.0 | 10.0–14.0 | 10.0–16.0 | 0.25 | 0.1–1.0 | 0.4 | 0.09 | 0.05 | 0.10 | 0.05 |
| 79880-030813-P4H5-9 | 69.51 | 4.71 | 12.22 | 12.15 | .025 | .650 | .509 | .006 | .052 | .008 | .003 |
| 79880-030813-P4H6-7 | 70.14 | 4.50 | 12.64 | 11.55 | .009 | .570 | .391 | .004 | .049 | .004 | .001 |

FIG. 4A

COMPOSITIONS AND MECHANICAL PROPERTIES, WROUGHT WHITE METAL

| HEAT NO | Cu | Ni | Zn | S | Mn | Sb | UTS, ksi | YS, ksi | % ELONG | BHN | COMMENTS |
|---|---|---|---|---|---|---|---|---|---|---|---|
| 79880-030713-P4H5-7 | 69.51 | 4.71 | 12.22 | .025 | 12.15 | .650 | 96.00 | – | 0.5 | 98 | COLD ROLLED (CR) |
| 79880-030713-P4H6-7 | 70.14 | 4.50 | 12.64 | .009 | 11.55 | .570 | 102.40 | 93.08 | 1 | 98 | COLD ROLLED (CR) |
| | | | | | | | 64.00 | 30.40 | 30 | 57 | CR+ANNEALED, 1100F, 1HR |
| | | | | | | | 65.60 | 31.00 | 30 | 59 | CR+ANNEALED, 1100F, 1HR |
| | | | | | | | 58.20 | 23.60 | 32 | 49 | CR+ANNEALED, 1200F, 1HR |
| | | | | | | | 58.20 | 23.20 | 34 | 49 | CR+ANNEALED, 1200F, 1HR |
| | | | | | | | 58.00 | 22.10 | 35 | 49 | CR+ANNEALED, 1290F, 1HR |
| | | | | | | | 58.00 | 22.10 | 35 | 44 | CR+ANNEALED, 1290F, 1HR |
| | | | | | | | 58.60 | 22.20 | 39 | 44 | CR+ANNEALED, 1290F, 1HR |
| NICKEL SILVER, C74500* | 63.5–66.5 | 9–11 | BAL, 25 NOMINAL | | 0.50 | | 86.00 | 76.00 | 4 | 89 | HARD, H04 |
| | | | | | | | 95.00 | 76.00 | 3 | 92 | EXTRA HARD, H06 |
| | | | | | | | 66.00 | 28.00 | 36 | 52 | ROLLED & ANNEALED,OS015 |
| NICKEL SILVER, C78200 | 63–67 | 7–9 | BAL, 25 NOMINAL | | 0.50 | | 85.00 | 73.00 | 4 | 87 | HARD |
| | | | | | | | 91.00 | 76.00 | 3 | 90 | EXTRA HARD |
| | | | | | | | 69.00 | 58.00 | 12 | 78 | HALF HARD |
| | | | | | | | 59.00 | 27.00 | 32 | | ROLLED & ANNEALED,OS015 |
| | | | | | | | 75.00 | 71.00 | 5 | 80 | HARD, H04 |
| CUPRONICKEL, C71000 | 79 | 12 | | | | | 78.00 | 75.00 | 4 | 82 | EXTRA HARD, H06 |
| | | | | | | | 53.00 | 16.00 | 30 | 32 | ROLLED & ANNEALED,OS025 |

*0.09 Pb, **1.5–2.5 Pb

FIG. 4B

WHITE METAL WITH 0.8wt% Sb

100 μm

P

Zn

Sn

Sb

Ni

SAMPLE 3 500X MAP DATA

SEM

C

O

Mn

Ni

Cu

Zn

Sb

S

P

COMPOSITIONS OF C99760 ALLOYS USED FOR MACHINABILITY EVALUATION

| HEAT NO. | Cu | Ni | Zn | Mn | S | Sb | Sn | Fe | Al | P | Pb | Si | C |
|---|---|---|---|---|---|---|---|---|---|---|---|---|---|
| 99760-072313-P13H1-7 | 65.32 | 8.77 | 11.96 | 12.29 | 0.008 | 0.214 | 0.868 | 0.197 | 0.296 | 0.052 | 0.007 | 0.002 | 0.004 |
| 99760-072313-P13H5-7 | 66.65 | 10.08 | 9.54 | 12.14 | 0.012 | 0.257 | 0.745 | 0.205 | 0.293 | 0.052 | 0.006 | 0.002 | 0.004 |
| 99760-091013-P13H13-7 | 63.62 | 8.70 | 12.34 | 13.16 | 0.017 | 0.714 | 0.847 | 0.316 | 0.223 | 0.036 | 0.008 | 0.002 | 0.007 |
| | | | | | | | | | | | | | |

FIG. 23A

COMPOSITIONS OF C99770 ALLOYS USED FOR MACHINABILITY EVALUATION

| HEAT NO. | Cu | Ni | Zn | Mn | S | Sb | Sn | Fe | Al | P | Pb | Si | C |
|---|---|---|---|---|---|---|---|---|---|---|---|---|---|
| 99770-081613-P10H5-7 | 70.60 | 3.58 | 12.86 | 10.86 | .014 | .868 | .842 | .162 | .154 | .040 | .008 | .002 | .001 |
| 99770-081913-P10H8-7 | 70.04 | 5.55 | 8.86 | 13.65 | .015 | .525 | .815 | .174 | .295 | .048 | .009 | .002 | .004 |
| 99770-091213-P10H21-7 | 67.43 | 4.65 | 13.27 | 12.65 | .017 | .871 | .586 | .232 | .229 | .040 | .009 | .002 | .001 |

FIG. 24A

| ANNEALING TEMPERATURE, °C | HARDNESS, BHN | ANNEALING TEMPERATURE, °F | HARDNESS, BHN |
|---|---|---|---|
| 25 | 98 | 77 | 98 |
| 200 | 99.2 | 390 | 99.2 |
| 300 | 100 | 570 | 100 |
| 400 | 98.5 | 750 | 98.5 |
| 500 | 84.3 | 930 | 84.3 |
| 600 | 72.2 | 1100 | 72.2 |
| 650 | 49 | 1200 | 49 |
| 700 | 47.6 | 1290 | 47.6 |
| 800 | 38.8 | 1470 | 38.8 |
FIG. 25A
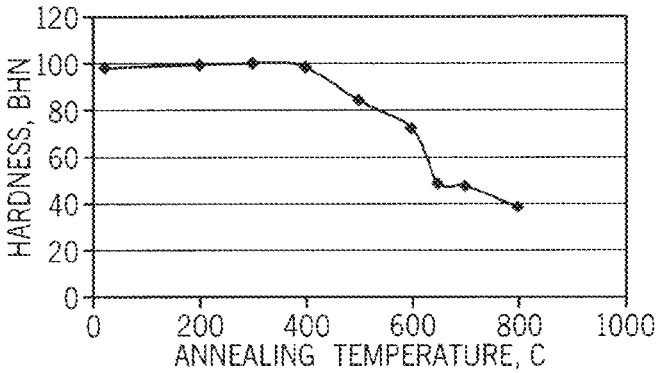
FIG. 25B
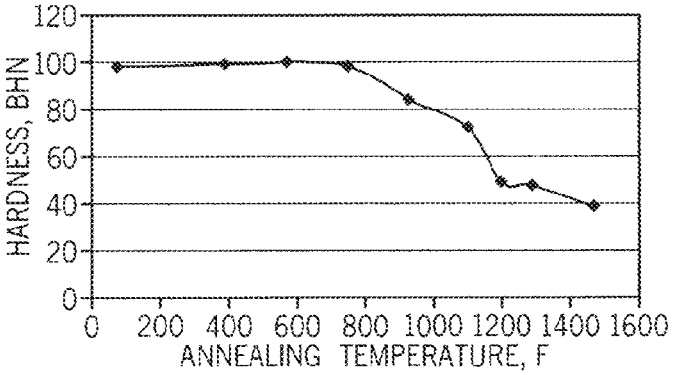
FIG. 25C

SAND CASTING, C99760–EFFECT OF ANTIMONY

| HEAT NO. | Cu | Ni | Zn | Mn | ANTIMONY COMPOUND | S | Sb | Sn | Fe | Al | P | Pb | Si | C |
|---|---|---|---|---|---|---|---|---|---|---|---|---|---|---|
| AIM | 61–67 | 8–12 | 8–14 | 10–16 | | 0.25 | 0.1–1.0 | 0.2–1.0 | 0.6 | 0.6 | 0.05 | 0.09 | 0.05 | 0.10 |
| | | | | | | | | | | | | | | |
| 99760–092313–P13H16–7 | 65.67 | 9.72 | 10.21 | 13.02 | 0.2 | .005 | .146 | .664 | .189 | .305 | .036 | .017 | .002 | .003 |
| 99760–092313–P13H17–7 | 65.29 | 10.38 | 10.36 | 12.47 | 0.4 | .010 | .324 | .622 | .199 | .274 | .038 | .010 | .006 | .002 |
| 99760–092613–P13H18–7 | 65.45 | 10.08 | 10.85 | 12.01 | 0.6 | .023 | .459 | .521 | .308 | .228 | .034 | .018 | .002 | .006 |
| 99760–092613–P13H19–7 | 65.03 | 10.02 | 11.02 | 12.11 | 0.8 | .021 | .604 | .562 | .356 | .187 | .032 | .013 | .005 | .010 |
| 99760–092613–P13H20–7 | 65.28 | 10.10 | 11.29 | 11.20 | 1.0 | .031 | .793 | .667 | .355 | .215 | .038 | .014 | .001 | .003 |

FIG. 26A

COMPOSITIONS AND MECHANICAL PROPERTIES, C99760, SAND CASTING– ANTIMONY EFFECT

| HEAT NO | Cu | Ni | Zn | Mn | S | Sb | Sn | Al | UTS, ksi | YS, ksi | % ELONG | BHN | MoE, Mpsi |
|---|---|---|---|---|---|---|---|---|---|---|---|---|---|
| AIM | 61.67 | 8–12 | 8–14 | 10–16 | 0.25 | 0.1–1.0 | 0.2–1.0 | 0.6 | | | | | |
| 99760–092313–P13H16–3A | 65.67 | 9.72 | 10.21 | 13.02 | .005 | .146 | .664 | .305 | 42.90 | 21.10 | 29 | 74 | 15.1 |
| 99760–092313–P13H16–3B | 65.67 | 9.72 | 10.21 | 13.02 | .005 | .146 | .664 | .305 | 50.00 | 20.90 | 49 | 69 | 15.0 |
| AVERAGE | | | | | | | | | 46.45 | 21.00 | 37 | 72 | 15.05 |
| 99760–092313–P13H17–3A | 65.29 | 10.38 | 10.36 | 12.47 | .010 | .324 | .622 | .274 | 44.30 | 20.90 | 32 | 74 | 15.0 |
| 99760–092313–P13H17–3B | 65.29 | 10.38 | 10.36 | 12.47 | .010 | .324 | .622 | .274 | 44.70 | 20.80 | 33 | 65 | 15.1 |
| AVERAGE | | | | | | | | | 44.50 | 20.85 | 32 | 70 | 15.05 |
| 99760–092613–P13H18–3A | 65.45 | 10.08 | 10.85 | 12.01 | .023 | .459 | .521 | .228 | 43.70 | 20.90 | 32 | 74 | 14.9 |
| 99760–092613–P13H18–3B | 65.45 | 10.08 | 10.85 | 12.01 | .023 | .459 | .521 | .228 | 45.30 | 20.20 | 35 | 74 | 15.0 |
| AVERAGE | | | | | | | | | 44.50 | 20.55 | 33 | 74 | 14.95 |
| 99760–092613–P13H19–3A | 65.03 | 10.02 | 11.02 | 12.11 | .021 | .604 | .562 | .187 | 39.80 | 21.70 | 21 | 74 | 15.0 |
| AVERAGE | | | | | | | | | 39.80 | 21.70 | 21 | 74 | 15.0 |
| 99760–092613–P13H20–3A | 65.28 | 10.10 | 11.29 | 11.20 | .031 | .793 | .667 | .215 | 36.50 | 21.10 | 19 | 74 | 15.1 |
| 99760–092613–P13H20–3A | 65.28 | 10.10 | 11.29 | 11.20 | .031 | .793 | .667 | .215 | 39.20 | 21.00 | 22 | 74 | 15.0 |
| AVERAGE | | | | | | | | | 37.85 | 21.05 | 21 | 74 | 15.05 |

FIG. 26B

| ANTIMONY COMPOUND wt% | Sb, wt% | S, wt% | UTS, ksi | YS, ksi | %ELONGATION |
|---|---|---|---|---|---|
| 0.2 | 0.146 | 0.005 | 46.45 | 21 | 37 |
| 0.4 | 0.324 | 0.01 | 44.5 | 20.85 | 32 |
| 0.6 | 0.459 | 0.023 | 44.5 | 20.55 | 33 |
| 0.8 | 0.604 | 0.021 | 39.8 | 21.7 | 21 |
| 1 | 0.793 | 0.031 | 37.85 | 21.05 | 21 |
FIG. 27A
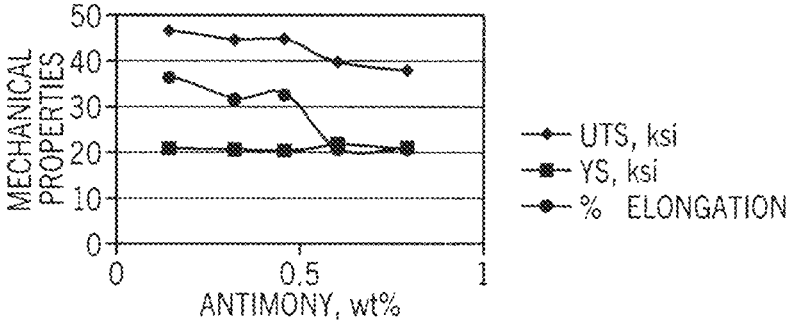
FIG. 27B
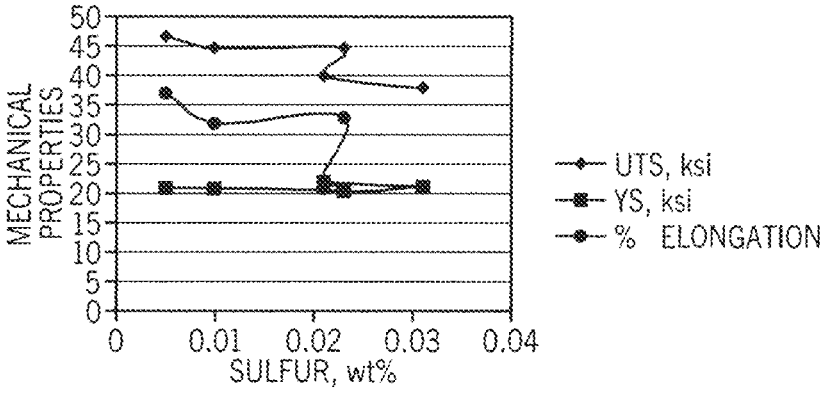
FIG. 27C

WHITE ANTIMICROBIAL COPPER ALLOY

CROSS-REFERENCE TO RELATED APPLICATIONS

This application claims priority as a continuation-in-part of Patent Cooperation Treaty Application No. PCT/US2013/066601 filed Oct. 24, 2013, which claims priority to U.S. Provisional Patent Application 61/718,857 filed Oct. 26, 2012, all of which are hereby incorporated by reference in their entirety.

FIELD OF THE INVENTION

The present invention generally relates to the field of alloys. Specifically, the embodiments of the present invention relate to copper alloys exhibiting a muted copper color, including, but not limited to rose, silver, white, or the like color which also have antimicrobial properties.

BACKGROUND OF THE INVENTION

Copper alloys are used in many commercial applications. Many such applications involve the use of molds or casting to shape molten alloy into a rough form. This rough form may then be machined to the final form. Thus, the machinability of a copper alloy may be considered important. In addition, the other physical and mechanical properties such as ultimate tensile strength ("UTS"), yield strength ("YS"), percent elongation ("% E"), Brinell hardness ("BHN"), and modulus of elasticity ("MoE") may be of varying degrees of importance depending on the ultimate application for the copper alloy.

One property imparted to copper alloys by copper is an antimicrobial effect. It is generally believed that alloys containing above 60% copper content will exhibit an antimicrobial effect. This antimicrobial effect appears to be through multiple pathways, making it very difficult for organisms to develop resistant strains. The antimicrobial effect of copper has been well studied, including recognition by the Environmental Protection Agency.

Copper alloys, particularly copper alloys having high levels of copper typically exhibit a copper-like color. This color may not be desirable in the end product, such as due to consumer preferences or compatibility with other materials used in the end product.

Further, although copper imparts many useful properties to copper-based alloys, copper (and high copper alloys) are susceptible to tarnish. Exposed copper or a copper alloy surface can discolor and develop a patina. This may provide an undesirable visual characteristic.

Attempts have been made at developing a "white brass" that provides the color of white/silvery metals while retaining the properties of a brass alloy. Copper Development Association Registration Number C99700, known in the industry as white Tombasil™, is a leaded brass alloy that provides a somewhat silvery color. However, C99700 presents many problems. First, it relies upon a relatively high lead content (~2%) to maintain the desirable machinability, a content considered significantly too high for commercial or residential water usage. Further, the alloy is difficult to machine, difficult to pour, and the intended silvery color is susceptible to discoloration (blackening).

As a result of the tendency of copper alloys to tarnish, many consumer goods that are made from copper alloys are painted or plated to provide a more appealing color and to prevent the detrimental effects of tarnish. One such example is plumbing fixtures. However, the needs and desire to plate a copper alloy also prevents the copper alloy from providing its antimicrobial effect, due to the surface of the consumer good being of the plated material rather than the underlying copper alloy.

SUMMARY OF THE INVENTION

One embodiment of the invention relates to a white/silver copper alloy that is machineable and has sufficient physical properties for use in molding and casting. The alloy includes less than 0.09% lead to allow for use in water supplies and also contains sufficient copper to exhibit antimicrobial properties. Machinability of the white alloy remains very good despite the low lead content relative to prior commercial alloys.

In certain implementations, C99760 alloys comprise (by weight percent): about 61-67 copper, about 8-12 nickel, about 8-14 zinc, about 10-16 manganese, up to about 0.25 sulfur, about 0.1-1.0 antimony, about 0.2-1.0 tin, less than about 0.6 iron, less than about 0.6 aluminum, less than about 0.05 phosphorous, less than about 0.09 lead, less than about 0.05 silicon, less than about 0.10 carbon.

In one implementation, a C99760 alloy for sand casting comprises (by weight percent): about 61-67 copper, about 8-12 nickel, about 8-14 zinc, about 10-16 manganese, up to about 0.25 sulfur, about 0.1-1.0 antimony, about 0.2-1.0 tin, less than about 0.6 iron, less than about 0.6 aluminum, less than about 0.05 phosphorous, less than about 0.09 lead, less than about 0.05 silicon, less than about 0.10 carbon.

In one implementation, a C99760 alloy for permanent mold casting comprises (by weight percent): 61-67 copper, 8-12 nickel, 8-14 zinc, 10-16 manganese, up to 0.25 sulfur, 0.1-1.0 antimony, 0.2-1.0 tin, less than 0.6 iron, less than 0.6 aluminum, less than 0.05 phosphorous, less than 0.09 lead, less than 0.05 silicon, less than 0.10 carbon.

In certain implementations, C99770 alloys comprise (by weight percent): about 66-70 copper, about 3-6 nickel, about 8-14 zinc, about 10-16 manganese, up to about 0.25 sulfur, about 0.1-1.0 antimony, about 0.2-1.0 tin, less than about 0.6 iron, less than about 0.6 aluminum, less than about 0.05 phosphorous, less than about 0.09 lead, less than about 0.05 silicon, less than about 0.10 carbon.

In one implementation, a C99770 alloy for sand casting comprises (by weight percent): about 66-70 copper, about 3-6 nickel, about 8-14 zinc, about 10-16 manganese, up to about 0.25 sulfur, about 0.1-1.0 antimony, about 0.2-1.0 tin, less than about 0.6 iron, less than about 0.6 aluminum, less than about 0.05 phosphorous, less than about 0.09 lead, less than about 0.05 silicon, less than about 0.10 carbon.

In one implementation, a C99770 alloy for permanent mold applications comprises (by weight percent): about 66-70 copper, about 3-6 nickel, about 8-14 zinc, about 10-16 manganese, up to about 0.25 sulfur, about 0.1-1.0 antimony, about 0.2-1.0 tin, less than about 0.6 iron, less than about 0.6 aluminum, less than about 0.05 phosphorous, less than about 0.09 lead, less than about 0.05 silicon, less than about 0.10 carbon.

In one implementation, a C79880 alloy for wrought applications comprises (by weight percent): about 66-70 copper, about 3-6 nickel, about 10-14 zinc, about 10-16 manganese, up to about 0.25 sulfur, about 0.1-1.0 antimony, about 0.6 iron, about 0.05 phosphorous, less than about 0.09 lead, less than about 0.05 silicon, less than about 0.10 carbon.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The foregoing and other objects, aspects, features, and advantages of the disclosure will become more apparent and better understood by referring to the following description taken in conjunction with the accompanying drawings, in which:

FIG. 1 is a table listing commercial alloy compositions.

FIG. 2A is a table listing the range of components for an implementation of C99760 alloy for sand casting and example heats of this implementation of C99760 alloy; FIG. 2B is a table listing the copper, nickel, zinc, sulfur, manganese, tin, antimony, and aluminum contents and the UTS, YS, % Elong, BHN, and Modulus of Elasticity for the target alloys of FIG. 2A; FIG. 2C is a table listing the range of components for an implementation of C99760 alloy for permanent mold casting and example heats of this implementation of C99760 alloy; FIG. 2D is a table listing the copper, nickel, zinc, sulfur, manganese, tin, antimony, and aluminum contents and the UTS, YS, % Elong, BHN, and Modulus of Elasticity for the target alloys of FIG. 2C.

FIG. 3A is a table listing the range of components for an implementation of C99770 alloy for sand casting and example heats of this implementation of C99770 alloy; FIG. 3B is a table listing the copper, nickel, zinc, sulfur, manganese, tin, antimony, and aluminum contents and the UTS, YS, % Elong, BHN, and Modulus of Elasticity for the target alloys of FIG. 3A; FIG. 3C is a table listing the range of components for an implementation of C99770 alloy for permanent mold casting and example heats of this implementation of C99770 alloy; FIG. 3D is a table listing the copper, nickel, zinc, sulfur, manganese, tin, antimony, and aluminum contents and the UTS, YS, % Elong, BHN, and Modulus of Elasticity for the target alloys of FIG. 3C.

FIG. 4A is a table listing the range of components for an implementation of C79880 alloy for wrought applications and example heats of this implementation of C79880 alloy; FIG. 4B is a table listing the copper, nickel, zinc, sulfur, manganese, and antimony contents and the UTS, YS, % Elong, BHN, and Modulus of Elasticity for the target alloys of FIG. 4A.

FIG. 22H illustrates elemental mapping of antimony in the portion shown in FIG. 21A.

FIG. 23A illustrates Compositions of C99760 Alloys used for Machinability Evaluation.

FIG. 24A illustrates Compositions of C99770 Alloys used for Machinability Evaluation.

FIG. 25A is a table illustrating the annealing temperature information and mechanical properties for alloy sample 79880-030713-P4H6-7 listed in FIG. 4A;

FIGS. 25B and 25C are graphs of the hardness vs annealing temperature.

FIG. 26A is a table listing various alloys based upon C99760 alloy with the amount of antimony varied. FIG. 26B illustrates alloys based upon C99760 alloy with mechanical properties.

FIG. 27A is a table listing properties of alloys with varied antimony and sulfur contents; FIG. 27B illustrates mechanical properties as a function of antimony content; FIG. 27C illustrates mechanical properties as a function of sulfur content.

DETAILED DESCRIPTION OF THE PREFERRED EMBODIMENTS

Figure 5:
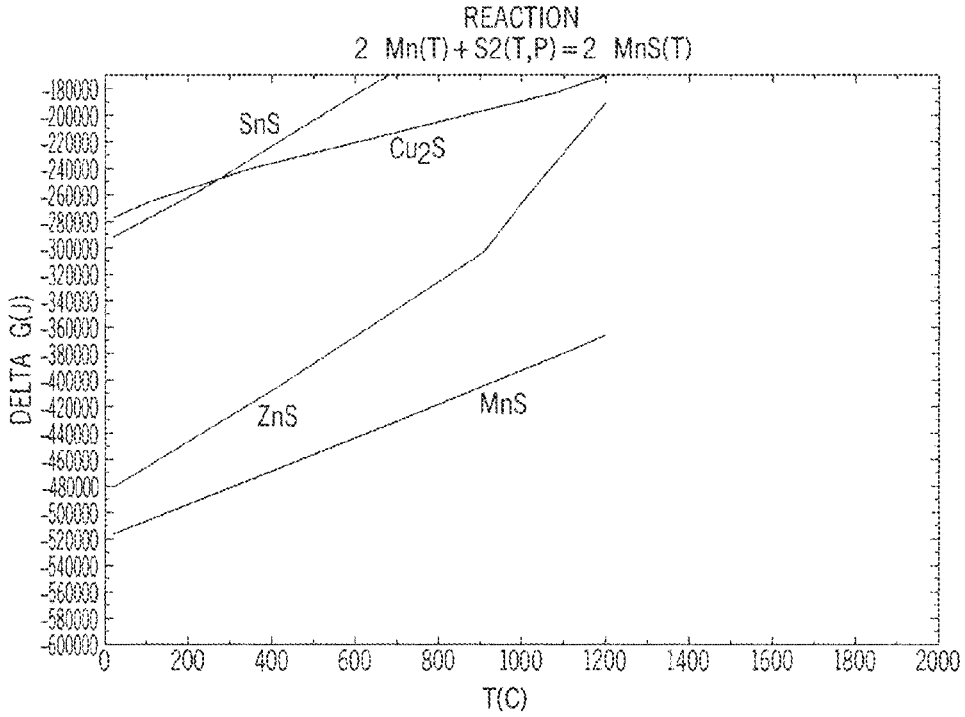
FIG. 5 is a free energy diagram of various sulfides.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

One embodiment relates to compositions of a copper alloy that contain a sufficient amount of copper to exhibit an antimicrobial effect, preferably more than 60% copper. The copper alloy may be a brass comprising, in addition to the copper, the following: zinc, nickel, manganese, sulfur, iron, aluminum, tin, antimony. The copper alloy may further contain small amounts of phosphorous, lead, and carbon. Preferably, the copper alloy contains no lead or less than 0.09% lead, so as to reduce the deleterious impact of leaching in potable water applications. In one embodiment, the alloy provides less than 0.09% lead while including at least 60% copper to impart antimicrobial properties and provides a machineable final product with a final color and gloss that is substantial equivalent to that of traditional plated red-brass alloys.

The copper alloys of one embodiment of the present invention provide a white/silver color. This color and the antimicrobial aspect of the alloy's surface make plating of products made from the alloy unnecessary. The avoidance of the need for plating of brass alloys provides opportunities for a substantially reduced environmental footprint. Extensive energy is necessary for the electroplating process commonly used and the process also involves the use of harsh chemicals.

The alloys, comprise as a principal component, copper. Copper provides basic properties to the alloy, including antimicrobial properties and corrosion resistance. Pure copper has a relatively low yield strength, and tensile strength, and is not very hard relative to its common alloy classes of bronze and brass. Therefore, it is desirable to improve the properties of copper for use in many applications through alloying. The copper will typically be added as a base ingot. The base ingot's composition purity will vary depending on the source mine and post-mining processing. The copper may also be sourced from recycled materials, which can vary widely in composition. Therefore, the alloys of the present invention may have certain trace elements without departing from the spirit and scope of the invention. Further, it should be appreciated that ingot chemistry can vary, so, in one embodiment, the chemistry of the base ingot is taken into account. For example, the amount of zinc in the base ingot is taken into account when determining how much additional zinc to add to arrive at the desired final composition for the alloy. The base ingot should be selected to provide the required copper for the alloy while considering the secondary elements in the base ingot and their intended presence in the final alloy since small amounts of various impurities are common and have no material effect on the desired properties.

Lead has typically been included as a component in copper alloys, particularly for applications such as plumbing where machinability is an important factor. Lead has a low melting point relative to many other elements common to copper alloys. As such, lead, in a copper alloy, tends to migrate to the interdendritic or grain boundary areas as the melt cools. The presence of lead at interdendritic or grain boundary areas can greatly improve machinability and pressure tightness. However, in recent decades the serious detrimental impacts of lead have made use of lead undesirable in many applications of copper alloys. In particular, the presence of the lead at the interdendritic or grain boundary areas, the feature that is generally accepted to improve machinability, is, in part, responsible for the unwanted ease with which lead can leach from a copper alloy. Alloys of the present invention seek to minimize the amount of lead, for example using less than about 0.09%.

Sulfur is added to the alloys of the present invention to overcome certain disadvantages of using leaded copper alloys. Sulfur provides similar properties as lead would impart to a copper alloy, such as machinability, without the health concerns associated with lead. Sulfur present in the melt will typically react with transition metals also present in the melt to form transition metal sulfides. For example, copper sulfide and zinc sulfide may be formed, or, for embodiments where manganese is present, it can form manganese sulfide. FIG. 5 illustrates a free-energy diagram for several transition metal sulfides that may form in embodiments of the present invention. The melting point for copper is 1,083 Celsius, 1130 Celsius for copper sulfide, 1185 Celsius for zinc sulfide, 1610 Celsius for manganese sulfide, and 832 Celsius for tin sulfide. Thus, without limiting the scope of the invention, in light of the free energy of formation, it is believed that a significant amount of the sulfide formation will be manganese sulfide. It is believed that sulfides solidify after the copper has begun to solidify, thus forming dendrites in the melt. These sulfides aggregate at the interdendritic areas or grain boundaries. The presence of the sulfides provides a break in the metallic structure and a point for the formation of a chip in the grain boundary region and improve machining lubricity, allowing for improved overall machinability. The sulfides predominate in the alloys of the present invention provide lubricity.

Further, good distribution of sulfides improves pressure tightness, as well as, machinability. It is believed that good distribution of the sulfides may be achieved through a combination of hand stirring in gas-fired furnace, induction stirring during induction melting and the plunging of antimony (or anantimony compound) wrapped in copper foils. The presence of elemental antimony, such as through dissociation of antimony from a compound makes it easy for homogeneous formation of copper sulfide and zinc sulfide in comparison with plunging sulfur powder and hence, a homogeneous distribution of the sulfide in interdendritic areas. In one embodiment the sulfur content is below 0.25%. Although sulfur provides beneficial properties as discussed above, increased sulfur content can reduce other desirable properties. It is believed that one mechanism causing such reduction may be the formation of sulfur dioxide during the melt, which leads to gas bubbles in the finished alloy product.

It is believed that the presence of a high amount of tin increases the strength and hardness but reduces ductility by solid solution strengthening and by forming Cu—Sn intermetallic phase such as $Cu_3Sn$. It also increases the solidification range. Casting fluidity increases with tin content, and tin also increases corrosion resistance. Tin content of certain embodiments is very low (<1.0%) relative to the prior art. At such low levels, it is believed that Sn remains in solid solution and does not form the $Cu_3Sn$ intermetallic compound. It also does not affect (increase) the solidification range. Such embodiments are short to medium freezing range alloys because of the high Zn, Ni and Mn contents. Cu—Zn and Cu—Ni binary alloys have short freezing ranges. Cu—Mn binary alloys have a medium freezing range. Hence, certain Cu—Zn—Mn—Ni alloys of the present invention will have a medium to long freezing range With respect to zinc, it is believed that the presence of Zn is similar to that of Sn but to a lesser degree, in certain embodiments approximately 2% Zn is roughly equivalent to 1% Sn with respect to the above mentioned improvements to characteristics noted. Zn is known, in sufficient quantities, to cause copper to be present in beta rather than alpha phase. The beta phase results in a harder material, thus Zn increases strength and hardness by solid solution hardening. However, Cu—Zn alloys have a short freezing range. Zinc has traditionally been less expensive than tin and, thus, used more readily. Zinc above a certain amount, typically about 14%, can result in an alloy susceptible to dezincification. In addition, it has been discovered that higher amounts of zinc prevent the sulfur from integrating into the melt. It is believed that some Zn remains in solid solution with Cu. Some Zn is associated with some intermetallic phases. The rest reacts with S to form ZnS. When the Zn content exceeds 13 to 14%, there is so much Zn available to form ZnS clumps that substantially all the S ends in the slag or dross.

With respect to certain alloys, iron can be considered an impurity picked up from stirring rods, skimmers, etc during melting and pouring operations, or as an impurity in the base ingot. Such categories of impurity have no material effect on alloy properties. However, embodiments of the present invention include iron as an alloying component, preferably in the range of about 0.6%. With regard to certain embodiments, such as embodiments of C79880, the iron content is less than 0.6%, preferably less than 0.4%. In certain embodiments iron may be included up to about 2%. At these levels it is believed that Fe has probably a grain refining effect similar to high strength yellow brasses or Manganese bronzes (Alloy C86300).

Figure 23B:
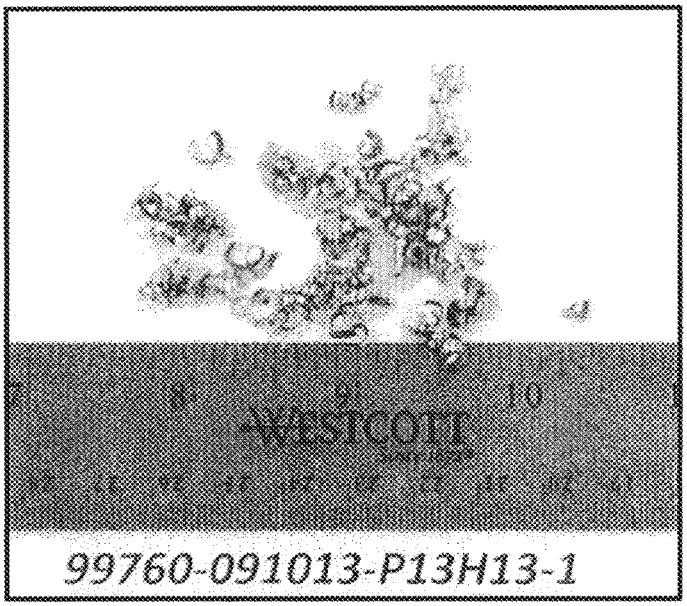
FIGS. 23B-D illustrate chips from a machinability test of implementations of C99760.
Figure 23C:
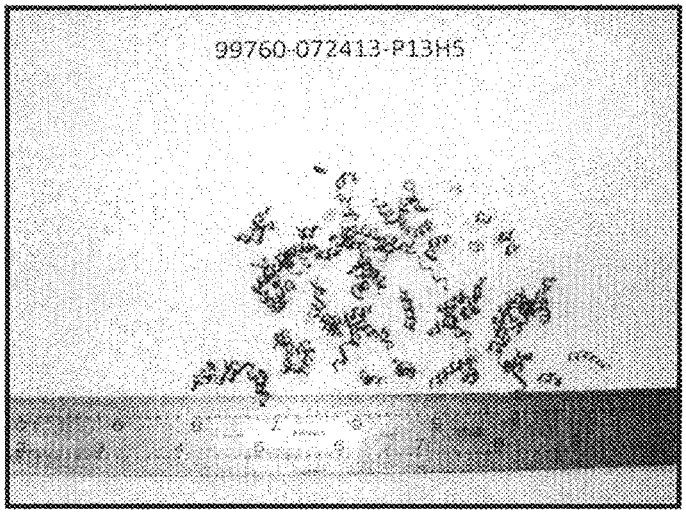
Figure 23D:
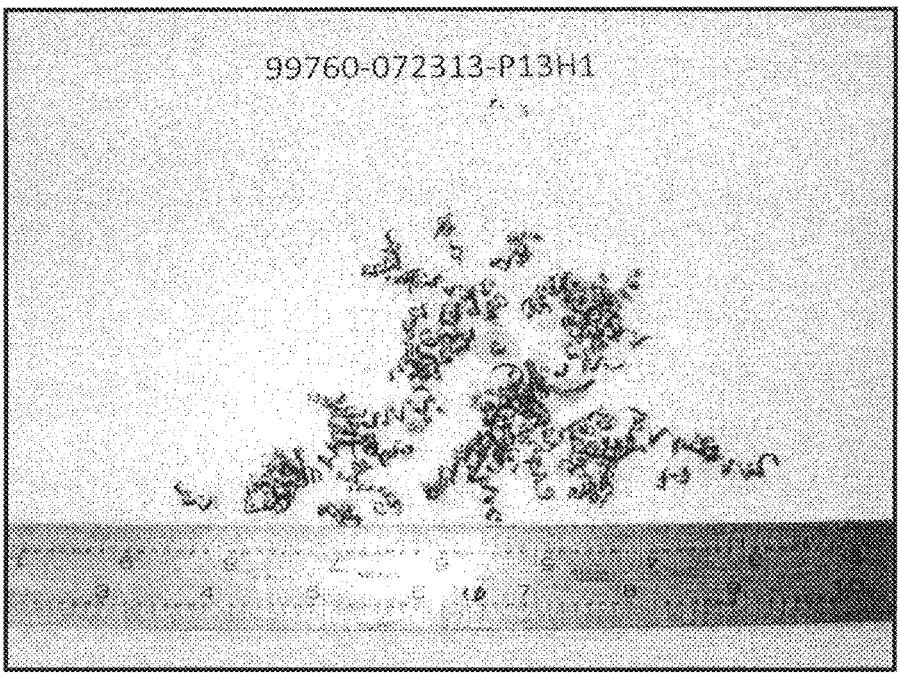

Typically, antimony is picked up from inferior brands of tin, scrap and poor quality of ingots and scrap. For many brass alloys, antimony has been viewed as a contaminant. However, some embodiments of the present application utilize antimony to increase the dezincification resistance. Antimony is used as an alloying element in one embodiment. Phase diagram analysis shows that Sb forms the NiSb compound. FIGS. 23 B-D and 24 B-D show that embodiments having antimony have good machinability despite the presence of 0.01 to 0.025% S. This is believed to be due to the presence of antimony. It is believed that presence of sulfides and NiSb contribute to good machinability. However, it is further believed that as Sb content increases, strength and % elongation decrease as shown in FIGS. 27A-B.

In some embodiments, nickel is included to increase strength and hardness. Further, nickel aids in distribution of the sulfide particles in the alloy. In one embodiment, adding nickel helps the sulfide precipitate during the cooling process of the casting. The precipitation of the sulfide is desirable as the suspended sulfides act as a substitute to the lead for chip breaking and machining lubricity during the post casting machining operations. Without limiting the scope of the invention, with the lower lead content, it is believed that the sulfide precipitates will minimize the effects of lowered machinability. Further, the addition of nickel, and the ability of the alloy to maintain desirable properties with 3-12% nickel content, provides for an copper alloy that exhibits a color more similar to that of nickel metal rather than copper metal, for example a white to silver color. Binary Cu—Ni alloys have complete solubility. As the Ni content increases strength increase so also the color of cast components. Generally, three types of cupronickel alloys are commercially available (90/10, 80/20 and 70/30). The silver white color increases with Ni content. Nickel Silver alloys have 11-14% Ni and 17-25% Zn. There are nickel silvers with 27% Ni and less than 4% Zn. Nickel silvers do not contain silver. The silver white color comes from Ni. In the present invention, it is believed that the white/silver color comes from Ni and Zn. In general, the higher the amount of Ni, the more silver/white the color approaching the color of elemental nickel.

Phosphorus may be added to provide deoxidation. The addition of phosphorus reduces the gas content in the liquid alloy. Removal of gas generally provides higher quality castings by reducing gas content in the melt and reducing porosity in the finished alloy. However, excess phosphorus can contribute to metal-mold reaction giving rise to low mechanical properties and porous castings.

Aluminum in some brass alloys is treated as an impurity. In such embodiments, aluminum has harmful effects on pressure tightness and mechanical properties. However, aluminum in certain casting applications can selectively improve casting fluidity. It is believed that aluminum encourages a fine feathery dendritic structure in such embodiments which allows for easy flow of liquid metal. In certain embodiments aluminum is an alloying element. It increases strength considerably by contributing to the zinc equivalent of the alloy. 1% Al has a zinc equivalent of 6. Preferably, aluminum is included as 1% max.

Silicon is generally considered an impurity. In foundries with multiple alloys, silicon based materials can lead to silicon contamination in non silicon containing alloys. A small amount of residual silicon can contaminate semi red brass alloys, making production of multiple alloys nearly impossible. In addition, the presence of silicon can reduce the mechanical properties of semi-red brass alloys. For embodiments of the present invention, silicon is not an alloy component and is considered an impurity. It should be limited to below 0.05% and preferably 0.

Manganese may be added in certain embodiments. The manganese is believed to aid in the distribution of sulfides. In particular, the presence of manganese is believed to aid in the formation of and retention of zinc sulfide in the melt. In one embodiment, manganese improves pressure tightness. In one embodiment, manganese is added as MnS. The phase diagrams illustrate that for certain embodiments only 1% MnS forms. Hence, for these embodiments it is believed that MnS is not the predominating sulfide but rather ZnS and $Cu_2S$ will be the predominating sulfides. As FIGS. 6A-B and 8 A-B illustrate, much of the manganese is present as $MnNi_2$ (7 wt %) and $Mn_3Ni$ (13 wt %) due to the higher nickel and manganese levels comparative to certain prior art alloys. It is believed in certain embodiments that only 1 wt % MnS is present.

Manganese serves several important roles. First, by reducing melting point and second, forming intermetallic compounds with Ni. The melting point of binary Cu-11 Mn alloy is reduced by ~85 C from that of Cu. Similarly, the melting point. of Cu-13 Zn is reduced by ~25 C. By contrast, Ni increases the melting point of the alloy. For the Cu-10 Ni alloy, the increment is about 50 C. When one considers a quaternary alloy of Cu—Ni—Zn—Mn, an overall decrease in melting point. can be expected. This expectation has been observed, for example where the melting point. is found to be about 966 C for the 4% Ni alloy and 1020 C for the 10% Ni alloy. Hence, embodiments of the present invention can be poured at relatively lower temperatures. This is a significant factor in reducing melt loss and electricity usage (and energy cost). FIG. 6, illustrating a phase diagram, supports such.

The second effect of Mn is the formation of intermetallic compounds with Ni which probably contribute to strength and ductility.

A third possible effect of Mn could be its zinc equivalent factor of +0.5. Thus, 11% Mn is equivalent to adding 5.5% Zn. On the other hand Ni has a negative zinc equivalent of 1.3. Thus, 10% Ni reduces Zn equivalent by 13%. For comparison, Zn equivalent of Sn, Fe, and Al are respectively +2, +0.9, and +6. Generally, the higher the Zn equivalent, the higher the strength of the alloy.

Carbon may be added in certain embodiments to improve pressure tightness, reduce porosity, and improve machinability. In one embodiment, carbon may be added to the alloy as copper coated graphite ("CCG"). One type of copper coated graphite product is available from Superior Graphite and sold under the name DesulcoMC™. One embodiment of the copper coated graphite utilizes graphite that contains 99.5% min carbon, 0.5% max ash, and 0.5% max moisture. US mesh size of particles is 200 or 125 microns. This graphite is coated with 60% Cu by weight and has very low S.

In another embodiment, carbon may be added to the alloy as calcinated petroleum coke (CPC) also known as thermally purified coke. CPC may be screened to size. In one aspect, 1% sulfur is added and the CPC is coated with 60% Cu by weight. CPC wrapped copper, because of its relatively higher and coarser S content compared to copper coated graphite, imparts slightly higher S to the alloy and hence, better machinability. It has been observed that the use of CPC provides a similar contribution of sulfur as CCG, but the observed machinability of the embodiments utilizing CPC is superior to those embodiments having CCG.

It is believed that a majority of the carbon is not present in the final alloy. Rather, it is believed that carbon particles are formed that float to the surface as dross or reacting to form carbon monoxide/carbon dioxide (around 1,149 degrees Celsius) that is released from the melt as a gas. It has been observed that final carbon content of alloy is about 0.005% with a low density of 2.2 g/cc. Carbon particles float and form $CO/CO_2$ at 1,149 degrees Celsius (like a carbon boil) and purify the melt. Thus, the alloys utilizing carbon may be more homogeneous and pure compared with other additions such as S, MnS, antimony, etc. Further, the atomic radius of carbon is $0.91\times10^{-10}$ M, which is smaller than that of copper ($1.57\times^{-10}$ M). Without limiting the scope of the invention, it is believed that carbon because of its low atomic volume remains in the face centered cubic crystal lattice of copper, thus contributing to strength and ductility.

The presence of carbon is observed to improve mechanical properties. Generally, a small amount of carbon (0.006%) is effective in increasing the strength, hardness and % elongation. Generally 0.1% carbon is considered the maximum desirable amount for embodiments of the present invention.

Implementations of Alloys

Alloys C99760 and C99770 include implementations suitable for sand casting and implementations suitable for permanent mold casting. Alloy C79880 includes an implementation for a wrought alloy In certain implementations, C99760 alloys comprise (by weight percent): 61-67 copper, 8-12 nickel, 8-14 zinc, 10-16 manganese, up to 0.25 sulfur, 0.1-1.0 antimony, 0.2-1.0 tin, less than 0.6 iron, less than 0.6 aluminum, less than 0.05 phosphorous, less than 0.09 lead, less than 0.05 silicon, less than 0.10 carbon.

In one implementation, a C99760 alloy for sand casting comprises (by weight percent): 61-67 copper, 8-12 nickel, 8-14 zinc, 10-16 manganese, up to 0.25 sulfur, 0.1-1.0 antimony, 0.2-1.0 tin, less than 0.6 iron, less than 0.6 aluminum, less than 0.05 phosphorous, less than 0.09 lead, less than 0.05 silicon, less than 0.10 carbon.

In one implementation, a C99760 alloy for permanent mold casting comprises (by weight percent): 61-67 copper, 8-12 nickel, 8-14 zinc, 10-16 manganese, up to 0.25 sulfur, 0.1-1.0 antimony, 0.2-1.0 tin, less than 0.6 iron, less than 0.6 aluminum, less than 0.05 phosphorous, less than 0.09 lead, less than 0.05 silicon, less than 0.10 carbon.

In certain implementations, C99770 alloys comprise (by weight percent): 66-70 copper, 3-6 nickel, 8-14 zinc, 10-16 manganese, up to 0.25 sulfur, 0.1-1.0 antimony, 0.2-1.0 tin, less than 0.6 iron, less than 0.6 aluminum, less than 0.05 phosphorous, less than 0.09 lead, less than 0.05 silicon, less than 0.10 carbon.

In one implementation, a C99770 alloy for sand casting comprises (by weight percent): 66-70 copper, 3-6 nickel, 8-14 zinc, 10-16 manganese, up to 0.25 sulfur, 0.1-1.0 antimony, 0.2-1.0 tin, less than 0.6 iron, less than 0.6 aluminum, less than 0.05 phosphorous, less than 0.09 lead, less than 0.05 silicon, less than 0.10 carbon.

In one implementation, a C99770 alloy for permanent mold applications comprises (by weight percent): 66-70 copper, 3-6 nickel, 8-14 zinc, 10-16 manganese, up to 0.25 sulfur, 0.1-1.0 antimony, 0.2-1.0 tin, less than 0.6 iron, less than 0.6 aluminum, less than 0.05 phosphorous, less than 0.09 lead, less than 0.05 silicon, less than 0.10 carbon.

In one implementation, a C79880 alloy for wrought applications comprises (by weight percent): 66-70 copper, 3-6 nickel, 10-14 zinc, 10-16 manganese, up to 0.25 sulfur, 0.1-1.0 antimony, about 0.6 iron, about 0.05 phosphorous, less than 0.09 lead, less than 0.05 silicon, less than 0.10 carbon.

One implementation of the C99770 alloy, includes about 66-70% copper, about 3-6% nickel, about 8-14% zinc, about 10-16% manganese, about 0.25% sulfur, about 0.1-1% antimony, about 0.6% tin, about 0.6% iron, about 0.6% aluminum, about 0.1% carbon.

One implementation of the C99760 alloy, includes about 61-67% copper, about 8-10% nickel, about 8-14% zinc, about 10-16% manganese, about 0.25% sulfur, about 0.1-1.0% antimony, about less than about 0.6% tin, about less than about 0.6% iron, about less than about 0.6% aluminum, about 0.05% phosphorous, about less than 0.09% lead, about less than about 0.05% silicon, about 0.1% carbon.

Alloys of the present invention exhibit a balance of several desirable properties and exhibit superior characteristics and performance to prior art alloys. FIGS. 2 is and 3 are tables providing the UTS, YS, % Elong, BHN, and Modulus of Elasticity for several embodiments of the present invention (alloy C99760 and C99770, both sand and permanent mold cast)).

Table 1 below lists three different implementations of alloys of the present invention. Alloys C99760 and C99770 are believed best suited for sand and permanent casting. The C79880 alloy is believed best suited for wrought products. The C99760 alloy includes greater amounts of nickel than the C99770 and C79880 alloys. It is believed that alloys with more nickel will exhibit a more silvery color and hardness, but may experience a slight reduction in other properties such as % Elong. C99760 alloys exhibit a higher hardness than C99770.

TABLE 1

| Alloys | | | | | | | | | | | | | |
|---|---|---|---|---|---|---|---|---|---|---|---|---|---|
| Alloy | Cu | Ni | Mn | Zn | S | Sb | Fe | Sn | Pb | Al | P | C | Si |
| C99760 | 61.0-67.0 | 8.0-12.0 | 10.0-16.0 | 8.0-14.0 | .25 | .10-1.0 | .60 | .2-1.0 | .09 | .6 | .05 | .10 | .05 |
| C99770 | 66.0-70.0 | 3.0-6.0 | 10.0-16.0 | 8.0-14.0 | .25 | .10-1.0 | .60 | .2-1.0 | .09 | .6 | .05 | .10 | .05 |
| C79880 | 66.0-70.0 | 3.0-6.0 | 10.0-16.0 | 10.0-14.0 | .25 | .10-1.0 | .60 | — | .09 | — | .05 | .10 | .05 |

In one implementation, alloys may be used in place of stainless steel. In particular, copper alloys may be used in medical applications where stainless steel is used, the copper alloy providing an antimicrobial functionality. Embodiments for use as a replacement for stainless steel exhibit a generally higher UTS, YS, and % elongation. In one embodiment, the copper alloy comprises greater than 60% copper, exhibiting antimicrobial effect and a muted copper or white/silver color. However, the stainless steel has an UTS of above about 69, a YS above about 30, and a % elongation above about 55%. The minimum requirements for stainless steel are UTS/YS % Elong of 70 ksi/30 ksi/30. To compete with and replace stainless steel, the copper alloy with antimicrobial characteristics should exceed the mechanical properties of stainless steel mention above. Despite their lower mechanical properties in comparison with cast stainless steels, their antimicrobial characteristics stand out much better in the presence of scratches or crevices where stainless steels corrode faster. Typical and Minimum Mechanical Properties (C99760 and C99770)

| | UTS, ksi | | YS, ksi | | % Elongation | | Brinell Hrd |
|---|---|---|---|---|---|---|---|
| Alloy | Range | Typ. | Range | Typ. | Range | Typ. | Ave. (Rng.) |
| C99760, Sand cast | 40.61-48.50 | 44.86 | 18.77-23.40 | 21.73 | 23-46 | 35 | 71 (65-80) |
| C99760, PM cast | 39.6-48.4 | 44.50 | 24.9-26.7 | 26.10 | 9-19 | 13 | 82 (80-86) |
| C99770, Sand cast | 39.5-47.7 | 43.8 | 17.73-20.70 | 19.32 | 27-45 | 36 | 66 (61-69) |
| C99770, PM cast | 38.3-50.9 | 44 | 22.2-24.5 | 23.2 | 10-23 | 16 | 71 (65-80) |

Samples of C99760 and C99770 both sand cast and permanent mold cast were tested for various mechanical properties. The table above provides both the range and typical values observed for the tested samples.

FIG. 2B is a table listing the copper, nickel, zinc, sulfur, manganese, tin, antimony, and aluminum contents and the UTS, YS, % Elong, BHN, and Modulus of Elasticity for the target alloys of FIG. 2A (C99760 sand cast). The tested implementations of C99760 sand cast exhibited an average UTS of 44.8 ksi, an average YS of 21.73 ksi, an average % Elong of 35, an average BHN of 71, and an average MOE of 15.54 Mpsi. FIG. 2D is a table listing the copper, nickel, zinc, sulfur, manganese, tin, antimony, and aluminum contents and the UTS, YS, % Elong, BHN, and Modulus of Elasticity for the target alloys of FIG. 2C (C99760 permanent mold cast). The tested implementations of C99760 permanent mold cast exhibited an average UTS of 44.5 ksi, an average YS of 26.1 ksi, an average % Elong of 13, an average BHN of 82, and an average MOE of 15.19 Mpsi.

FIG. 3B is a table listing the copper, nickel, zinc, sulfur, manganese, tin, antimony, and aluminum contents and the UTS, YS, % Elong, BHN, and Modulus of Elasticity for the target alloys of FIG. 3A (C99770 sand cast). The tested implementations of C99770 sand cast exhibited an average UTS of 43.8 ksi, an average YS of 19.32 ksi, an average % Elong of 36, an average BHN of 66, and an average MOE of 15.12 Mpsi. FIG. 3D is a table listing the copper, nickel, zinc, sulfur, manganese, tin, antimony, and aluminum contents and the UTS, YS, % Elong, BHN, and Modulus of Elasticity for the target alloys of FIG. 3C (C99770 permanent mold cat). The tested implementations of C99770 permanent mold cast exhibited an average UTS of 44.0 ksi, an average YS of 23.2 ksi, an average % Elong of 16, an average BHN of 71, and an average MOE of 15.32 Mpsi.

FIG. 4B is a table listing the copper, nickel, zinc, sulfur, manganese, and antimony contents and the UTS, YS, % Elong, BHN, and Modulus of Elasticity for the target alloys of FIG. 4A (C79880 wrought Cold Rolled and annealed) As can be seen, the cold rolled products exhibited higher hardness and UTS with a substantial reduction in % Elong compared to the annealed products of C79880.

Phase Diagrams

C99760

Figure 6A:
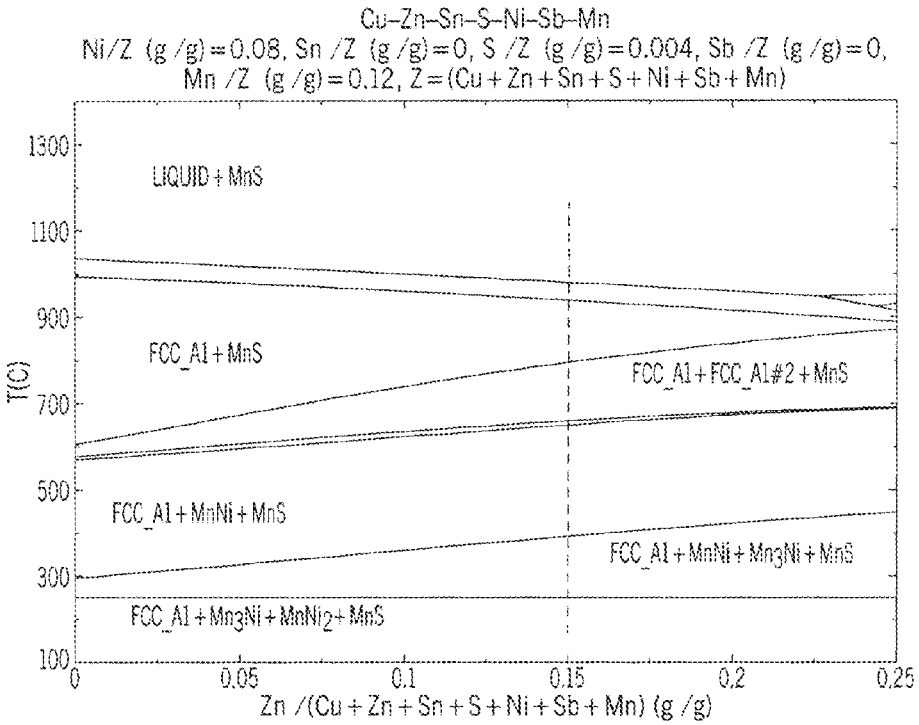
FIG. 6A is a phase diagram of an alternative alloy based upon C99760 with no antimony.
Figure 6B:
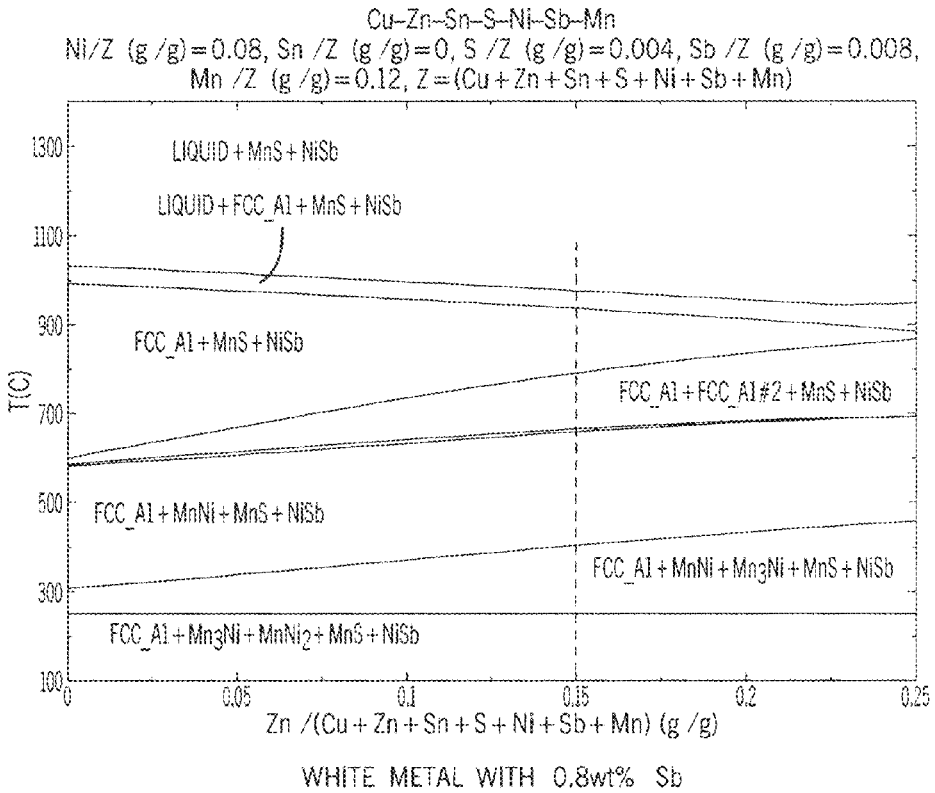
FIG. 6B is a phase diagram of an implementation of a C99760 alloy with 0.8% antimony.

The phases of certain embodiments of the invention have been studied. FIGS. 6A-B to 7 A-D illustrate corresponding phase diagrams. These have been drawn for both equilibrium and non-equilibrium (Scheil calculation) conditions.

The implementation evaluated has a composition of 62% Cu, 8% Ni, 15% Zn, 12% Mn, 0.4% S. The effect of 0.8% Sb addition is also shown.

It is evident that these are short/medium freezing range alloys compared with semi-red brass family. For certain embodiments of the present invention, the freezing range is around 40 C. For the semi-red brass family, freezing range is greater than 80 C. Thus, permanent mold casting of these embodiments of the present invention will be favorable. In some applications, most of the plumbing parts are produced by both gravity and low pressure permanent mold casting. Finer grain structure due to faster cooling rates should increase the mechanical properties in permanent mold casting.

Equilibrium Calculations

C99760

White metal alloy contains many intermetallics (if it is cooled at equilibrium rate). The phase assemblage diagram of the embodiment noted above is illustrated in FIGS. 7A-7D. This alloy contains the following phases at room temperature.

| MnS | $MnNi_2$ | $Mn_3Ni$ | FCC Cu |
|---|---|---|---|
| 1 wt % | 7 wt % | 13 wt % | 79 wt % |

Figure 7A:
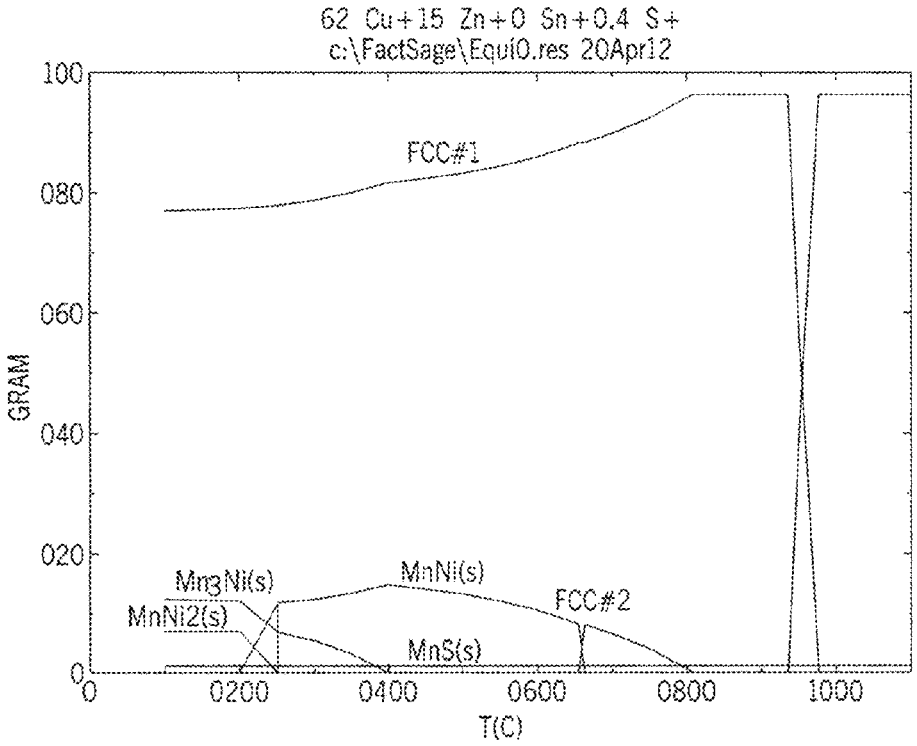
FIG. 7A is a phage assemblage diagram of an alternative alloy based upon C99760 alloy with no antimony under equilibrium.
Figure 7B:
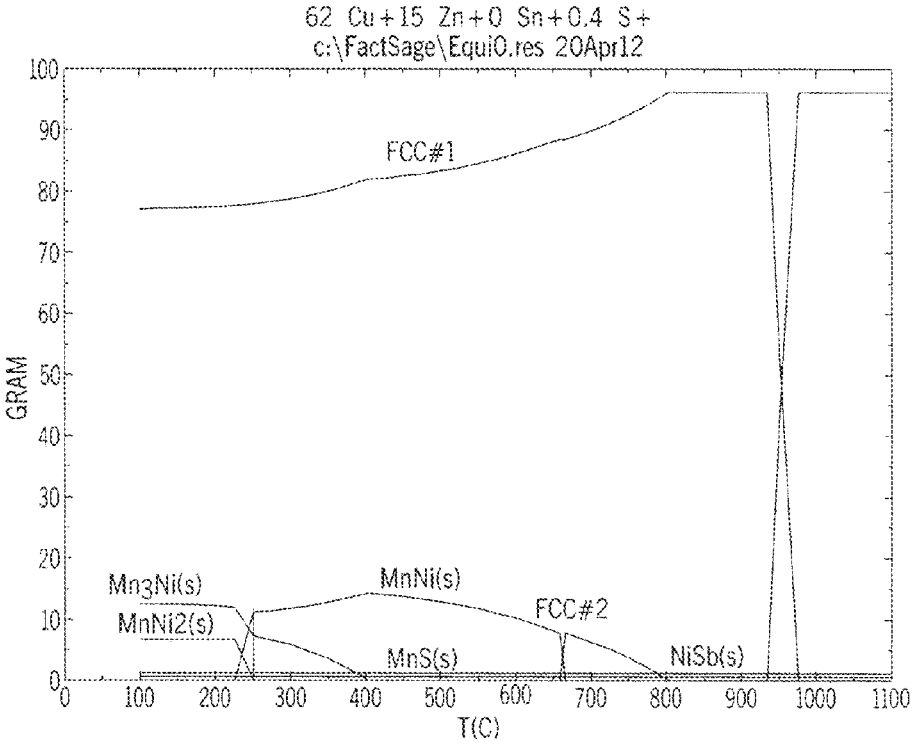
FIG. 7B is a phage assemblage diagram of an embodiment of the present invention with 0.8% antimony for C99760 under equilibrium conditions.

FIG. 7B illustrates a phase assemblage diagram of the embodiment noted above with 0.8 Sb. The liquidus and solidus temperatures did not change significantly (only 1 to 2° C.) due to the addition of Sb because NiSb compound formed from the liquid. Addition of Sb did not change the phase contents of the alloy except for the formation of around 1 wt % NiSb compound.

Figure 7C:
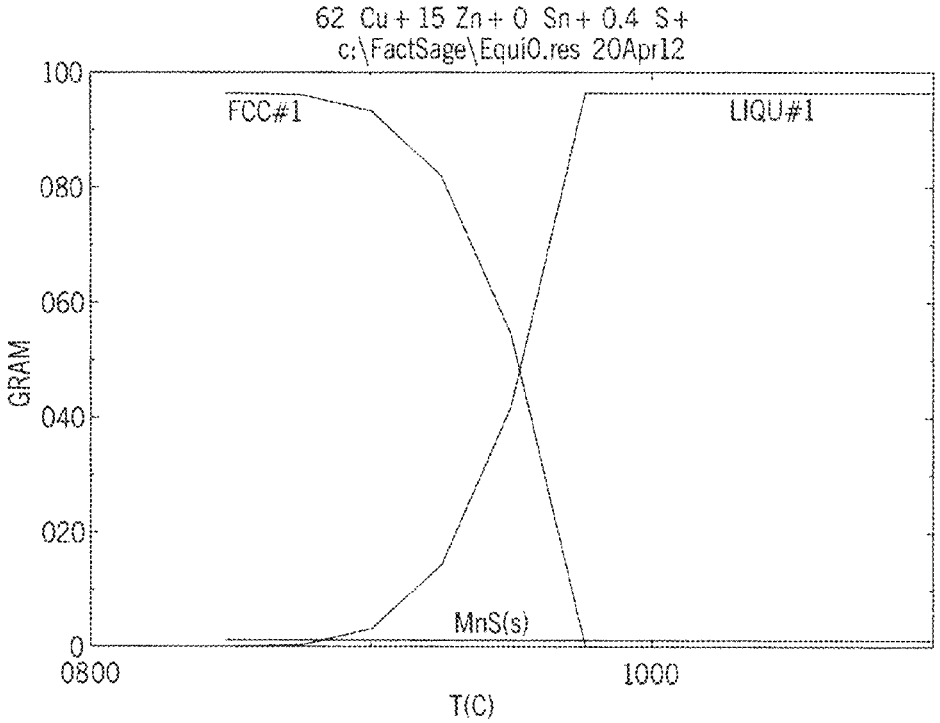
FIG. 7C is a phage assemblage diagram (Scheil Cooling) of an alternative alloy based upon C99760 alloy with no antimony.

FIG. 7C illustrates a phase assemblage diagram (Scheil Cooling) of the variation of C99760 with no antimony noted above. According to Scheil simulation, this alloy is a single phase alloy with traces of MnS (~1 wt %). Real world conditions are expected to be somewhere in between equilibrium and Scheil conditions.

Liquidus temperature=975° C.

Solidus temperature=900° C.

The solidus and the liquidus temperatures, obtained from both cycles are provided in the table below. The samples were weighed before and after these experiments. The percent loss in weight was as follows:

C99760 12.9%

Samples for DSC

| Heat No. | Cu | Ni | Zn | Mn | S | Sb | Sn | Fe | Al | P | Pb | Si | C |
|---|---|---|---|---|---|---|---|---|---|---|---|---|---|
| 99760-020613-P2 H1-1 | 66.11 | 10.28 | 10.90 | 10.86 | .021 | .441 | .408 | .537 | .385 | .022 | .005 | .002 | .015 |

Solidus and Liquidus Temperatures

| | 1st Cycle | | 2nd Cycle | |
|---|---|---|---|---|
| Alloy No | Solidus T, C.(F.) | Liquidus T, C.(F.) | Solidus T, C.(F.) | Liquidus T, C.(F.) |
| C99760-020613-P2H1 | 897 (1647) | 1020 (1868) | 939 ((1722) | 1025 (1877) |

Initial Scheil calculation shows a freezing range of 75 C. But DSC (differential Scanning calorimetry) work on alloy 99760-020613-P2H1 which had 66.11% Cu, 10.86% Mn, 10.28% Ni, 10.90% % Zn, 0.441% Sb,). 021% S, 0.408% Sn, 0.385% Al and 0.537% Fe gave the liquidus and solidus temperatures as 1020° C. and 897° C. respectively. This has a freezing range of 123 C, indicating it to be a long freezing range alloy.

Figure 7D:
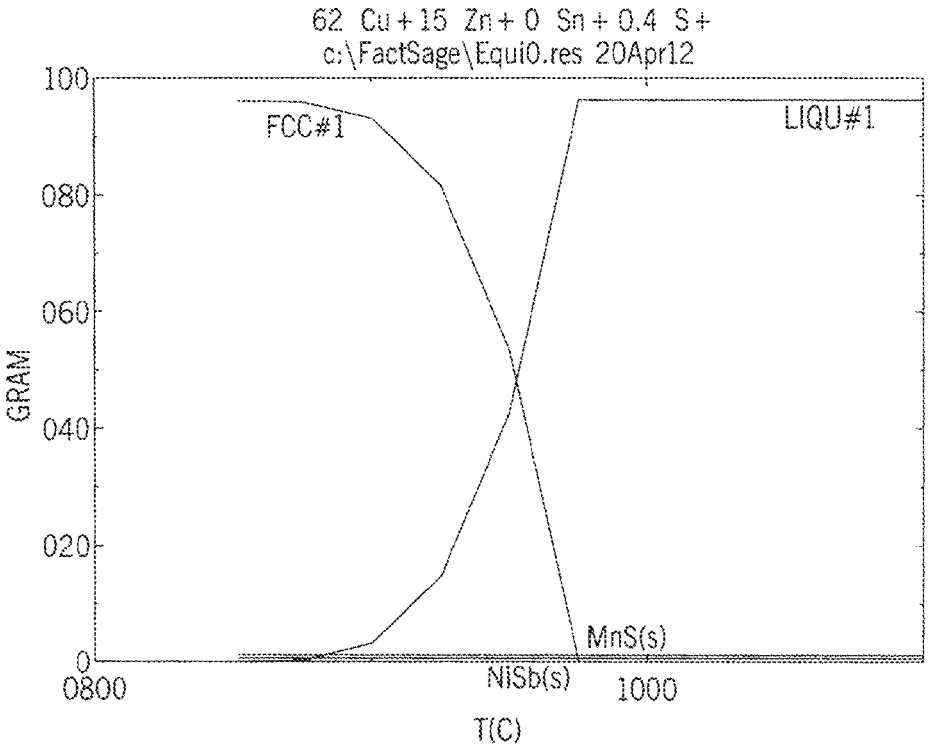
FIG. 7D is a phage assemblage diagram (Scheil Cooling) of an embodiment of the present invention with 0.8% antimony for C99760.

FIG. 7D is a phase assemblage diagram (Scheil Cooling) of C99760 with 0.8 Sb. Addition of 0.8 Sb resulted in forming around 1 wt % NiSb compound but did not change the liquidus or the solidus temperatures.

Summary of the Effect of Sb on C99760 Alloy

Relative Amount of the Phases Present at Room Temperature:

A 100 kg overall alloy will contain the following amounts of each phase in kg.

| | Equilibrium | | | | | Scheil Cooling | | |
|---|---|---|---|---|---|---|---|---|
| Composition | FCC | $Mn_3Ni$ | $MnNi_2$ | NiSb | MnS | FCC | MnS | NiSb |
| C99760 | 79 | 13 | 7 | 0 | 1 | 99 | 1 | 0 |
| +0.8 wt % Sb | 79 | 13 | 6 | 1 | 1 | 98 | 1 | 1 |

Liquidus and Solidus Temperatures:

| | Equilibrium | | Scheil Cooling | |
|---|---|---|---|---|
| Composition | Liquidus | Solidus | Liquidus | Solidus |
| C99760 | 976° C. | 935° C. | 975° C. | ~900° C. |
| +0.8 wt % Sb | 977° C. | 935° C. | 974° C. | ~900° C. |

Phase Diagrams

C99770

Figure 8A:
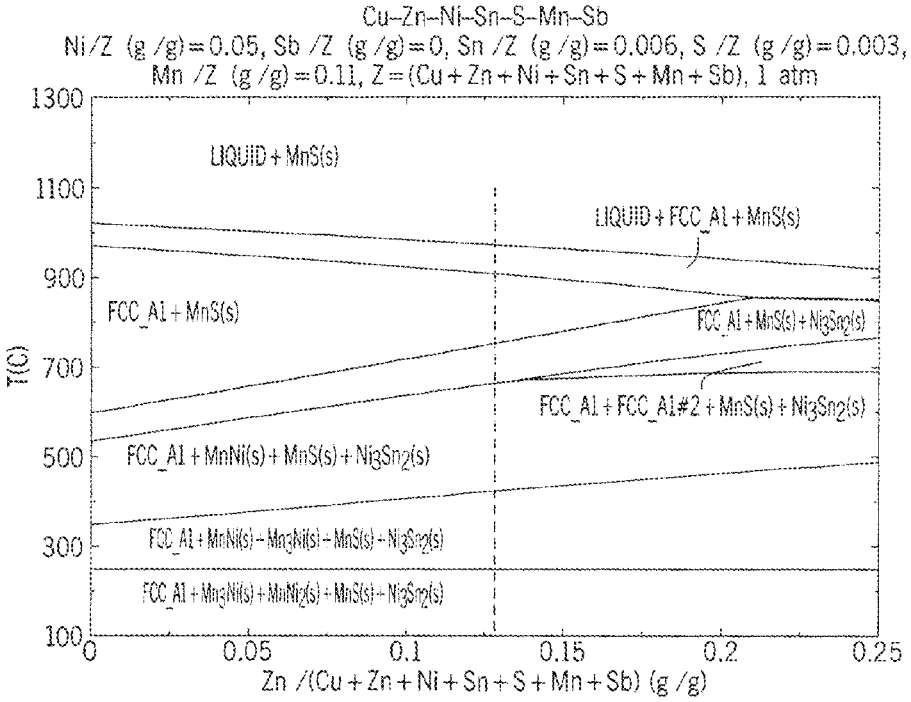
FIG. 8A is a phase diagram of an alternative alloy based upon C99770 with no antimony.
Figure 8B:
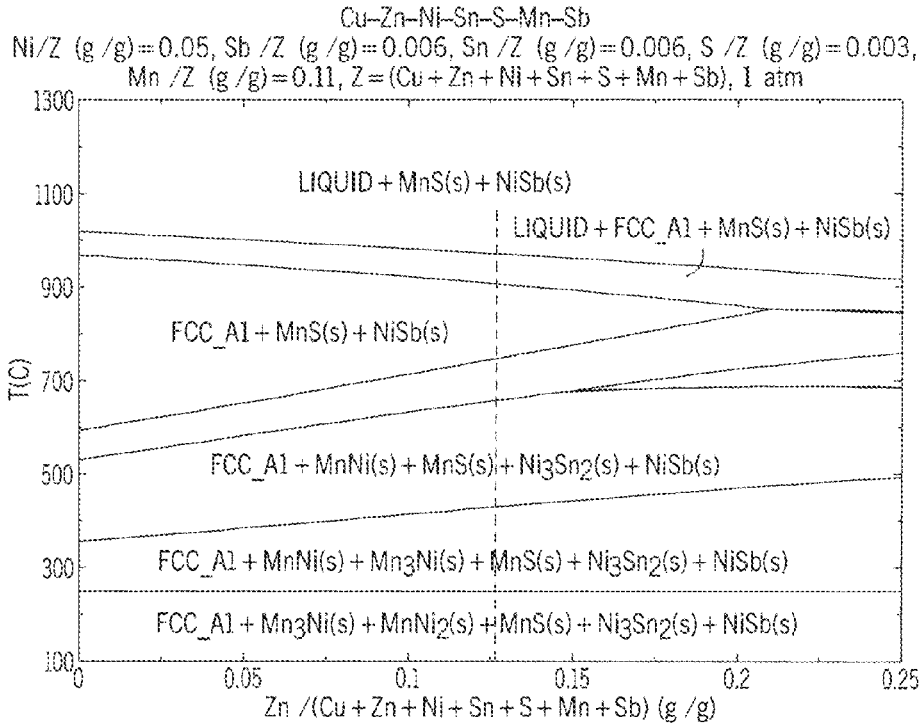
FIG. 8B is a phase diagram of an implementation of a C99770 alloy with 0.6% antimony.

The phases of certain embodiments of the invention have been studied. FIGS. 8A to 8B illustrate corresponding phase diagrams. The implementation evaluated has a composition of 68% Cu, 5% Ni, 11% Zn, 11% Mn, 0.3% S. The effect of 0.6% Sb addition is also shown.

It is evident that these are short/medium freezing range alloys compared with semi-red brass family. For certain embodiments of the present invention, the freezing point is around 34 C. For the semi-red brass family, freezing range is greater than 80 C. Thus, permanent mold casting of these embodiments of the present invention will be favorable. In some applications, most of the plumbing parts are produced by both gravity and low pressure permanent mold casting. Finer grain structure due to faster cooling rates should increase the mechanical properties in permanent mold casting.

C99770 alloys contain many intermetallics (if it is cooled at equilibrium rate), as can be seen below. The liquidus and solidus temperatures did not change significantly (only around 3° C.) due to the addition of Sb because NiSb compound formed from the liquid. Addition of Sb did not change the phase contents of the alloy except for the formation of less than 1 wt % NiSb compound.

Equilibrium Calculations

C99770

Figure 9A:
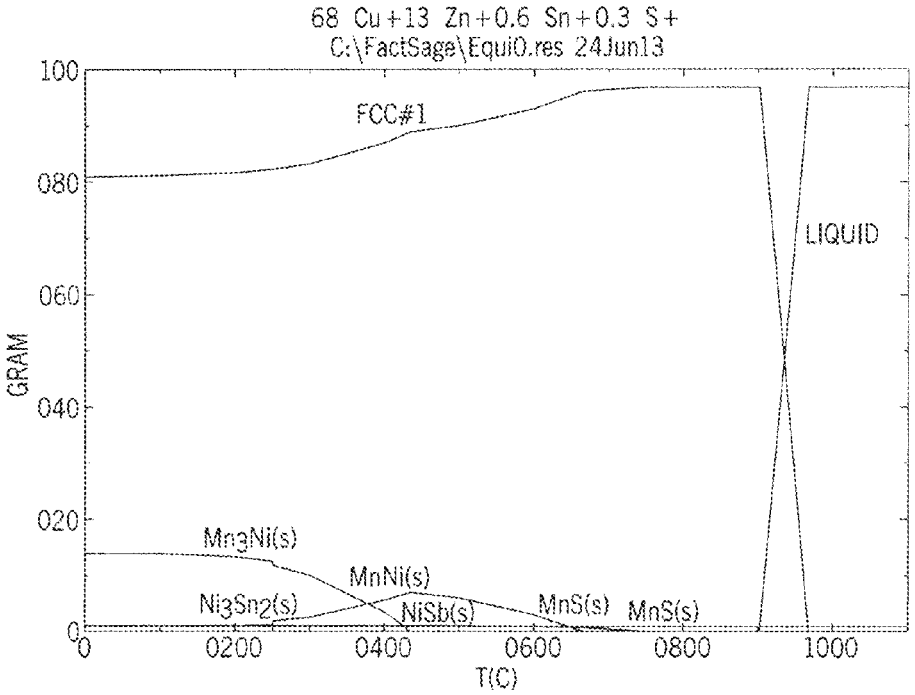
FIG. 9A is a phage assemblage diagram of an alternative alloy based upon C99770 with no antimony under equilibrium conditions.
Figure 9B:
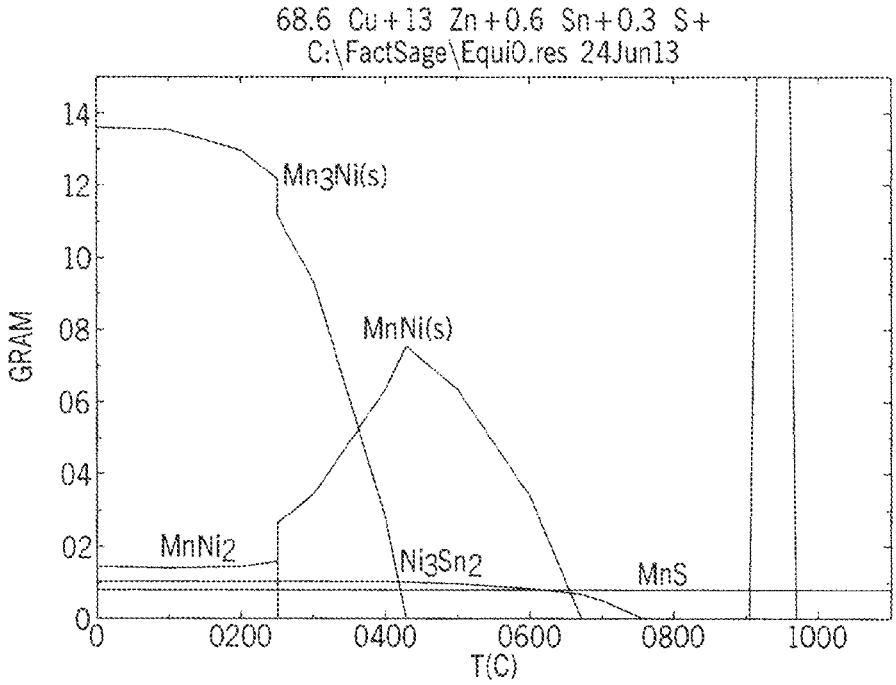
FIG. 9B is a magnified phage assemblage diagram of an alternative alloy based upon C99770 with no antimony under equilibrium conditions.
Figure 9C:
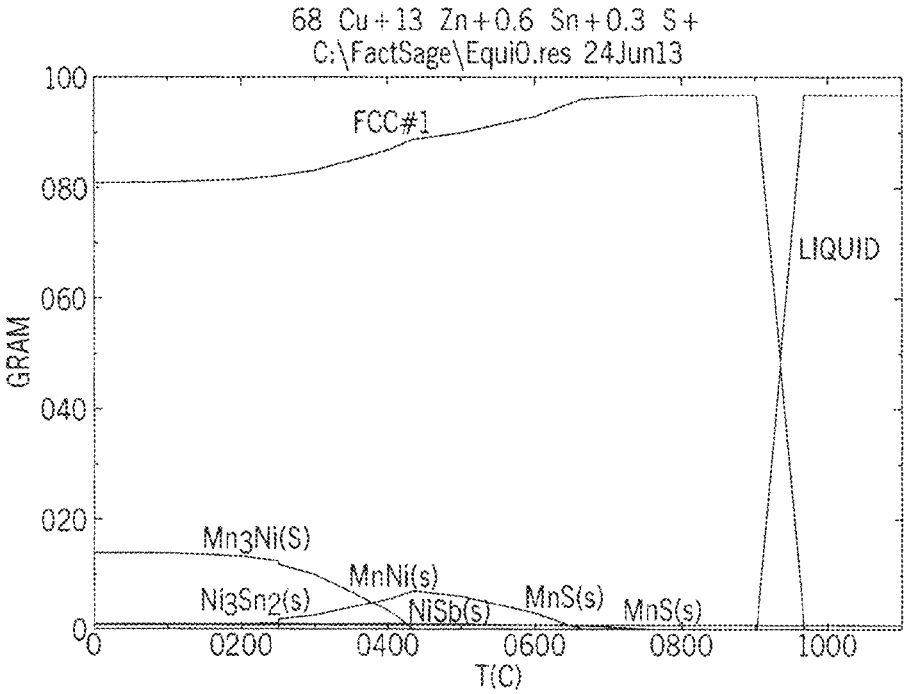
FIG. 9C is a phage assemblage diagram of an implementation of the C99770 alloy with 0.6% antimony under equilibrium conditions.
Figure 9D:
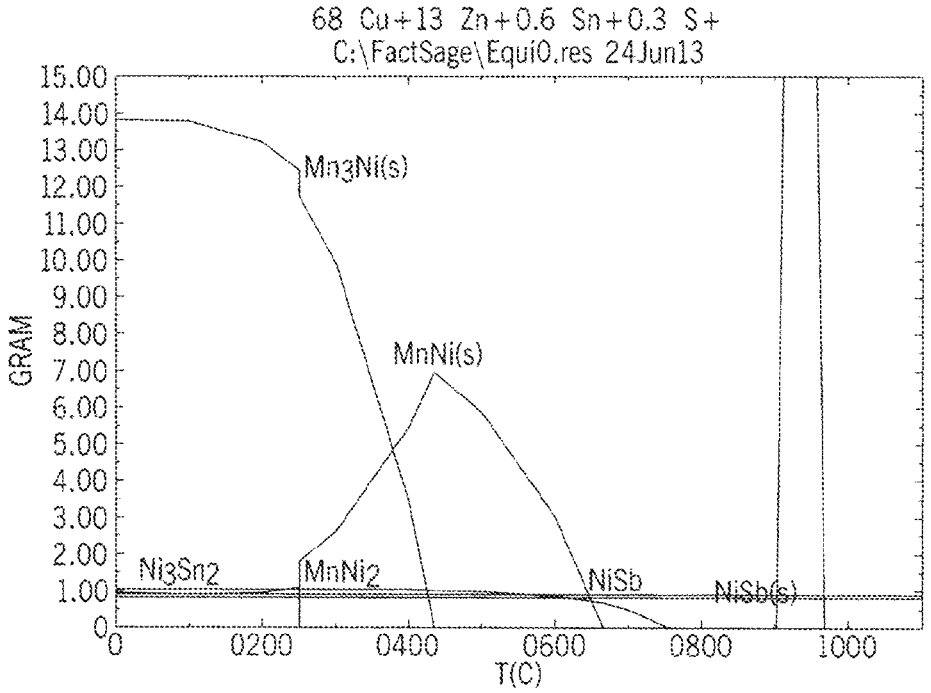
FIG. 9D is a magnified phage assemblage diagram of an implementation of the C99770 alloy with 0.6% antimony under equilibrium conditions.
Figure 9E:
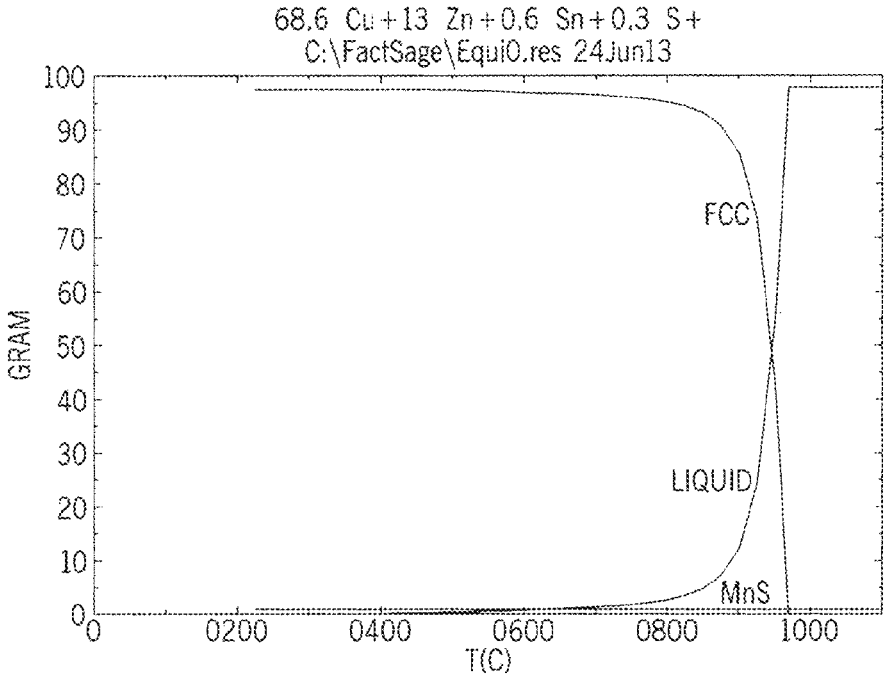
FIG. 9E is a phage assemblage diagram (Scheil Cooling) of an alternative alloy based upon C99770 with no antimony.
Figure 9F:
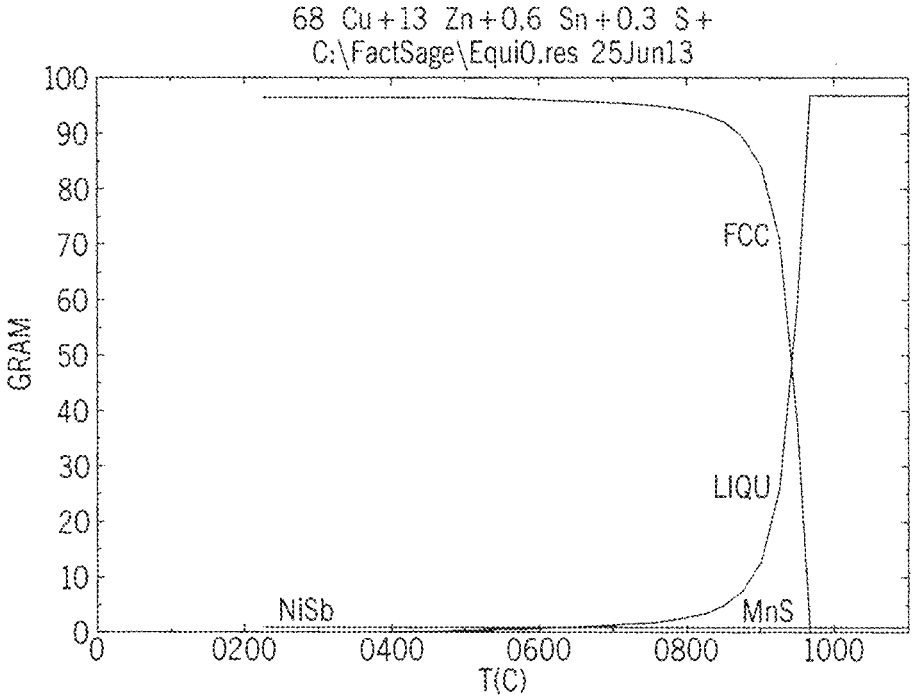
FIG. 9F is a phage assemblage diagram (Scheil Cooling) of an implementation of the C99770 alloy with 0.6% antimony.

FIGS. 9A-F illustrates phase assemblage diagrams for a variation from C99770 alloys with no antimony (equilibrium—FIGS. 9A, 9B and Scheil cooling—FIG. 9E) and an implementation of a C99770 alloy with 0.6% antimony (equilibrium—FIGS. 9C, 9D and Scheil cooling—FIG. 9F). C99770 alloy contains many intermetallics (if it is cooled at equilibrium rate). According to Scheil simulation, the C99770 alloy is a single phase alloy with traces of MnS (~1 wt %). In real casting process, the results should be somewhere in between equilibrium and Scheil conditions. Addition of 0.6 Sb resulted in forming around 1 wt % NiSb compound but did not change the liquidus or the solidus temperatures.

C99770 alloy contains many intermetallics (if it is cooled at equilibrium rate). The phase assemblage diagram of the embodiment noted above is illustrated in FIG. 9 A-F. This alloy contains the following phases at room temperature.

| MnS | $MnNi_2$ | $Mn_3Ni$ | FCC Cu |
|---|---|---|---|
| 0.8 wt % | 1.4 wt % | 13.6 wt % | 81.6 wt % |

FIG. 9C illustrates a phase assemblage diagram of the embodiment noted above with 0.6 Sb. The liquidus and solidus temperatures did not change significantly (only 1-3 degrees) due to the addition of Sb because NiSb compound formed from the liquid. Addition of Sb did not change the phase contents of the alloy except for the formation of around 1 wt % NiSb compound.

FIG. 9F illustrates a phase assemblage diagram (Scheil Cooling) of the embodiment noted above. According to Scheil simulation, this alloy is a single phase alloy with traces of MnS (~0.8 wt %). Real world conditions are expected to be somewhere in between equilibrium and Scheil conditions. Liquidus and solidus temperatures for both equilibrium and Scheil cooling conditions are given below.

Summary of the Effect of Sb on C99770 Alloys

Relative Amount of the Phases Present at Room Temperature:

A 100 kg overall alloy will contain the following amounts of each phase in kg.

| | Equilibrium | | | | | | | Scheil Cooling | | |
|---|---|---|---|---|---|---|---|---|---|---|
| Composition | FCC | $Mn_3Ni$ | $MnNi_2$ | $Ni_3Sn_2$ | NiSb | MnS | $Cu_3Sn$ | FCC | MnS | NiSb |
| C99770 | 81.6 | 13.6 | 1.4 | 0 | 0 | 0.8 | 0 | 97.5 | 0.8 | 0 |
| +0.6 wt % Sb | 81 | 14 | 0.9 | 1.0 | 0.9 | 0.8 | 0 | 96.5 | 0.8 | 0.9 |

Liquidus and Solidus Temperatures:

| | Equilibrium | | Scheil Cooling | |
|---|---|---|---|---|
| Composition | Liquidus | Solidus | Liquidus | Solidus |
| C99770 | 970° C. | 904° C. | 970° C. | ~675° C.* |
| +0.6 wt % Sb | 967° C. | 901° C. | 967° C. | ~675° C.* |

*in modeling traces of liquid phase seen up to 675 C., it is believed the true value should be taken as ~900 C.

Thermal investigation of the two alloys was conducted on the Setaram SetSys2400 DSC to evaluate the solidus and liquidus temperature. To find out the solidus and liquidus temperature the samples were heated from room temperature up to 1100 C, then cooled to 800 C, then heated to 1100 C and cooled to 800 C again. Finally the apparatus was brought down to room temperature. These experiments were conducted under an Argon atmosphere which was preceded by vacuum pump evacuation of the DSC chamber. Thus data from two cycles were collected. The heating was done at 10 C/min and the cooling at 15 C/min. The table below gives the compositions of the two alloys used for the DSC work.

Samples for DSC

| Heat No. | Cu | Ni | Zn | Mn | S | Sb | Sn | Fe | Al | P | Pb | Si | C |
|---|---|---|---|---|---|---|---|---|---|---|---|---|---|
| 99770-052313-P7H1-7 | 67.71 | 5.32 | 11.99 | 12.88 | .011 | .514 | .669 | .508 | .344 | .031 | .007 | .002 | .004 |

The solidus and the liquidus temperatures, obtained from both cycles are provided in the table below. The samples were weighed before and after these experiments. The percent loss in weight was as follows:

C99770 13.7%

It is believed this explains the shift of the solidus and liquidus in the first and second cycles. The data from the first cycle is believed to be more representative of the tested alloys.

Solidus and Liquidus Temperatures

| | 1st Cycle | | 2nd Cycle | |
|---|---|---|---|---|
| Alloy No | Solidus T, C.(F.) | Liquidus T, C.(F.) | Solidus T, C.(F.) | Liquidus T, C.(F.) |
| C99770-052313-P7H1-7 | 843 (1550) | 966 (1771) | 900 (1652) | 973 (1783) |

Initial Scheil calculation shows a freezing range of ~70 C. But DSC (differential Scanning calorimetry) work on alloy C99770-052313-P7H1-7 which had 67.71 Cu, 5.32 Ni, 11.99 Zn, 12.88 Mn, 0.011S, 0.514 Sb, 0.669 Sn, 0.508 Fe, 0.344 Al, 0.031 P, 0.007 Pb, 0.002 Si and 0.004 C gave the liquidus and solidus temperatures as 966° C. and 843° C. for the first cycle respectively. This has a freezing range of 123° C., indicating it to be a long freezing range alloy.

Zinc Equivalent

Copper alloys are known to undergo dezincification in certain environments when the alloy contains greater than about 15%. However, large amounts of zinc can alter the phase of the copper from an all alpha to a duplex or beta phase. Other elements are known to also alter the phase of the copper. A composite "zinc equivalent" is used to estimate the impact on the copper phase:

$$Zn_{equivalent}=(100*X)/((X+Cu\ \%)$$

Where X is the total of zinc equivalents contributed by the added alloying elements plus the percentage of actual zinc present in the alloy. A zinc equivalent under 32.5% Zn typically results in single alpha phase. This phase is relatively soft in comparison with the beta phase.

Table 2 lists equivalent zinc values for certain alloying elements described herein. As can be seen, not all elements contribute equally to zinc equivalent. In fact, certain elements, such as nickel have a negative zinc value, thus reducing the zinc equivalent number and the associated mechanical properties with higher levels. Table 2 Zinc Equivalents

| | Alloying Element | | | | | | | |
|---|---|---|---|---|---|---|---|---|
| | Si | Al | Sn | Mg | Pb | Fe | Mn | Ni |
| Zinc Equiv. | 10 | 6 | 2 | 2 | 1 | 0.9 | 0.5 | −1.2 |

Dezincification occurs as Zn, typically when present in excess of 15%, leaches out selectively in chlorinated water. Zinc's reactivity is high because of a weak atomic bond. Although the upper end of the zinc range for the C99760 and C99770, it is believed that the presence of antimony aids in reducing dezincification. The Zn—Sb phase diagrams indicate that Sb can form an intermetallic compound such as $Sb_3Zn_4$ which increases Zn's atomic bond strength. Thus, it is believed that the increased atomic bond strength increases resistance to selective leaching such that dezincification is minimized. In addition, dezincification occurs because of the reduction of $Cu^{++}$ in solution to Cu on the alloy surface by cathodic reaction. Sb addition inhibits or "poisons" this cathodic copper reduction reaction and thereby effectively eliminates dezincification. It is believed that the 14% zinc with antimony will not result in dezincification based on the out-of-range amount of 17% that had no dezincification combined with the general knowledge that dezincification increases as zinc content increases.

Annealing Study

Hot and Cold Rolling

An annealing study was carried out for the composition listed in FIG. 4A as 79880-030713-P4H5-7. Composition (wt %) of this is 69.51 Cu, 4.71 Ni, 12.22 Zn, 12.15 Mn, 0.025 S, 0.650 Sb, 0.509 Fe, 0.006 Pb, 0.052 P, 0.008 C, and). 003 Si. The anneal study had the following parameters:

1. 0.5 inch thick permanent mold cast plates were homogenized at 900 C for two hours and rolled in the hot condition
2. As edge cracks appeared, intermittent annealing at 800 C and hot rolling were done twice to reduce the thickness to 0.150 in.
3. These hot rolled sheets were annealed at 700 C for one hour, cooled in air and then cold rolled in several passes to 0.040 inch thickness.
4. Samples from the cold rolled sheets were cut for tensile and hardness measurements.
5. Tensile testing was done in cold rolled and also annealed conditions Annealing was done at 1100, 1200 and 1290 F (593, 650, and 700 C) for one hour followed by air cooling.

FIG. 4B summarizes the mechanical properties for the cold rolled and cold rolled and annealed conditions. These data have been compared with those for nickel silvers and cupronickels. All these data show that UTS and YS in the cold rolled condition are higher than those for nickel silvers (C74500 and C78200) and cupronickels (C71000). In addition, mechanical properties in the annealed condition are similar to those for nickel silver (C78200) and cupronickels (C70600 and C7100). Thus, the white metals can compete with the nickel silvers and cupronickels for flat, rod and tubular products.

Figures 17A, 17B, 17C, 17D, 17E, 17F, 17G, 17H, 17I, 17J:
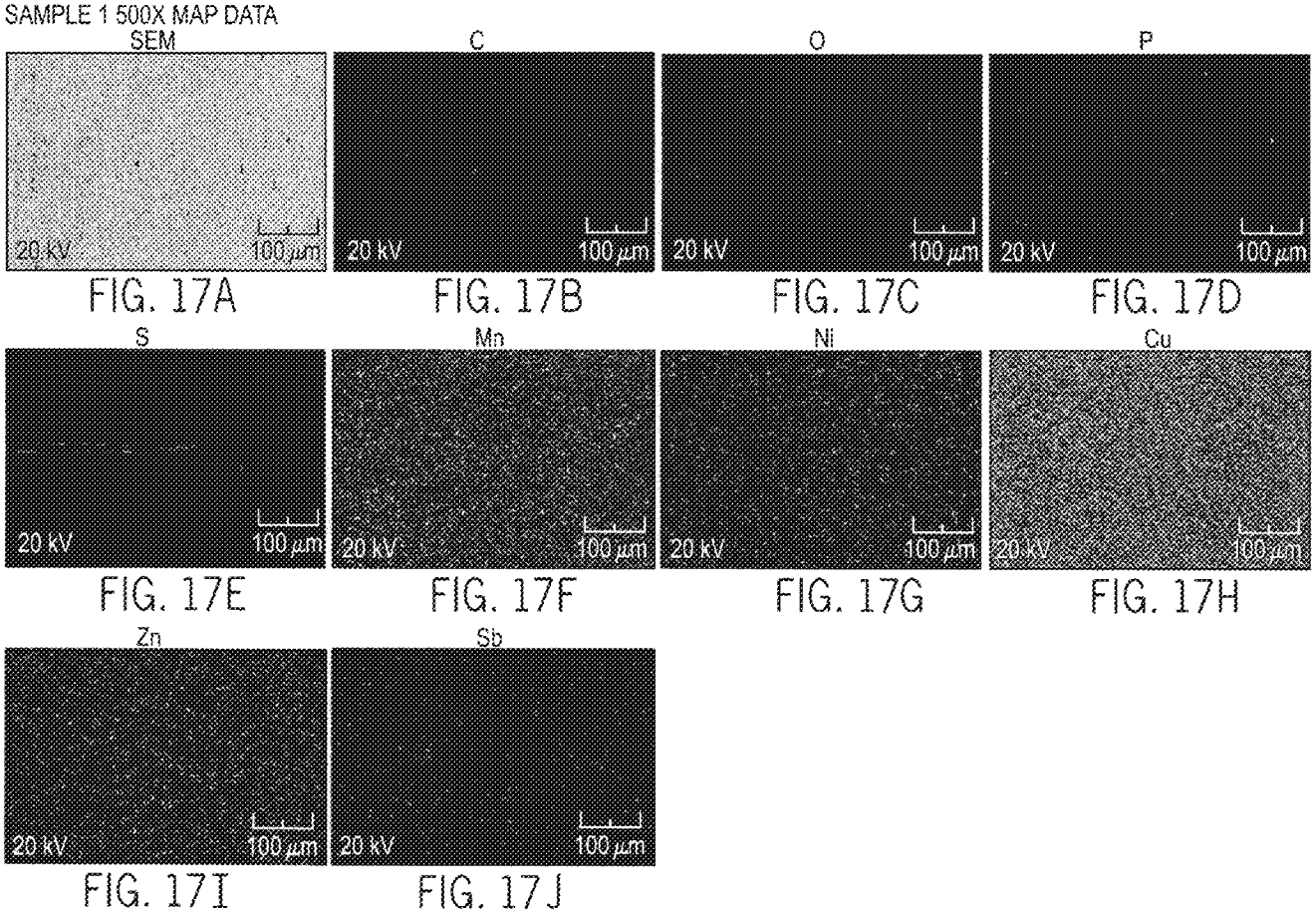
FIG. 17A is a SEM image of a cold rolled implementation of C79880 alloy.
FIG. 17B illustrates elemental mapping of carbon in the portion shown in FIG. 17A.
FIG. 17C illustrates elemental mapping of oxygen in the portion shown in FIG. 17A.
FIG. 17D illustrates elemental mapping of phosphorous in the portion shown in FIG. 17A.
FIG. 17E illustrates elemental mapping of sulfur in the portion shown in FIG. 17A.
FIG. 17F illustrates elemental mapping of manganese in the portion shown in FIG. 17A.
FIG. 17G illustrates elemental mapping of nickel in the portion shown in FIG. 17A.
FIG. 17H illustrates elemental mapping of copper in the portion shown in FIG. 17A.
FIG. 17I illustrates elemental mapping of zinc in the portion shown in FIG. 17A.
FIG. 17J illustrates elemental mapping of antimony in the portion shown in FIG. 17A.
Figure 18A:
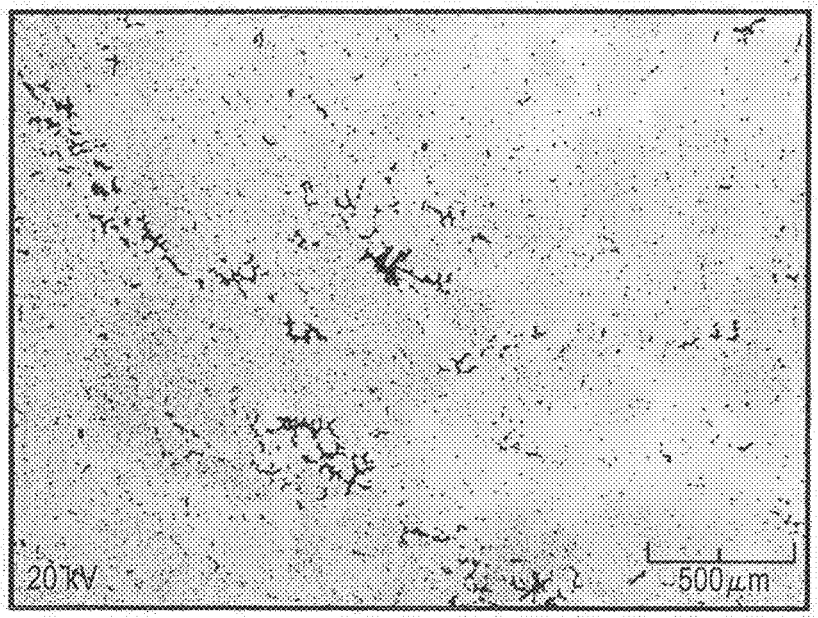
FIG. 18A is a BE image of a permanent mold implementation of C79880 alloy.
Figure 18B:
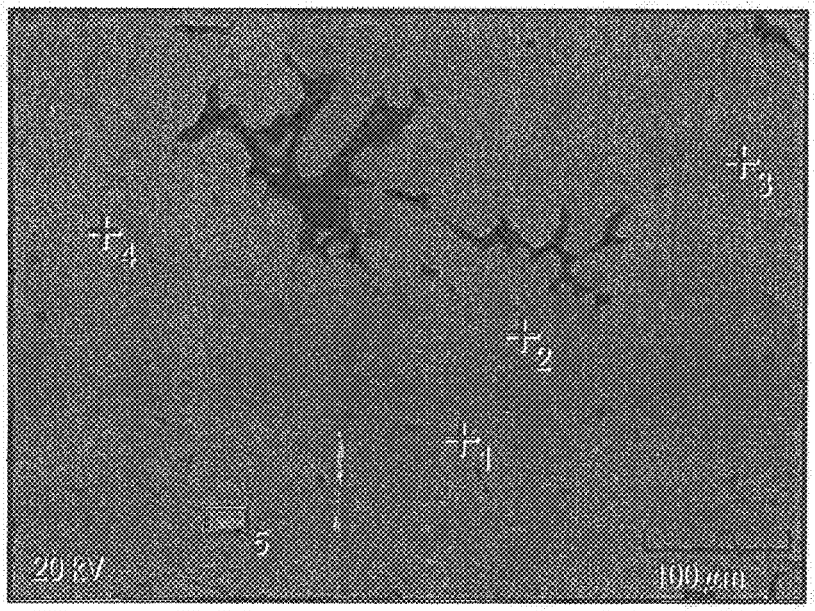
FIG. 18B is a magnified image of FIG. 19A indicating locations of interest for an implementation of an alloy C79880 alloy.
Figure 18C:
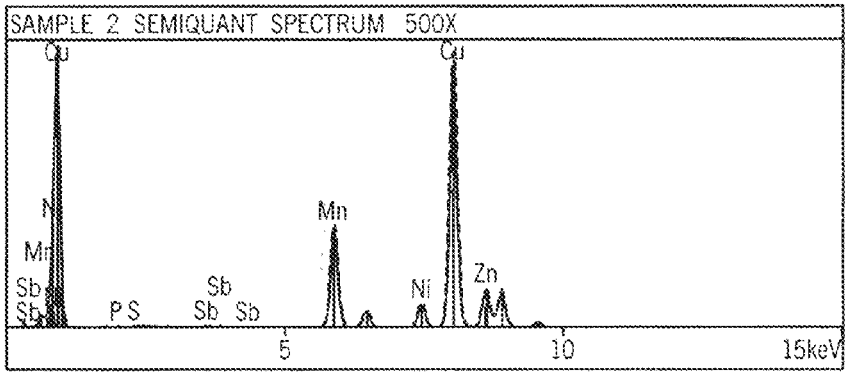
FIG. 18C is a general EDS spectrum of one implementation of C79880 alloy.
Figure 18D:
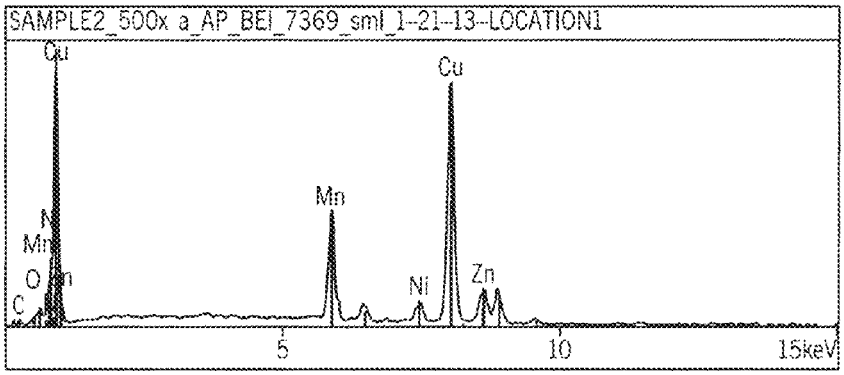
FIG. 18D is a EDS spectrum of location 1 of one implementation of C79880 alloy.
Figure 18E:
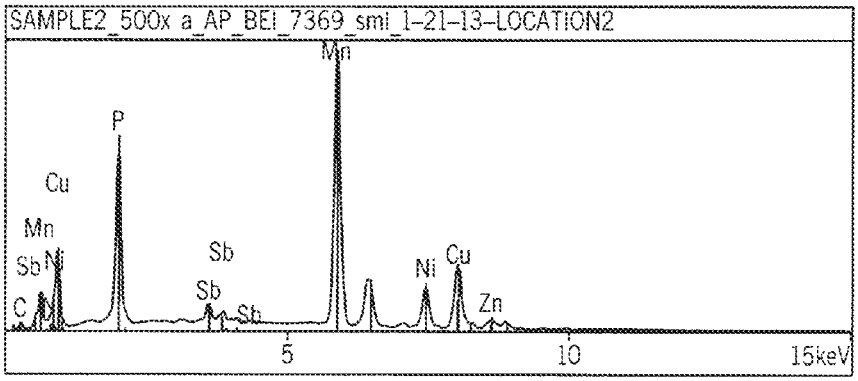
FIG. 18E is a EDS spectrum of location e of one implementation of C79880 alloy.
Figure 18F:
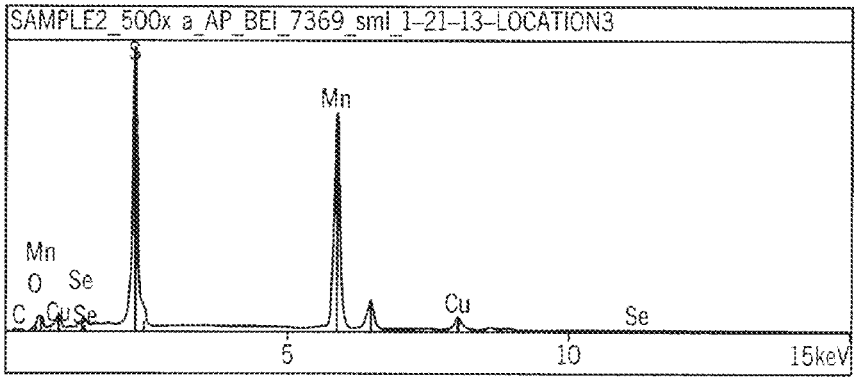
FIG. 18F is a EDS spectrum of location 3 of one implementation of C79880 alloy
Figure 18G:
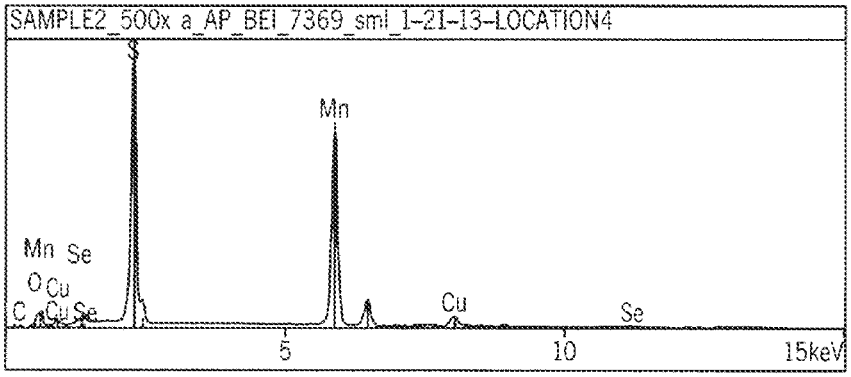
FIG. 18G is a EDS spectrum of location 4 of one implementation of C79880 alloy.
Figure 18H:
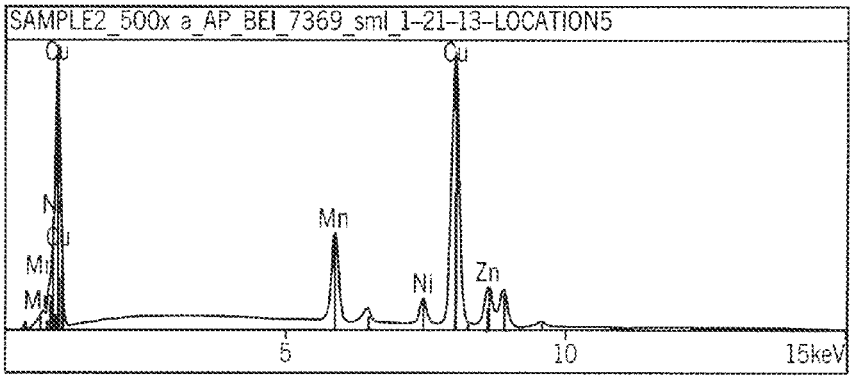
FIG. 18H is a EDS spectrum of location 5 of one implementation of C79880 alloy.
Figures 19A, 19B, 19C, 19D, 19E, 19F, 19G, 19H, 19I, 19J:
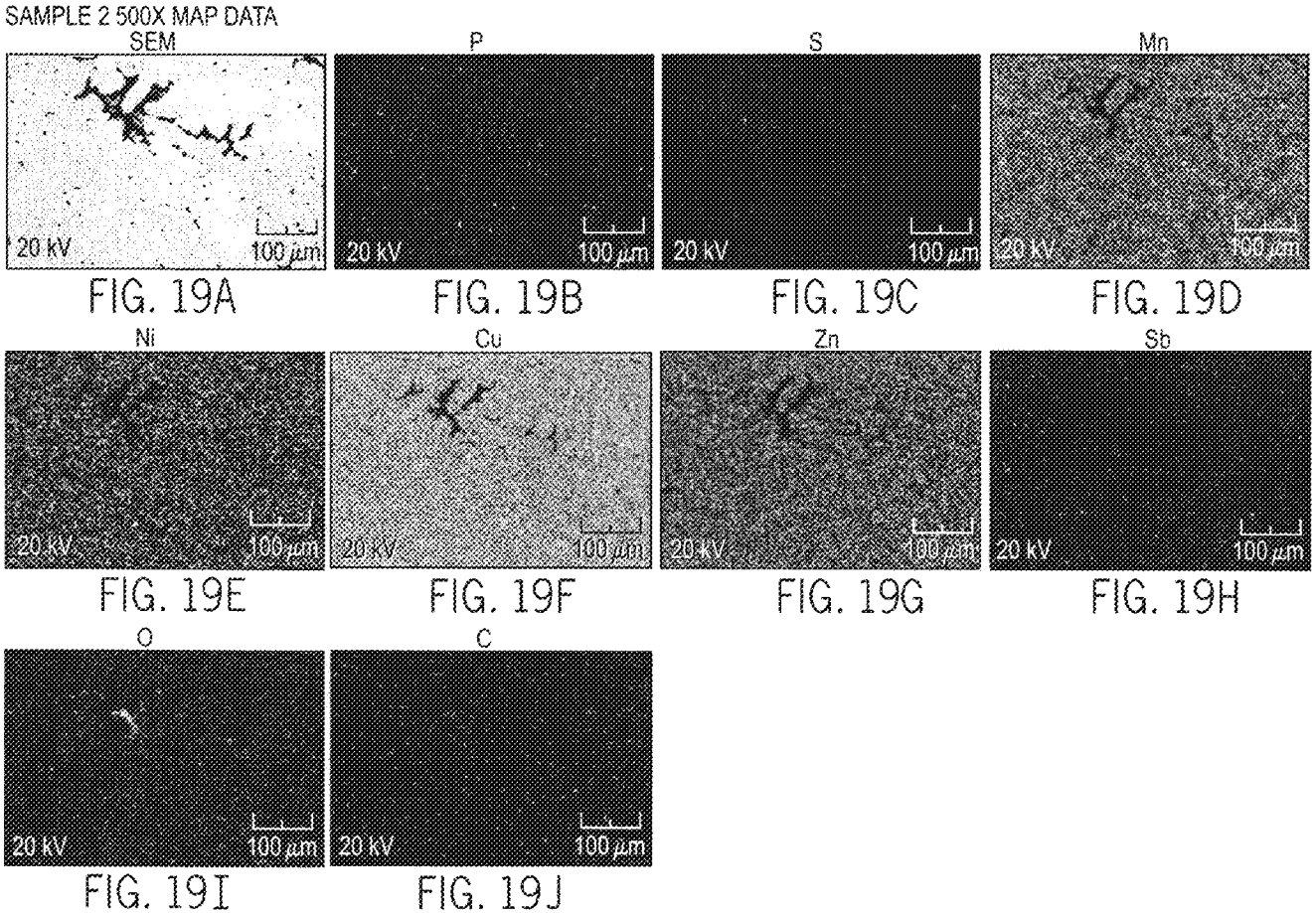
FIG. 19A is a SEM image of a permanent mold implementation of C79880 alloy.
FIG. 19B illustrates elemental mapping of phosphorous in the portion shown in FIG. 19A.
FIG. 19C illustrates elemental mapping of sulfur in the portion shown in FIG. 19A.
FIG. 19D illustrates elemental mapping of manganese in the portion shown in FIG. 19A.
FIG. 19E illustrates elemental mapping of nickel in the portion shown in FIG. 19A.
FIG. 19F illustrates elemental mapping of copper in the portion shown in FIG. 19A.
FIG. 19G illustrates elemental mapping of zinc in the portion shown in FIG. 19A.
FIG. 19H illustrates elemental mapping of antimony in the portion shown in FIG. 19A.
FIG. 19I illustrates elemental mapping of oxygen in the portion shown in FIG. 19A.
FIG. 19J illustrates elemental mapping of carbon in the portion shown in FIG. 19A.
Figure 20A:
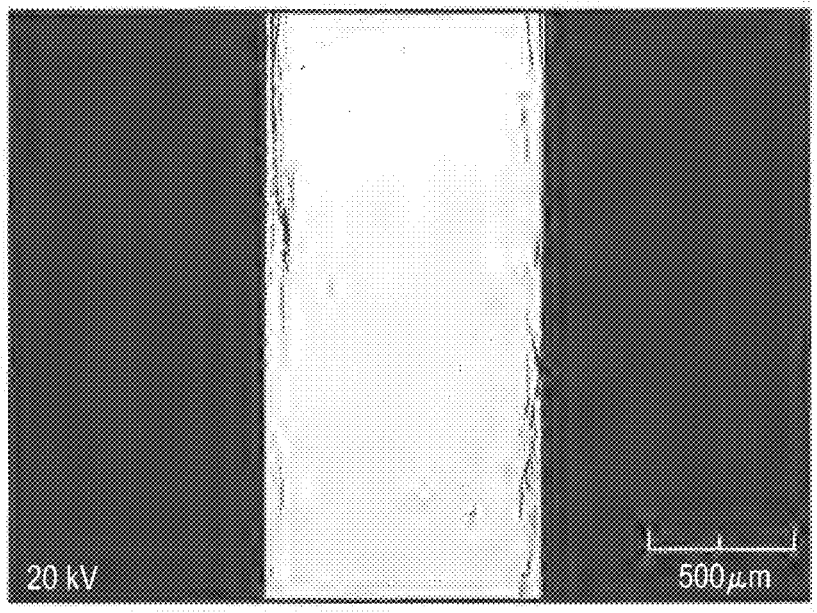
FIG. 20A is a BE image of a cold rolled and annealed implementation of C79880 alloy.
Figure 20B:
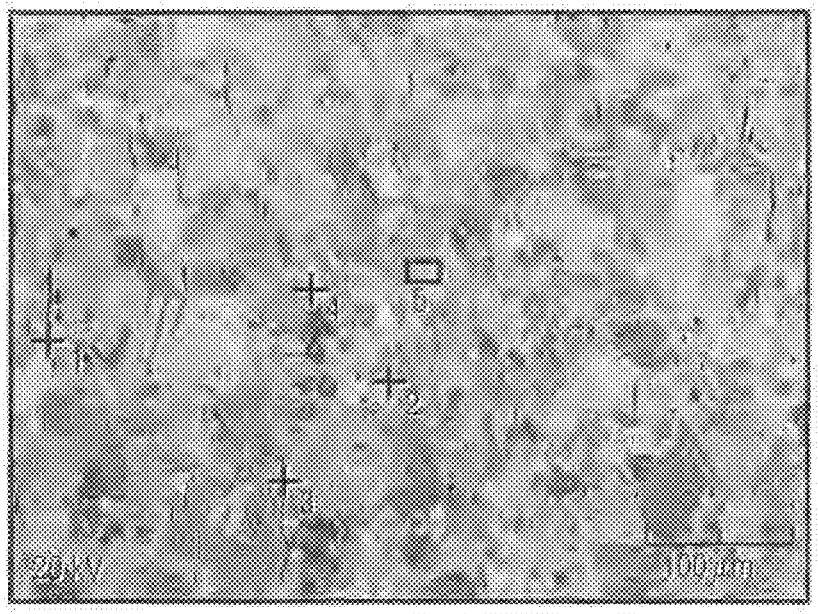
FIG. 20B is a magnified image of FIG. 20A indicating locations of interest for an implementation of an alloy C79880 alloy.
Figure 20C:
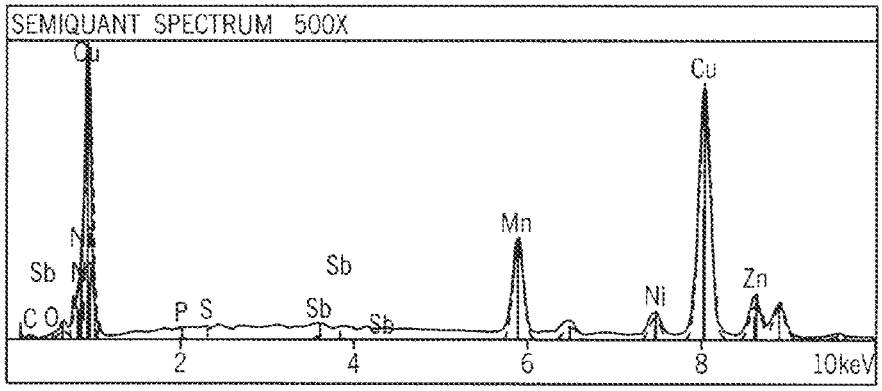
FIG. 20C is a general EDS spectrum of one implementation of C79880 alloy.
Figure 20D:
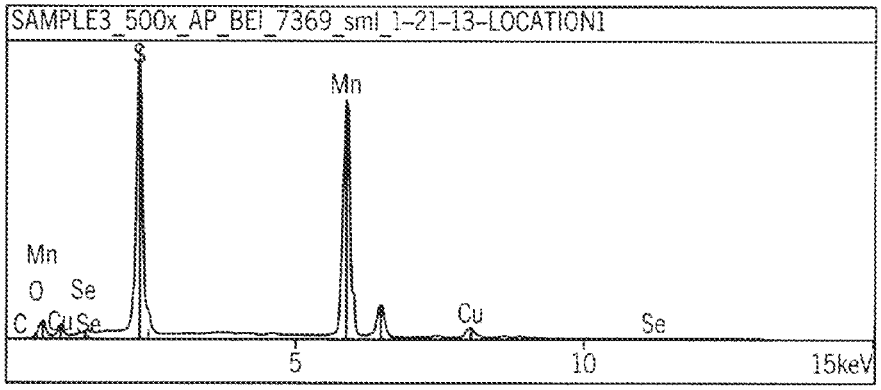
FIG. 20D is a EDS spectrum of location 1 of one implementation of C79880 alloy.
Figure 20E:
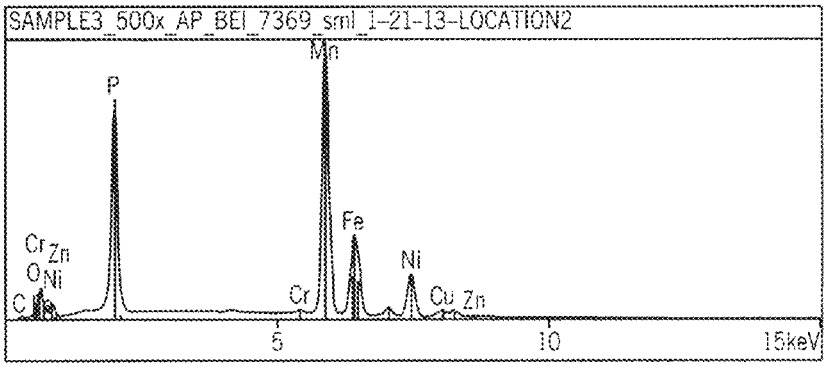
FIG. 20E is a EDS spectrum of location 2 of one implementation of C79880 alloy.
Figure 20F:
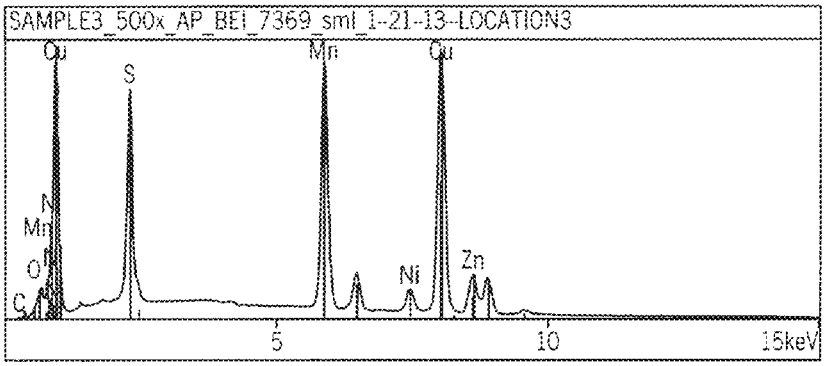
FIG. 20F is a EDS spectrum of location 3 of one implementation of C79880 alloy.
Figure 20G:
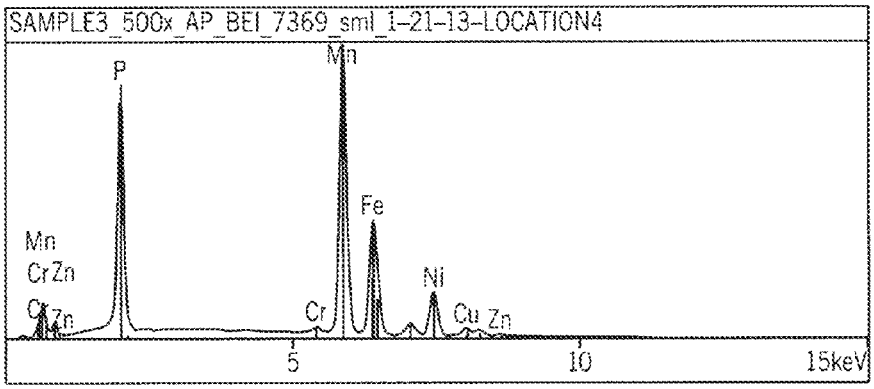
FIG. 20G is a EDS spectrum of location 4 of one implementation of C79880 alloy.
Figure 20H:
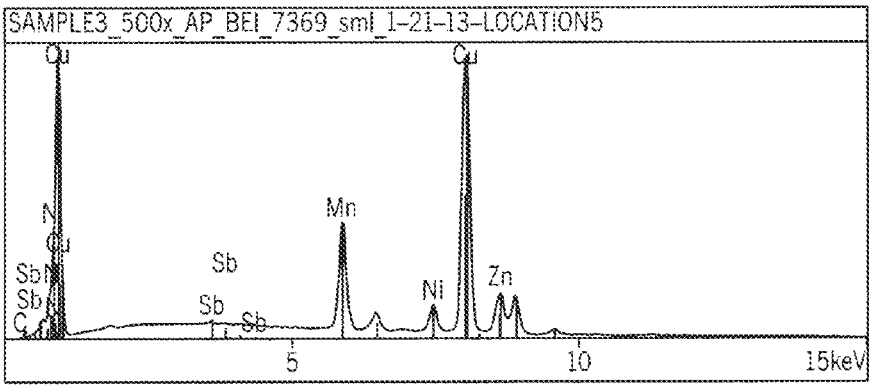
FIG. 20H is a EDS spectrum of location 5 of one implementation of C79880 alloy.
Figure 21A:
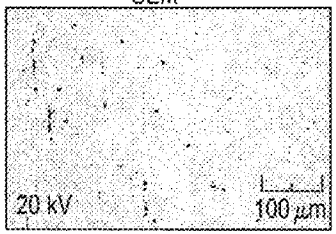
FIG. 21A is a SEM image of a cold rolled and annealed implementation of alloy C79880 alloy.
Figure 21B:
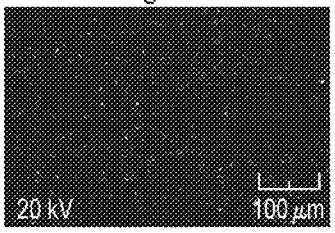
FIG. 21B illustrates elemental mapping of carbon in the portion shown in FIG. 21A.
Figure 21C:
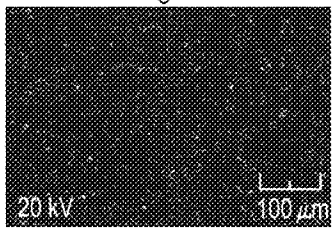
FIG. 21C illustrates elemental mapping of oxygen in the portion shown in FIG. 21A.
Figure 21D:
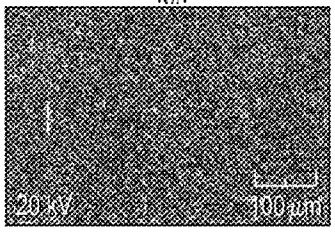
FIG. 21D illustrates elemental mapping of manganese in the portion shown in FIG. 21A.
Figure 21E:
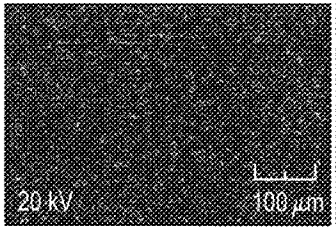
FIG. 21E illustrates elemental mapping of nickel in the portion shown in FIG. 21A.
Figure 21F:
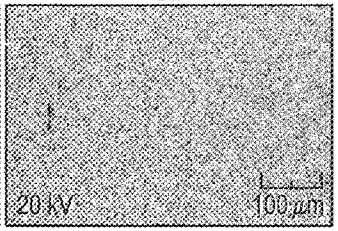
FIG. 21F illustrates elemental mapping of copper in the portion shown in FIG. 21A.
Figure 21G:
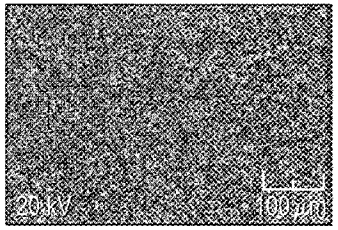
FIG. 21G illustrates elemental mapping of zinc in the portion shown in FIG. 21A.
Figure 21H:
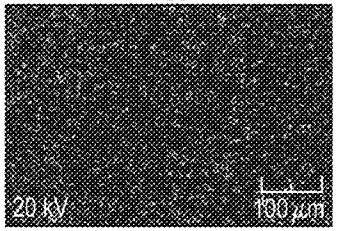
FIG. 21I illustrates elemental mapping of sulfur in the portion shown in FIG. 21A.
FIG. 21J illustrates elemental mapping of phosphorous in the portion shown in FIG. 21A.
Figure 21I:
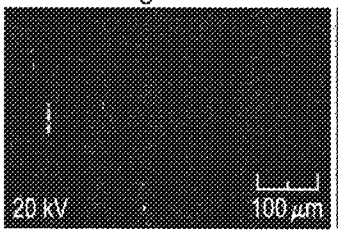
Figure 21J:
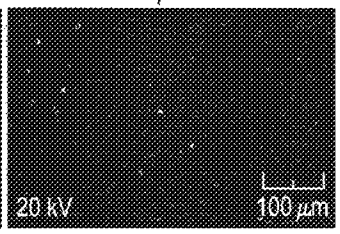
Figure 22:
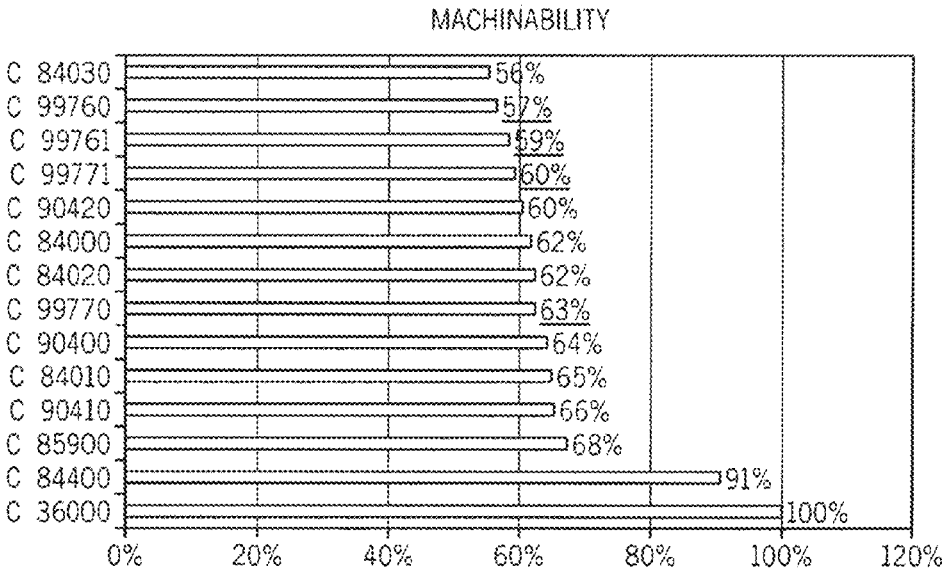
FIG. 22 illustrates a graph comparing machinability of an implementation C99760 and an implementation of C99770 to other alloys.

FIGS. 16 and 17 relate to the cold rolled implementation, FIGS. 18 and 19 to the permanent cast implementation, and FIGS. 20 and 21 to the cold rolled and annealed (1200 F, 1 Hour). The annealing study indicated an isochronal annealing behavior. FIGS. 25 A-C relate to the isochronal annealing study. The cold rolled coupons were annealed at each indicated temperature for one hour and then air cooled. Hardness data at different annealing temperatures show that recovery takes place up to 400 C. Recrystallization occurs between 450 and 650 C. Grain growth takes place beyond 650 C annealing. If intermittent annealing is required during hot and cold rolling, it should be around 800 C. Recrystallized microstructure is shown. FIG. 25A is a table illustrating the annealing temperature information and mechanical properties. FIGS. 25B and 25C are graphs of the hardness vs annealing temperature. These data are useful to decide the temperatures for homogenization of cast ingots and to decide the intermittent annealing temperatures during hot and cold rolling. In addition, the recrystallization temperatures are useful to decide the annealing temperature of flat and tube products.

Color Comparison

Figure 10:
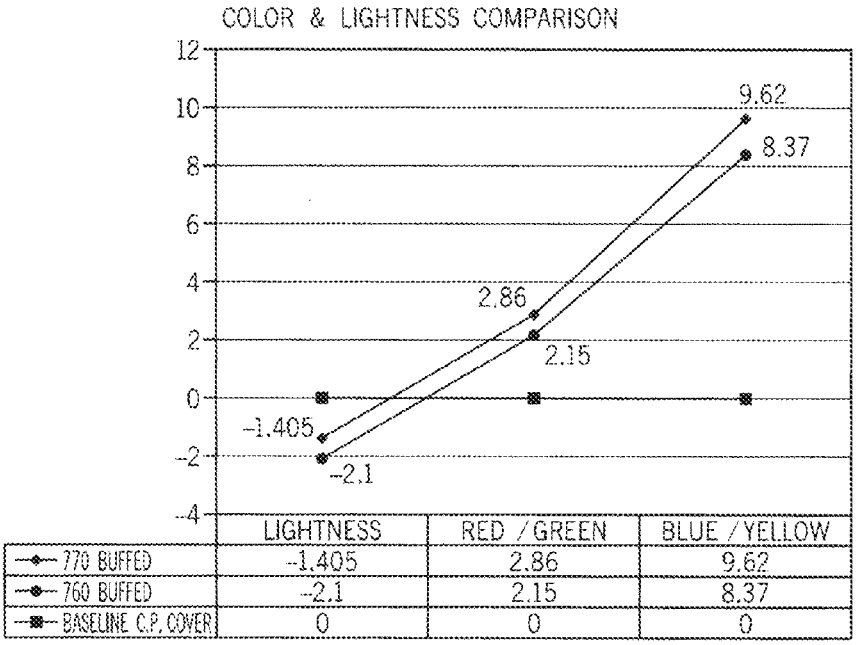
FIG. 10 is a color comparison of implementations of C99760 alloy and implementations of C99770 alloy with the chrome plated cover.
Figure 11:
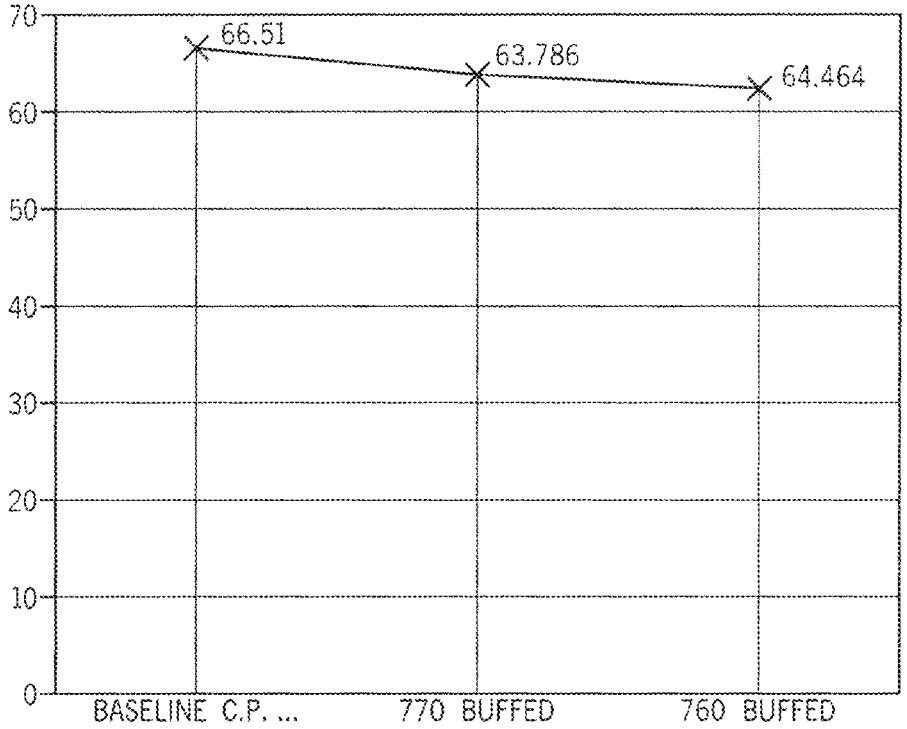
FIG. 11 is a color comparison of buffed implementations of C99760 alloy and implementations of C99770 alloy with chrome plated cover.

The goal is to show how close in color alloys C99760 and C99770 are in comparison with hexavalent chrome plated (CP) part. To this end, a standard hexavalent chrome plated (CP) cover is used. This is established as the zero that the tests are based on. FIG. 10 shows the comparison with the baseline cover, the lightness, red or green value, and blue or yellow values for buffed C99760 and C99770. These data show that alloy C99760 is only 2.1 units darker from the CP part, 2.15 units redder and 8.37 units yellower. FIG. 11 shows the comparison of reflectivity. Reflectivity of CP cover is 66.511 from a possible 100. In case of alloys C99760 and C99770, reflectivity values dropped slightly and ere 62.464 and 63.786 respectively. Since white metals will be used in the buffed condition, these data indicate that the two white metals compare favorably with respect to the CP cover.

Microstructure

Scanning electron microscopy (SEM) uses electrons for imaging, much as a light microscope uses visible light. Imaging is typically performed using secondary electrons (SE) for best resolutions of fine topographical features. Alternatively, imaging with backscattered electrons (BE) gives contrast based on atomic number to resolve microscopic composition variations, as well as topographical information. Qualitative and quantitative chemical analysis can be performed using energy dispersive X-ray spectrometry (EDS) with the SEM. The instrument used by the testing laboratory is equipped with a light element detector capable of detecting carbon and elements with a higher atomic number (i.e., cannot detect hydrogen, helium, lithium, beryllium, and boron).

Each sample was mounted in conductive epoxy, metallographically prepared to a 0.04 μm finish, and examined using BE imaging to further identify observed particles.

The sample was examined using a scanning electron microscope with energy dispersive spectroscopy (SEM/EDS) using an excitation voltage of 20 keV. This instrument is equipped with a light element detector capable of detecting carbon and elements with greater atomic numbers (i.e., cannot detect hydrogen, helium, lithium, beryllium, and boron). Images were acquired using the backscattered electron (BE) detector. In backscattered electron imaging, elements with a higher atomic number appear brighter. For the EDS analysis, results are semi-quantitative and in weight percent unless otherwise indicated.

The observed samples consist of dispersed particles throughout the copper-rich matrix. Image analysis was then performed to determine particle size. The minimum, maximum, and average are reported in the following table. Image analysis for particle size was performed on micrographs found in FIG. 12 and FIG. 14.

Microstructure

C99760

Microstructure was studied as laid out above for an implementation of C99760: 99760-020613-P2H1-1: 66.11 Cu, 10.28 Ni, 10.90 Zn, 10.86 Mn, 0.021 S, 0.441 Sb, 0.408 Sn, 0.537 Fe, 0.385 Al, 0.022 P, 0.002 Si and 0.015 C.

| Spectrum | P | S | Mn | Fe | Ni | Cu | Zn | Se | Sn | Sb |
|---|---|---|---|---|---|---|---|---|---|---|
| Location 1 | — | — | 15.9 | <1 | 12.6 | 45.9 | 6.3 | — | 3.1 | 15.8 |
| Location 2 | — | 16.9 | 34.2 | <1 | 4.8 | 35.8 | 4.3 | 3.4 | — | — |
| Location 3 | <1 | — | 15.0 | <1 | 7.2 | 62.1 | 8.3 | — | 2.2 | 3.5 |
| Location 4 - Base | — | — | 9.0 | 1.03 | 12.4 | 67.8 | 9.8 | — | — | — |

Figure 12A:
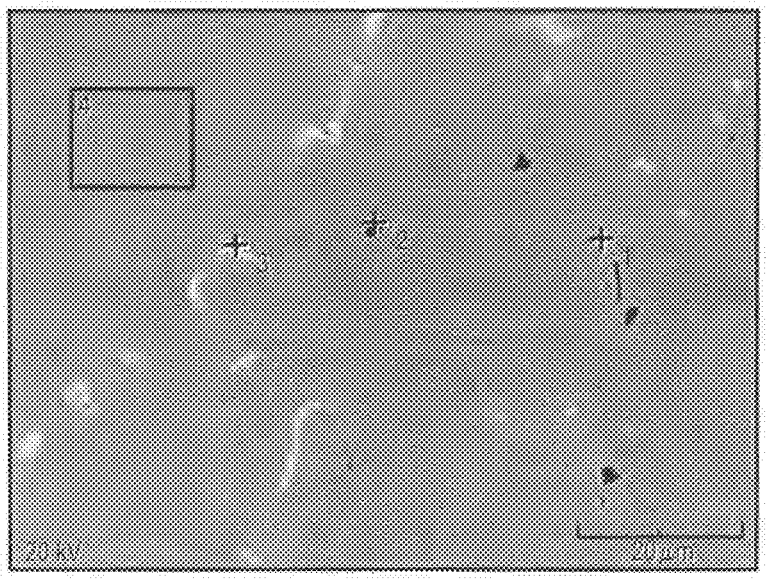
FIG. 12A is a micrograph indicating locations of interest for an implementation of an alloy C99760.
Figure 12B:
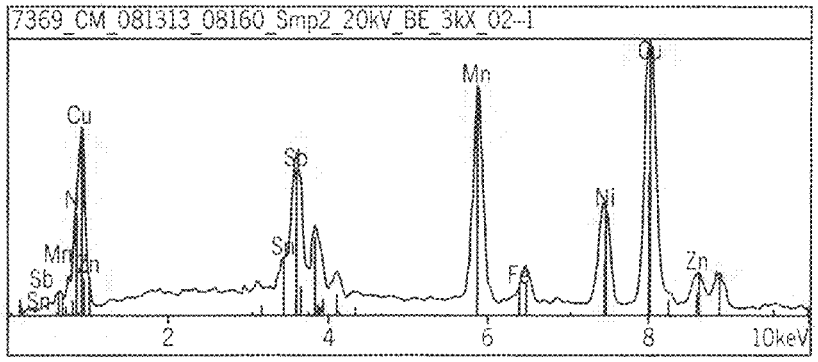
FIGS. 12B-E is a BE image of an implementation of C99760 alloy showing annotated locations and corresponding EDS spectra.
Figure 12C:
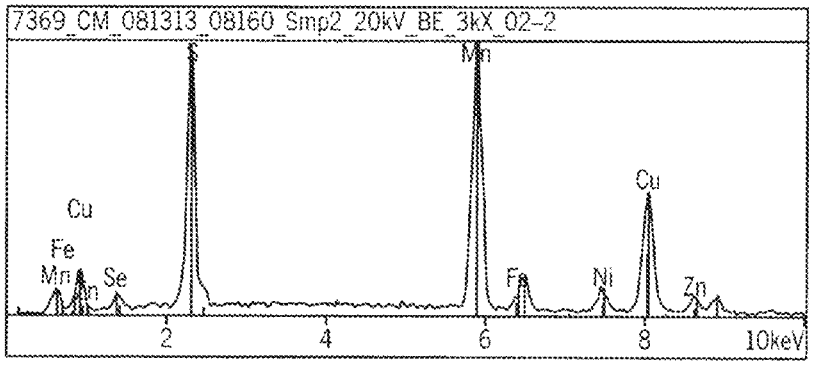
Figure 12D:
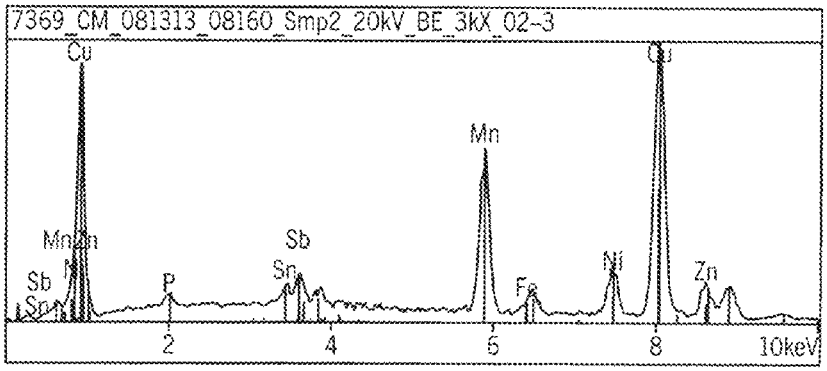
Figure 12E:
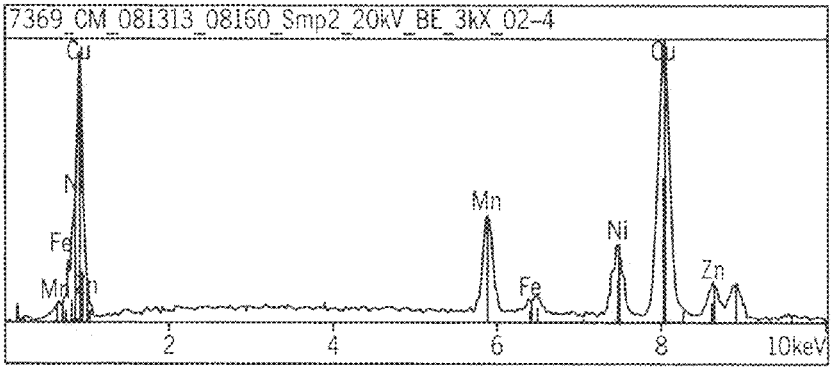
Figure 12F:
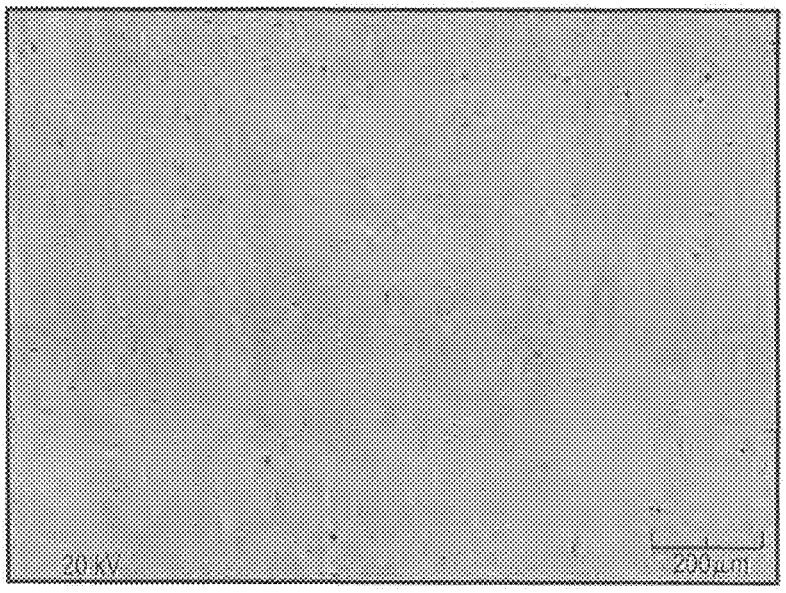
FIGS. 12F-G are additional BE images of the implementation of C99760 of FIG. 12A.
Figure 12G:
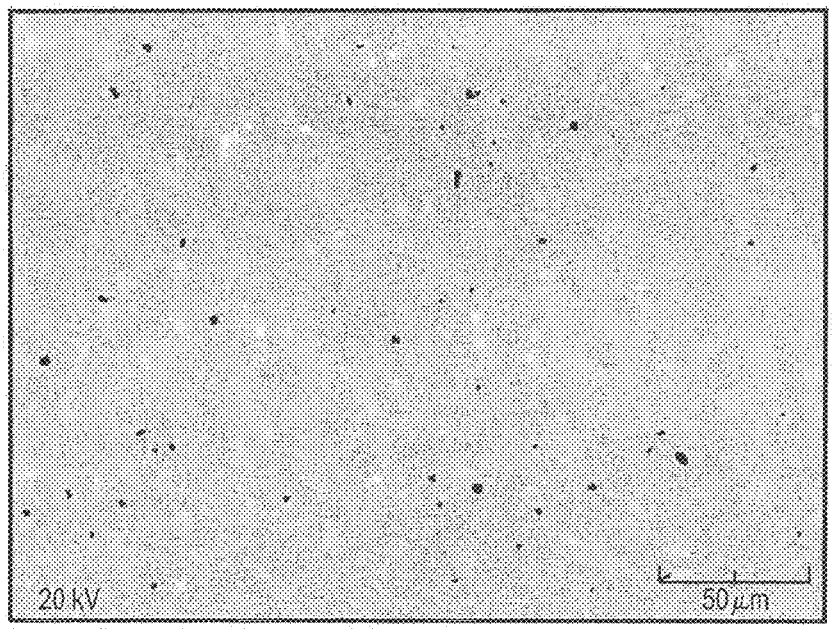
Figure 12H:
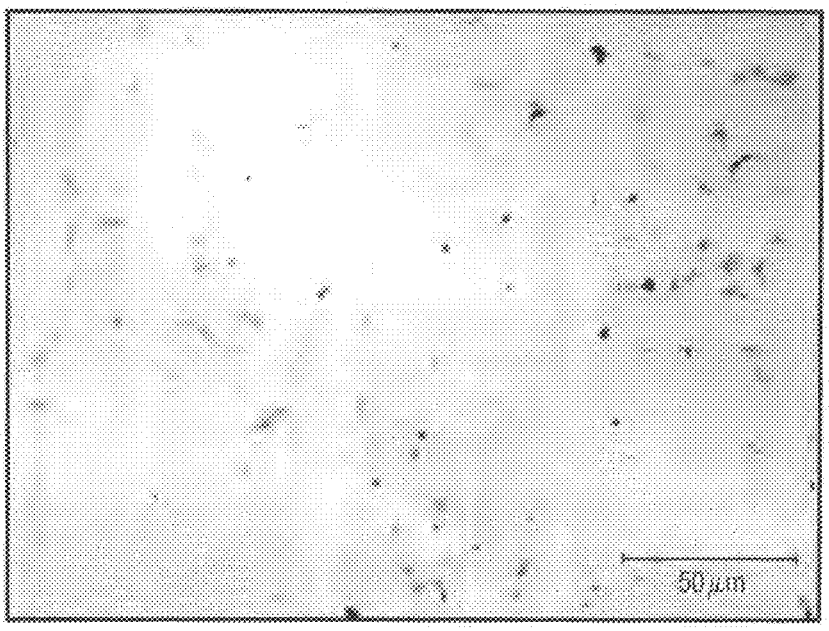
FIG. 12H is the as-polished micrograph of implementation of C99760 alloy.
Figure 13A:
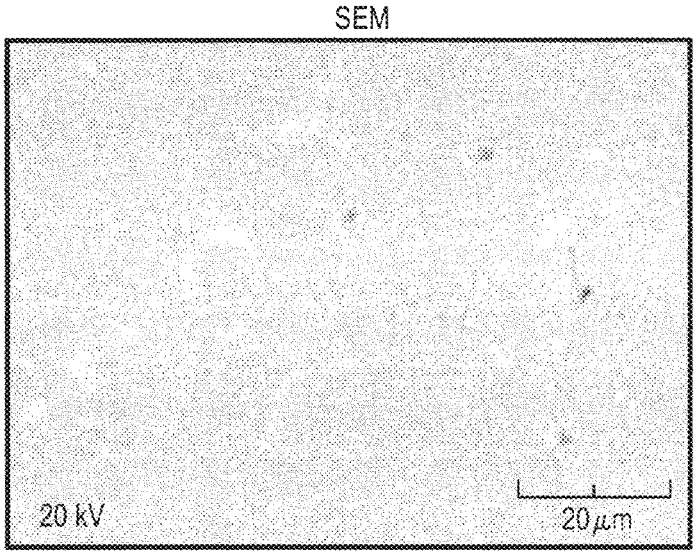
FIG. 13A is a SEM image of an embodiment of alloy C99760.
Figure 13B:
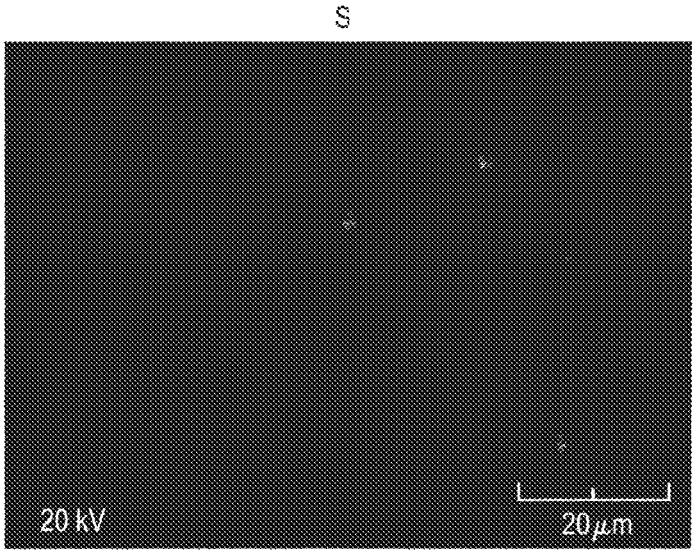
FIG. 13B illustrates elemental mapping of sulfur in the portion shown in FIG. 13A.
Figure 13C:
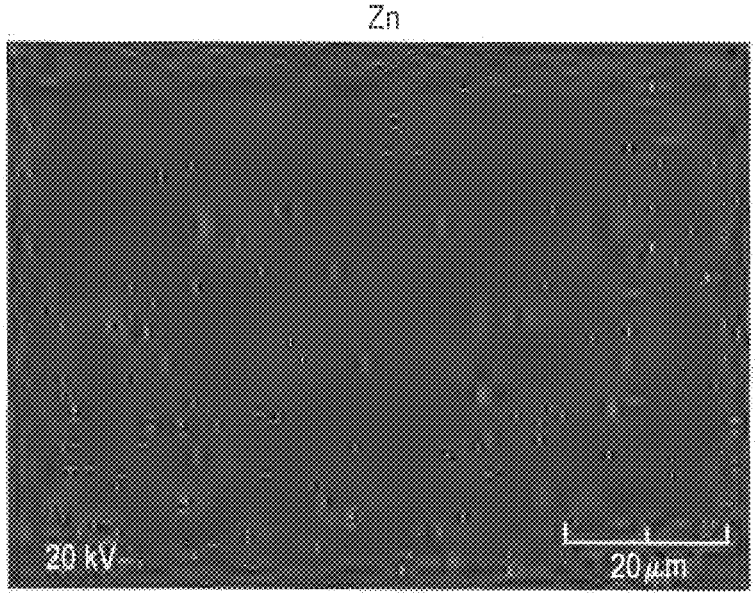
FIG. 13C illustrates elemental mapping of zinc in the portion shown in FIG. 13A.
Figure 13D:
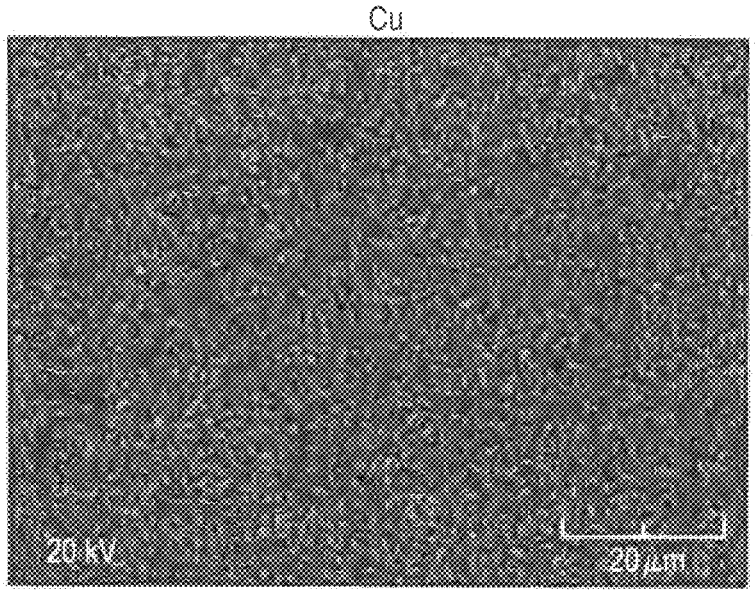
FIG. 13D illustrates elemental mapping of copper in the portion shown in FIG. 13A.
Figure 13E:
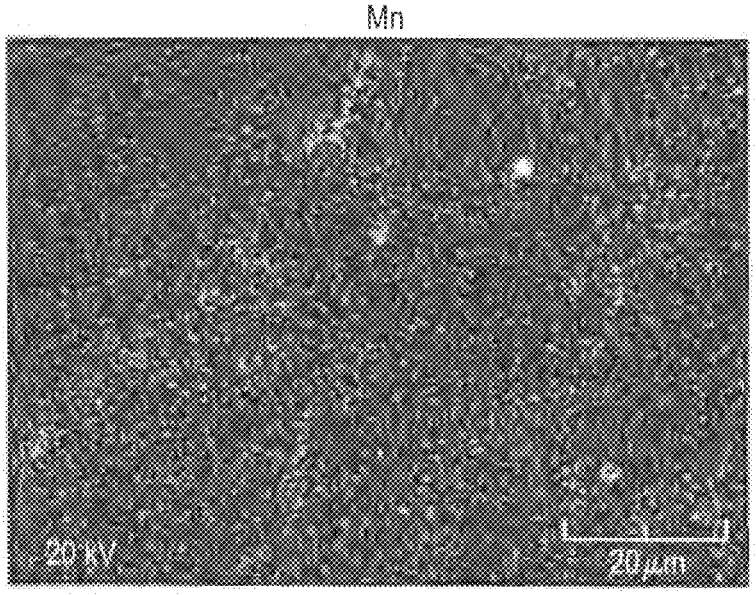
FIG. 13E illustrates elemental mapping of manganese in the portion shown in FIG. 13A.
Figure 13F:
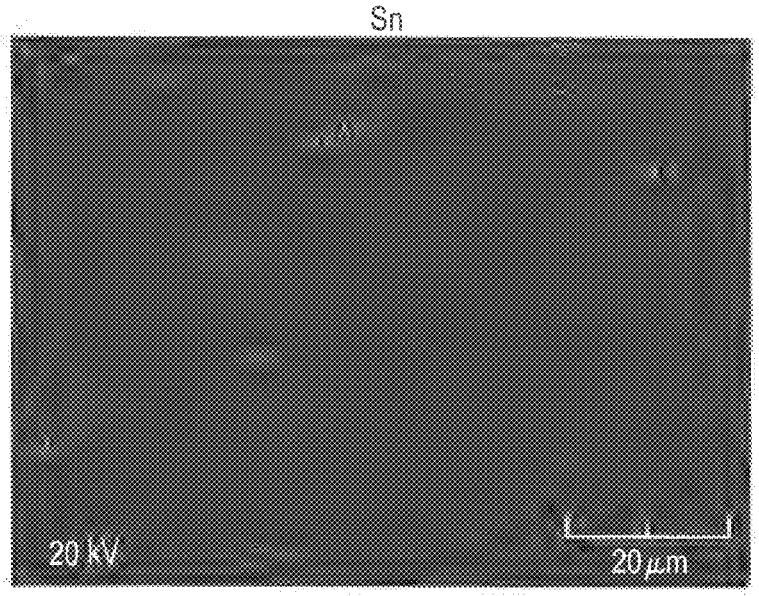
FIG. 13F illustrates elemental mapping of tin in the portion shown in FIG. 13A.
Figure 13G:
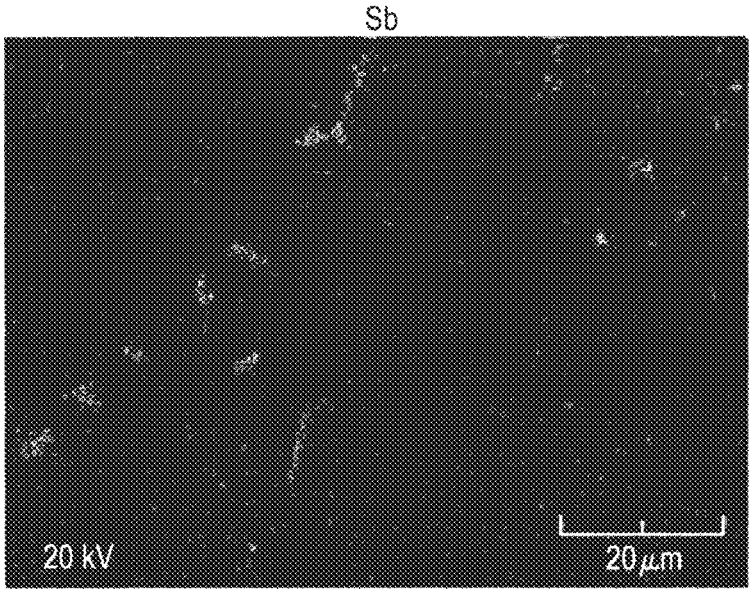
FIG. 13G illustrates elemental mapping of antimony in the portion shown in FIG. 13A.
Figure 13H:
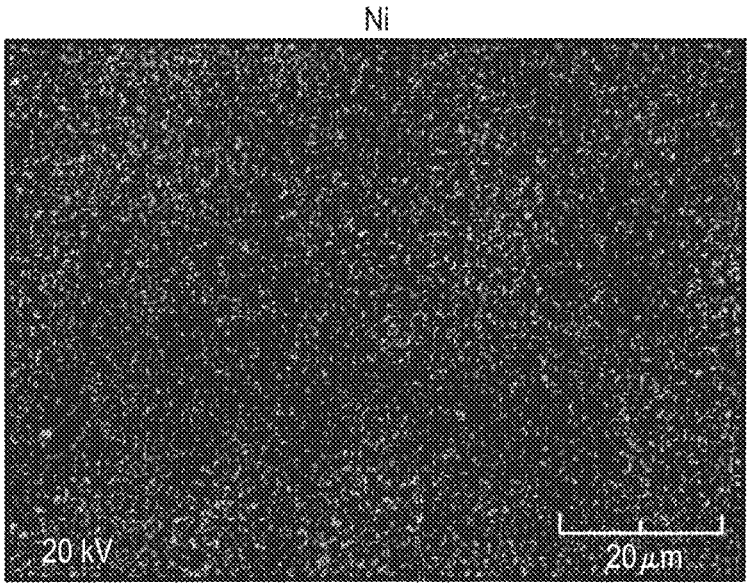
FIG. 13H illustrates elemental mapping of nickel in the portion shown in FIG. 13A.

SEM/EDS spectra results of the base material from C99760 consist of significant amounts of copper with lesser amounts of manganese, iron, nickel, and zinc (see Location 4). The light colored phases at Locations 1 and 3 reveal antimony and tin in addition to manganese, iron, nickel, copper, and zinc (see Location 1 and 3). The dark colored phase reveals significant amounts of sulfur, copper, and manganese with lesser amounts iron, nickel, zinc, and selenium (see Location 2). Semi-quantitative particle size data is reported in the following tables for the above locations. Representative BE images are shown in FIG. 12F and FIG. 12G.

| Sample ID | Minimum (μm) | Maximum (μm) | Average (μm) |
|---|---|---|---|
| C99760 | <0.1 | 11.5 | 1.5 |

C99770

C99770 microstructure was studied as laid out above for an implementation of C99760: 99770-052313-P7H1-7: 67.71 Cu, 5.32 Ni, 11.99 Zn, 12.88 Mn, 0.011S, 0.514 Sb, 0.669 Sn, 0.508 Fe, 0.344 Al, 0.031 P, 0.007 Pb, 0.002 Si and 0.004 C. Semi-quantitative particle size data is given below.

| Spectrum | P | Mn | Fe | Ni | Cu | Zn | Sn | Sb | Pb |
|---|---|---|---|---|---|---|---|---|---|
| Location 1 - Base | — | 11.5 | <1 | 4.6 | 71.2 | 12.2 | — | — | — |
| Location 2 | — | 9.2 | <1 | 2.1 | 24.5 | 3.8 | 4.7 | 3.6 | 51.8 |
| Location 3 | 16.8 | 57.9 | 4.8 | 7.3 | 8.8 | 1.3 | 1.4 | 1.6 | — |
| Location 4 | — | 22.7 | — | 13.8 | 19.9 | 2.4 | 2.8 | 38.5 | — |

SEM/EDS spectra results of the base material from Sample C99770 consist of significant amounts of copper with lesser amounts of manganese, iron, nickel, and zinc (see Location 1). The bright white colored phase reveals significant amounts of lead with lesser amounts of copper, manganese, nickel, zinc, tin, and antimony (see Location 2). The dark colored phase reveals significant amounts of phosphorus and manganese with lesser amounts of iron, nickel, copper, zinc, tin, and antimony (see Location 3) The light colored phase at Location 4 reveals significant amounts of antimony and manganese with lesser amounts of nickel, copper, zinc, and tin (see Location 4).

| Sample ID | Minimum (μm) | Maximum (μm) | Average (μm) |
|---|---|---|---|
| Sample 1, C99770 | <0.1 | 6.6 | 1.1 |

Figure 14A:
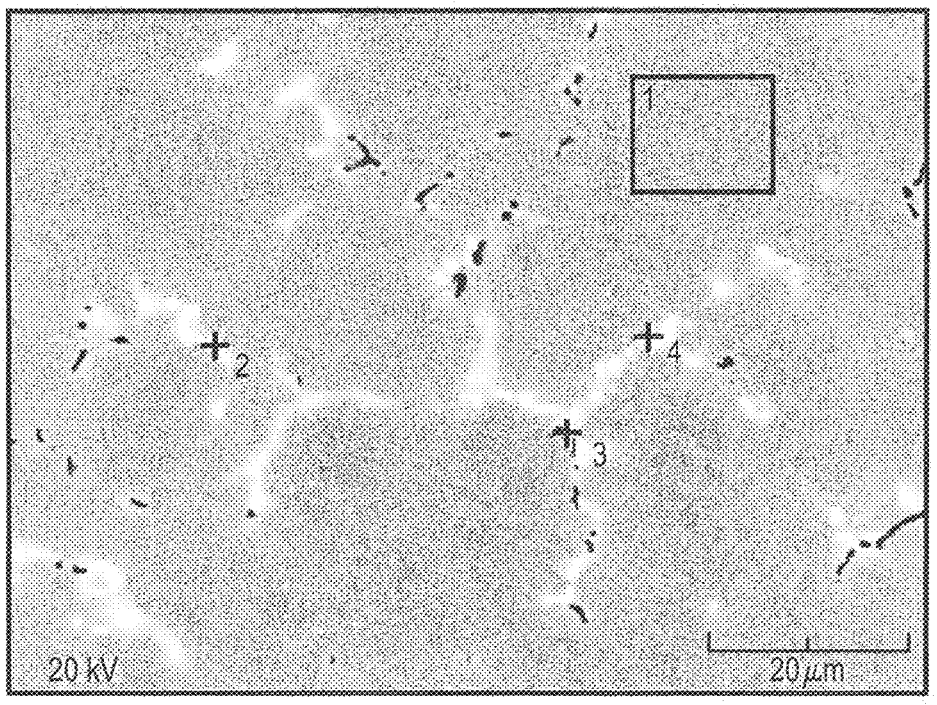
FIG. 14A is a micrograph indicating locations of interest for an implementation of an alloy C99770.
Figure 14B:
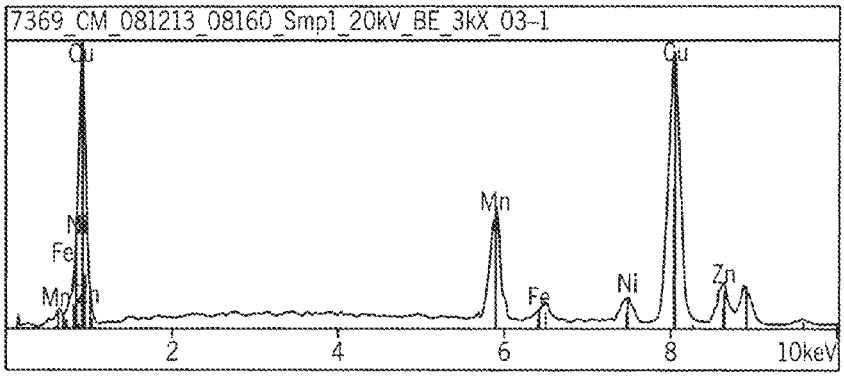
FIGS. 14B-E is a BE image of an implementation of C99770 alloy showing annotated locations and corresponding EDS spectra.
Figure 14C:
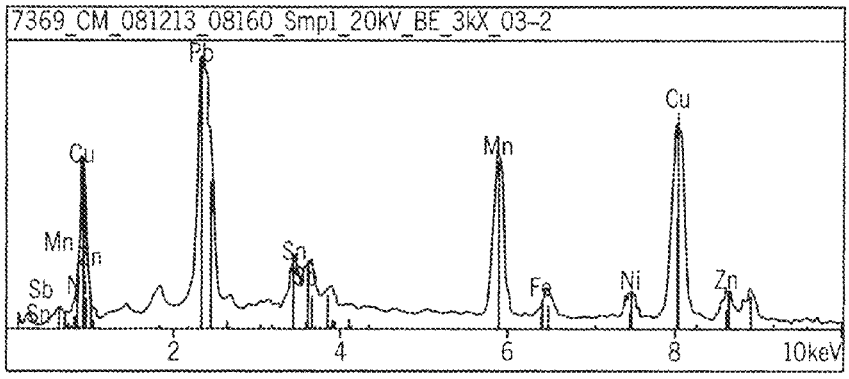
Figure 14D:
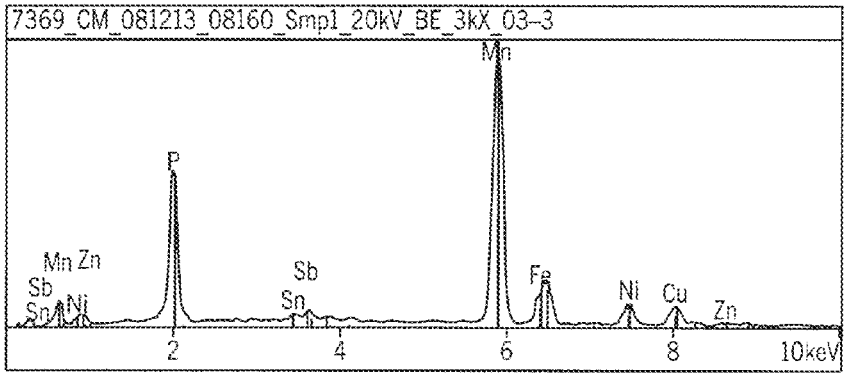
Figure 14E:
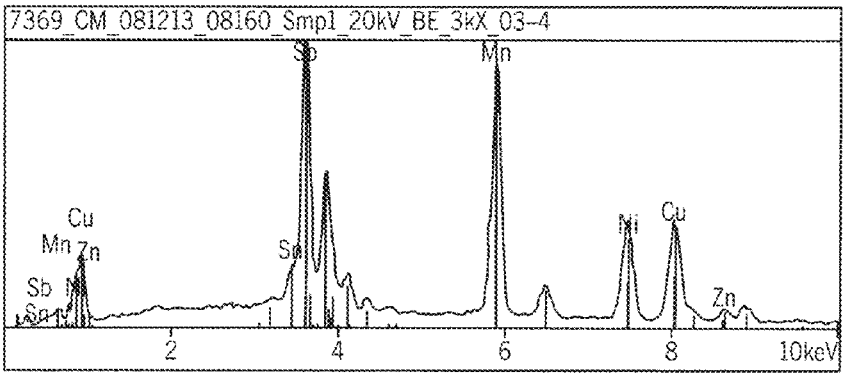
Figure 14F:
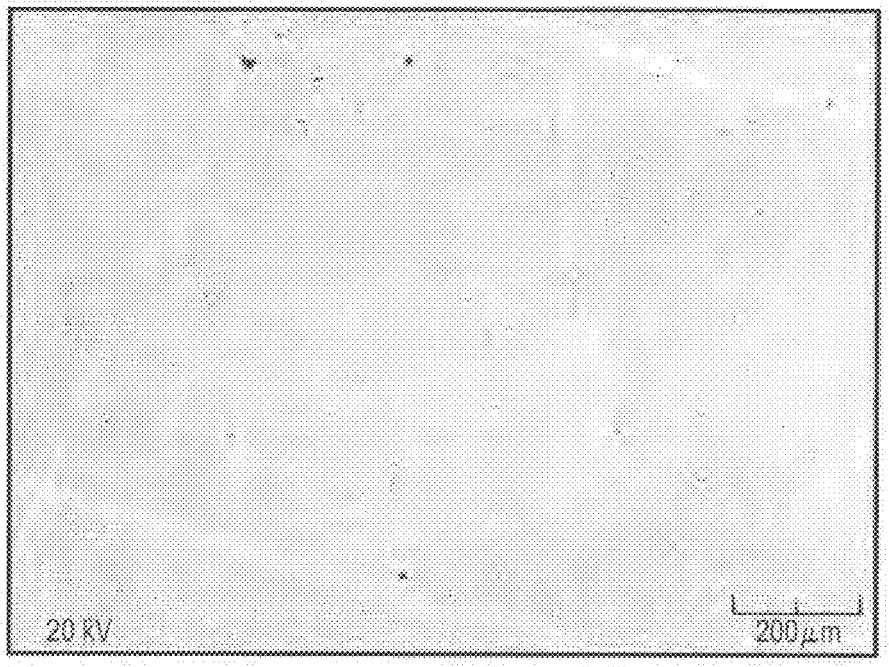
FIGS. 14F-G are additional BE images of the implementation of C99770 of FIG. 14A.
Figure 14G:
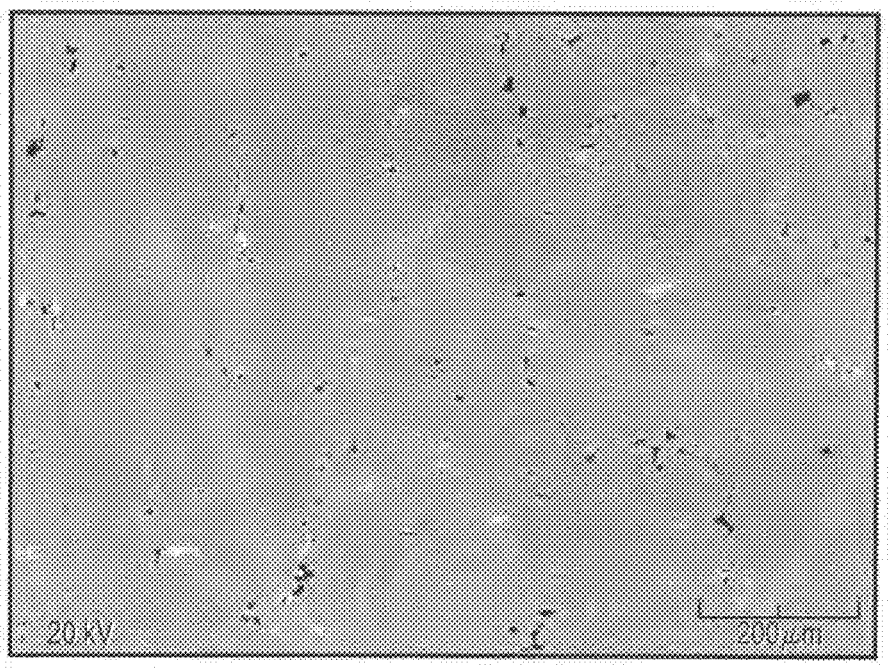
Figure 14H:
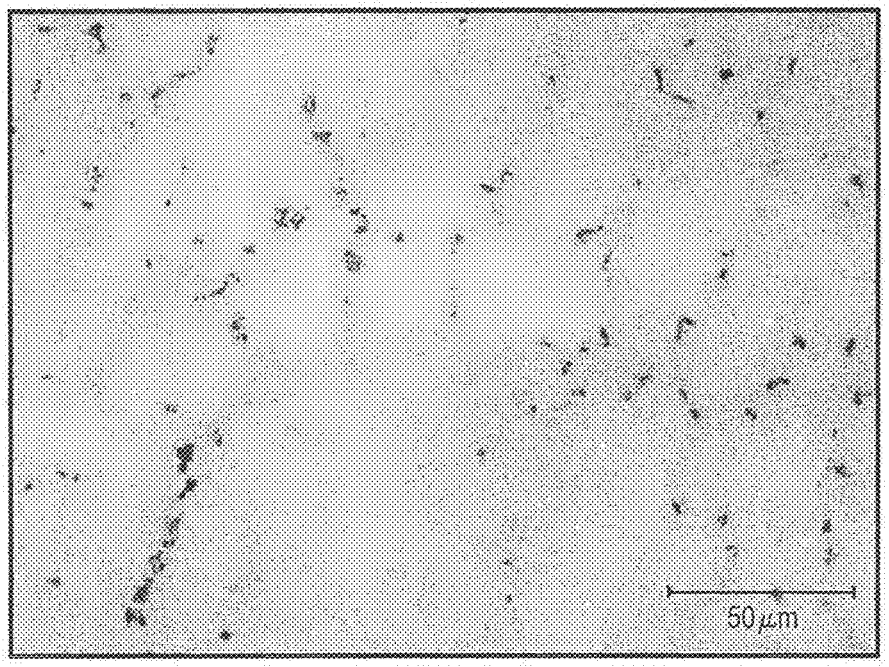
FIG. 14H illustrates as-polished micrograph of an implementation of C99770 alloy.
Figure 15A:
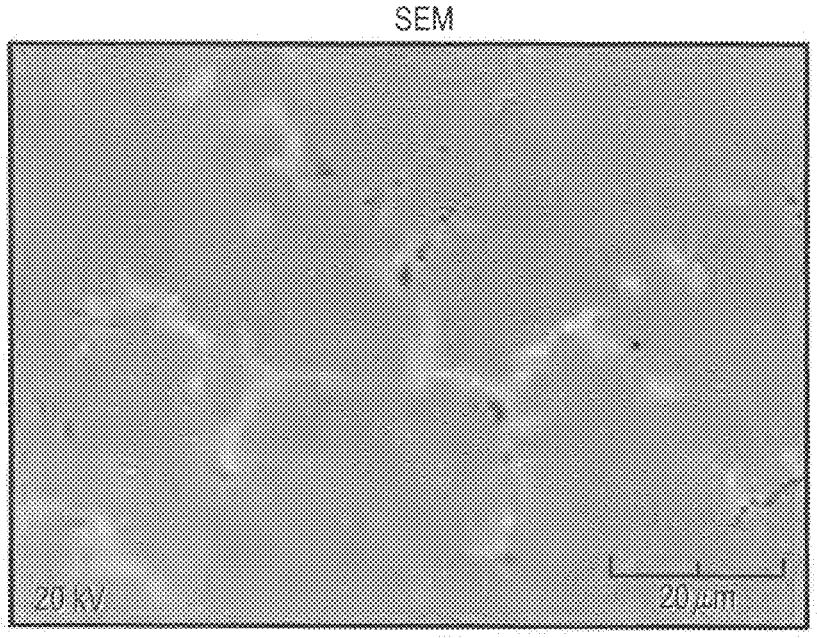
FIG. 15A is a SEM image of an embodiment of alloy C99770.
Figure 15B:
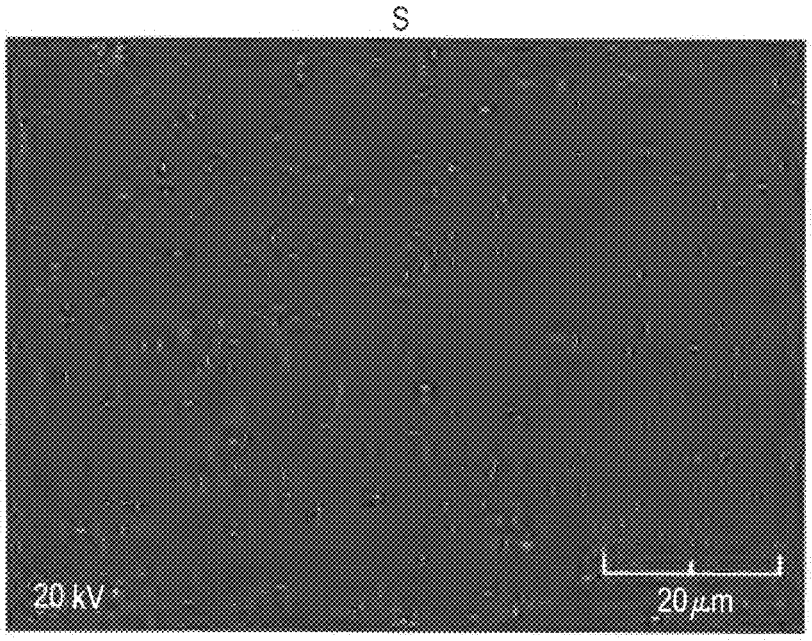
FIG. 15B illustrates elemental mapping of sulfur in the portion shown in FIG. 15A.
Figure 15C:
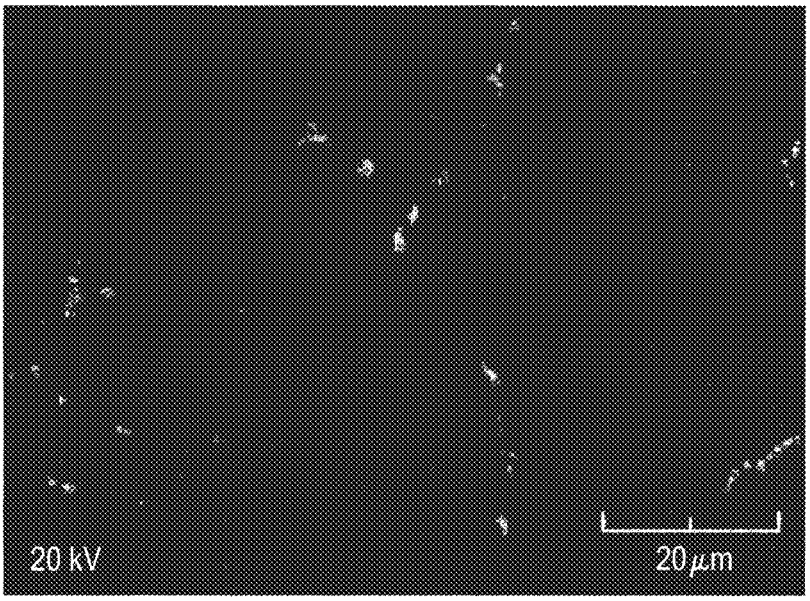
FIG. 15C illustrates elemental mapping of phosphorous in the portion shown in FIG. 15A.
Figure 15D:
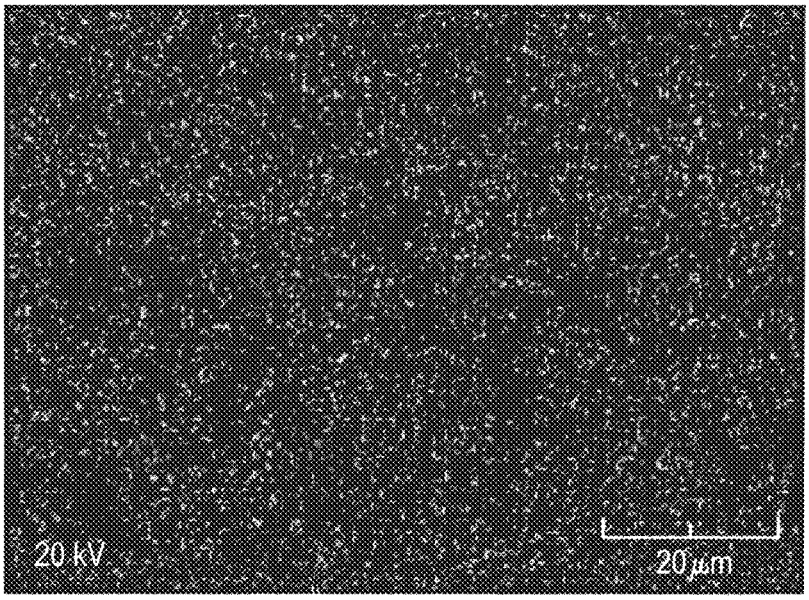
FIG. 15D illustrates elemental mapping of zinc in the portion shown in FIG. 15A.
Figure 15E:
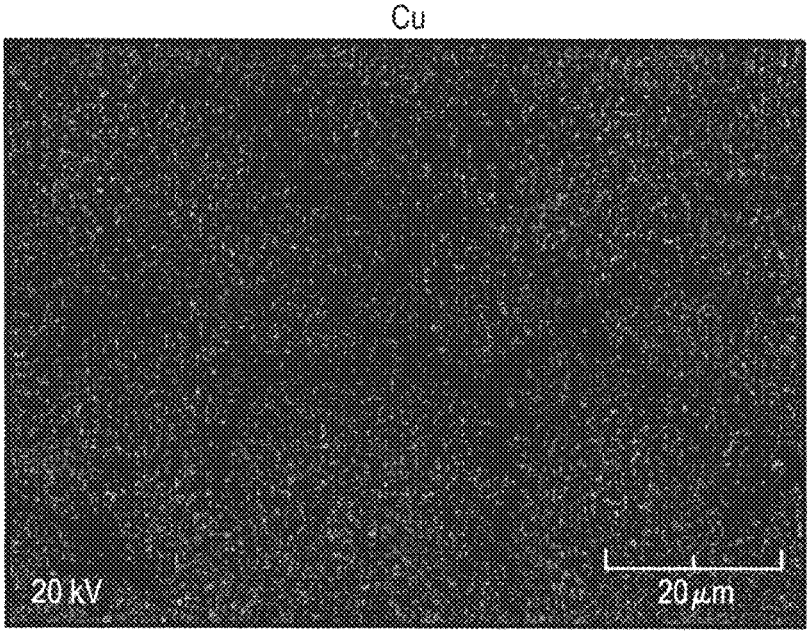
FIG. 15E illustrates elemental mapping of copper in the portion shown in FIG. 15A.
Figure 15F:
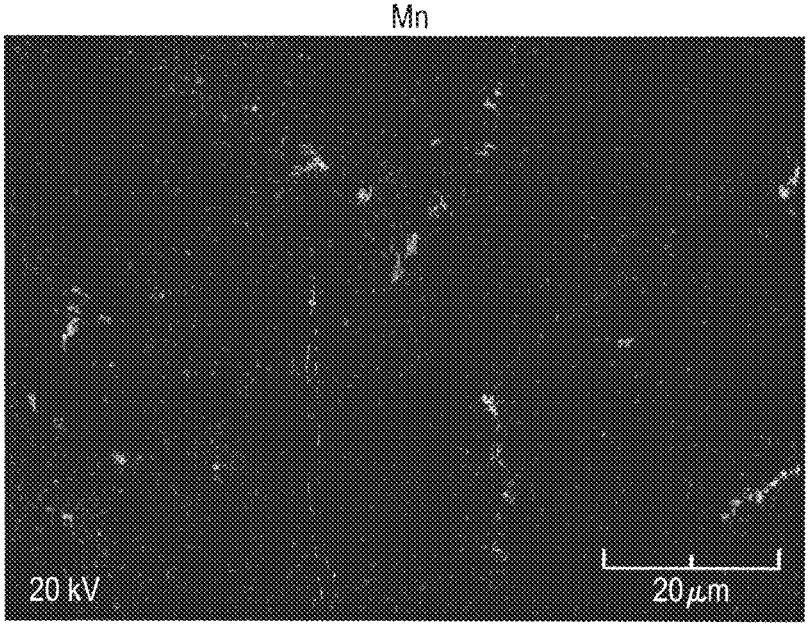
FIG. 15F illustrates elemental mapping of manganese in the portion shown in FIG. 15A.
Figure 15G:
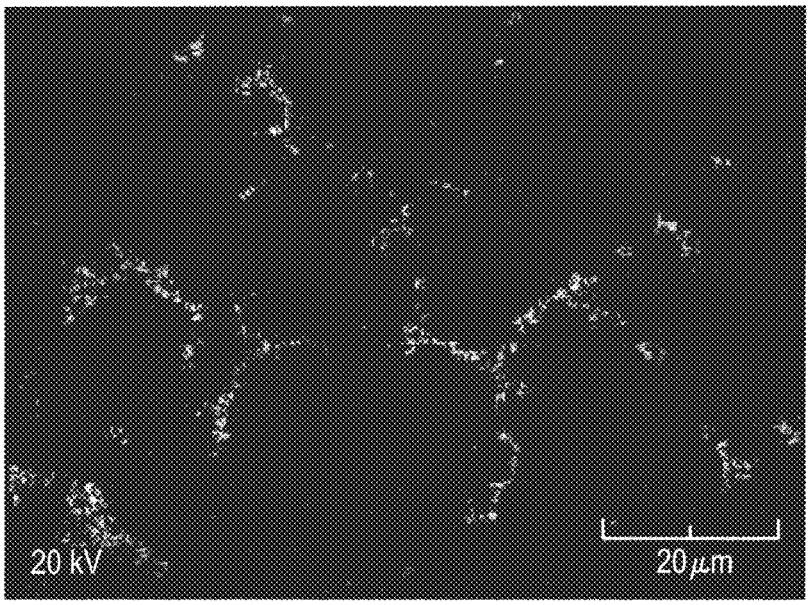
FIG. 15G illustrates elemental mapping of tin in the portion shown in FIG. 15A.
Figure 15H:
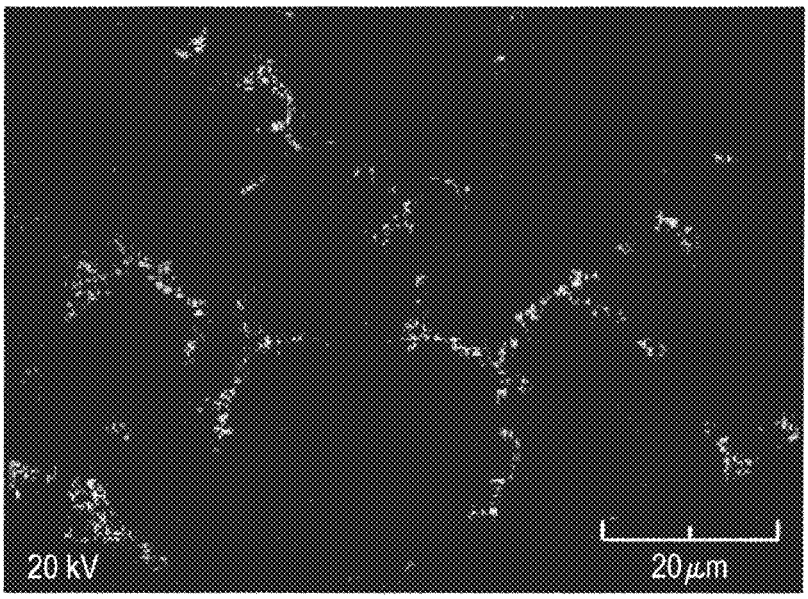
FIG. 15H illustrates elemental mapping of antimony in the portion shown in FIG. 15A.
Figure 15I:
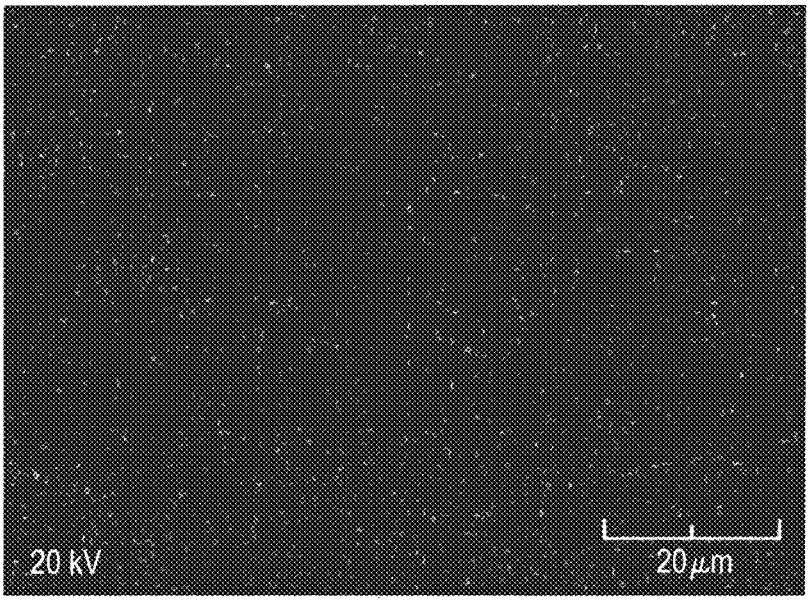
FIG. 15I illustrates elemental mapping of nickel in the portion shown in FIG. 15A.
Figure 16A:
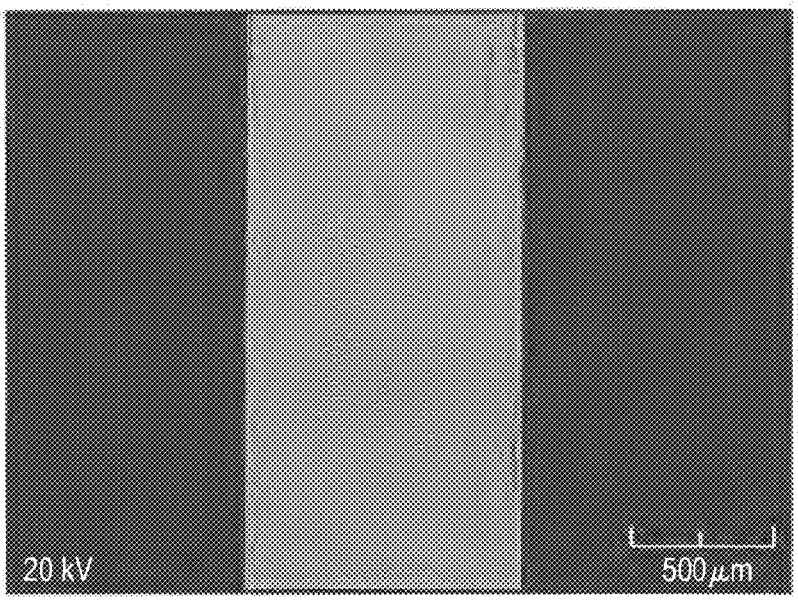
FIG. 16A is a BE image of a cold rolled implementation of C79880 alloy.
Figure 16B:
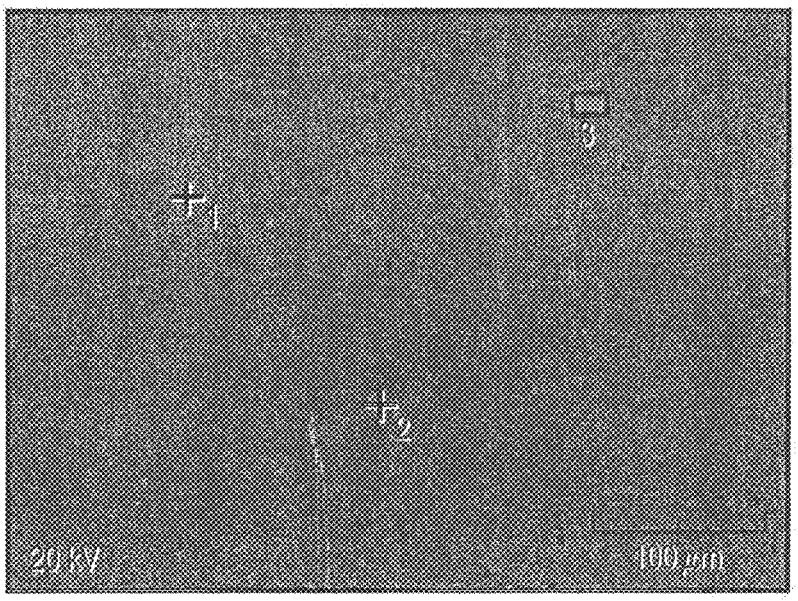
FIG. 16B is a magnified image of FIG. 16A indicating locations of interest for an implementation of an alloy C79880 alloy.
Figure 16C:
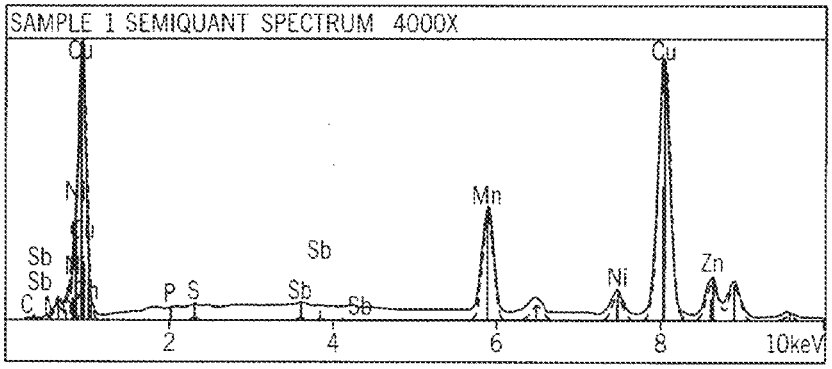
FIG. 16C is a general EDS spectrum of one implementation of C79880 alloy.
Figure 16D:
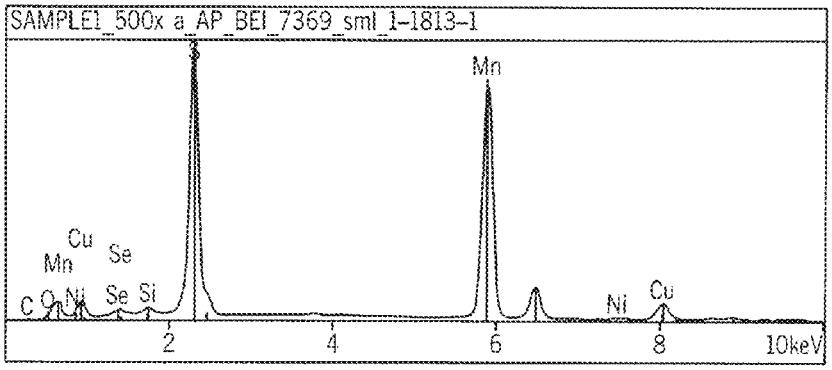
FIG. 16D is a EDS spectrum of location 1 of one implementation of C79880 alloy.
Figure 16E:
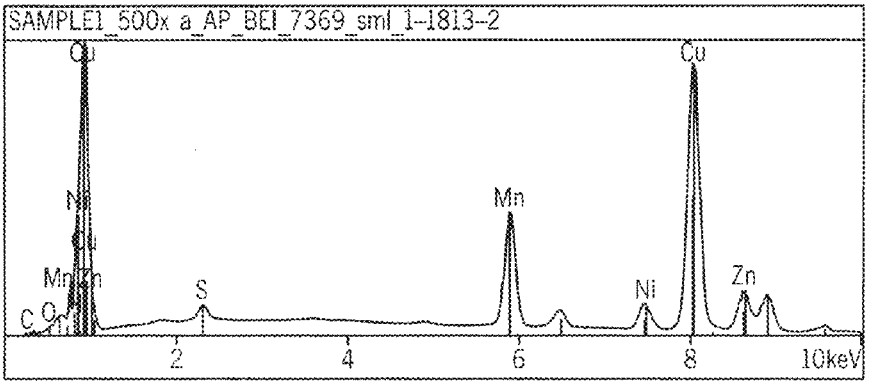
FIG. 16E is a EDS spectrum of location 2 of one implementation of C79880 alloy.
Figure 16F:
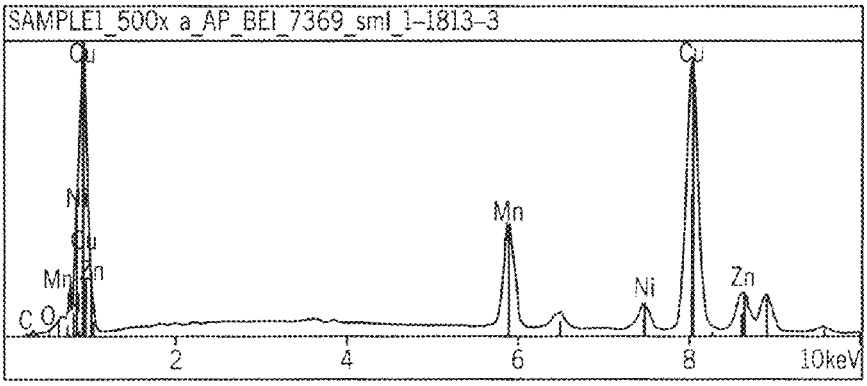
FIG. 16F is a EDS spectrum of location 3 of one implementation of C79880 alloy.

Representative BE images taken at 200× and 1000× are shown in FIG. 14F and FIG. 14G.

C79880

Three samples of C79880 were studied. The samples were based upon the implementation 79880-030813-P4H5-9 of FIG. 4A Sample 1

Cold Rolled

FIGS. 16A-F (BE and EDS images) and 17A-J (SEM and elemental analysis) relate to sample one, which was a cold rolled implementation of C79880.

| Spectrum | Si | P | S | Cr | Mn | Fe | Ni | Cu | Zn | Se | Sb |
|---|---|---|---|---|---|---|---|---|---|---|---|
| Sample 1 General Spectrum | | 0.1 | 0.1 | | 10.6 | | 4.6 | 71.0 | 12.6 | | 0.9 |
| Sample 1 Location 1 | 0.6 | | 30.0 | | 57.6 | | 0.5 | 8.9 | | 2.4 | |
| Sample 1 Location 2 | | | 1.2 | | 11.5 | | 4.6 | 70.8 | 11.9 | | |
| Sample 1 Location 3 | | | | | 11.5 | | 4.8 | 71.5 | 12.2 | | |

Sample 1 includes a small amount of silicon at location one along with sulfur, manganese and small amounts of copper and nickel, indication manganese sulfide. Location 2 includes primarily copper with zinc and manganese, as does location 3 but with no sulfur detected.

Sample 2

Permanent Mold Cast

FIGS. 18A-H (BE and EDS images) and 19A-J (SEM and elemental analysis) relate to sample one, which was a permanent mold implementation of C79880.

| Spectrum | Si | P | S | Cr | Mn | Fe | Ni | Cu | Zn | Se | Sb |
|---|---|---|---|---|---|---|---|---|---|---|---|
| Sample 2 General Spectrum | | 0.1 | 0.1 | | 10.6 | | 4.4 | 71.8 | 12.5 | | 0.5 |
| Sample 2 Location 1 | | | | | | | | | | | |
| Sample 2 Location 2 | | 17.2 | | | 42.0 | | 10.5 | 22.5 | 3.8 | | 4.0 |
| Sample 2 Location 3 | | | 32.9 | | 58.3 | | | 7.3 | | 1.6 | |
| Sample 2 Location 4 | | | 32.9 | | 57.9 | | | 7.5 | | 1.7 | |
| Sample 2 Location 5 | | | | | 9.6 | | 4.8 | 73.3 | 12.3 | | |

Sample 2 includes phosphorous and manganese with nickel and copper and small amount of zinc and antimony at location 2. Location three is primarily manganese sulfide as is location 4. Location 5 is primarily copper and zinc with lesser amounts of manganese and nickel.

Sample 3

Cold Rolled and Annealed at 1200 F

FIGS. 20A-H (BE and EDS images) and 21A-J (SEM and elemental analysis) relate to sample one, which was a cold rolled and annealed implementation of C79880.

| Spectrum | Si | P | S | Cr | Mn | Fe | Ni | Cu | Zn | Se | Sb |
|---|---|---|---|---|---|---|---|---|---|---|---|
| Sample 3 General Spectrum | | 0.2 | 0.1 | | 12.2 | | 4.6 | 70.1 | 12.1 | | 0.7 |
| Sample 3 Location 1 | | | 32.1 | | 60.6 | | | 5.7 | | 1.5 | |
| Sample 3 Location 2 | | | | | | | | | | | |
| Sample 3 Location 3 | | | 11.3 | | 21.4 | | 3.3 | 54.5 | 9.5 | | |
| Sample 3 Location 4 | | 21.7 | | 0.5 | 45.1 | 17.4 | 12.4 | 2.5 | 0.4 | | |
| Sample 3 Location 5 | | | | | 10.8 | | 4.6 | 71.2 | 12.6 | | 0.8 |

Sample 3 includes primarily manganese sulfide at location 1. Location 3 is primarily copper and manganese with sulfur, zinc, and nickel. Location 4 is primarily phosphorous manganese and iron with nickel. Location 5 is primarily copper with some manganese and zinc and small amount of nickel and traces of antimony.

Mechanical Properties

Cold Rolled and Annealed Conditions

Mechanical properties for the C79880 implementations tested illustrate superior results. For example:

- UTS and YS in the cold rolled condition are higher than those for nickel silvers (C74500 and C78200) and cupronickels (C71000).
- Mechanical properties in the annealed condition are similar to those for nickel silver (C78200)
- These mechanical properties indicate that the white metals can compete with nickel silvers and cupronickels for flat, rod and tubular products.
- Other advantages are the antimicrobial characteristics and white color.

Machinability

Implementations of C99770 have slightly better machinability rating than C99760. This is also evident from the chip morphologies. However, they are comparable to other copper colored alloys.

Machinability testing described in the present application was performed using the following method. The piece parts were machined by a coolant fed, 2 axis, CNC Turning Center. The cutting tool was a carbide insert. The machinability is based on a ratio of energy that was used during the turning on the above mentioned CNC Turning Center. The calculation formula can be written as follows:

1. $C_F=(E_1/E_2)\times 100$
2. $C_F$=Cutting Force
3. $E_1$=Energy used during the turning of a "known" alloy C 36000 (CDA).
4. $E_2$=Energy used during the turning of the New Alloy.
5. Feed rate=0.005 IPR
6. Spindle Speed=1,500 RPM
7. Depth of Cut=Radial Depth of Cut=0.038 inches An electrical meter was used to measure the electrical pull while the cutting tool was under load. This pull was captured via milliamp measurement.

Figure 24B:
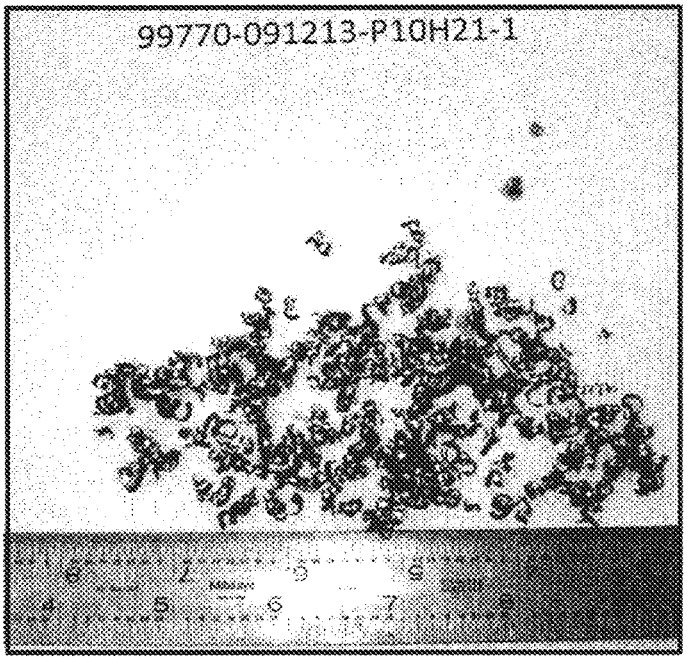
FIGS. 24B-D illustrate chips from a machinability test of implementations of C99770.
Figure 24C:
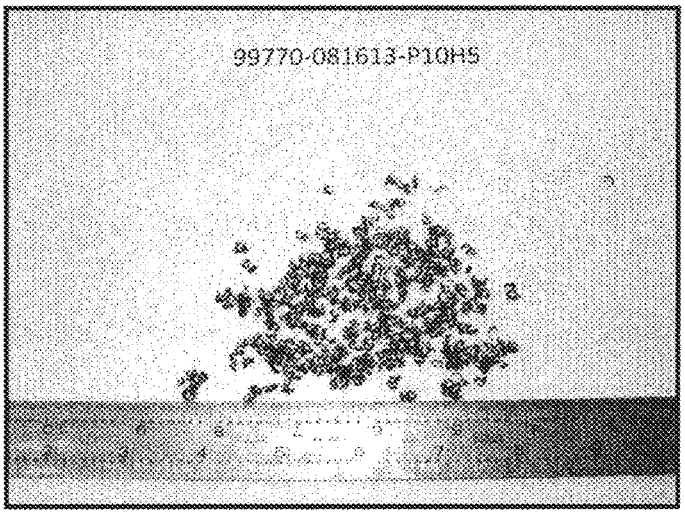
Figure 24D:
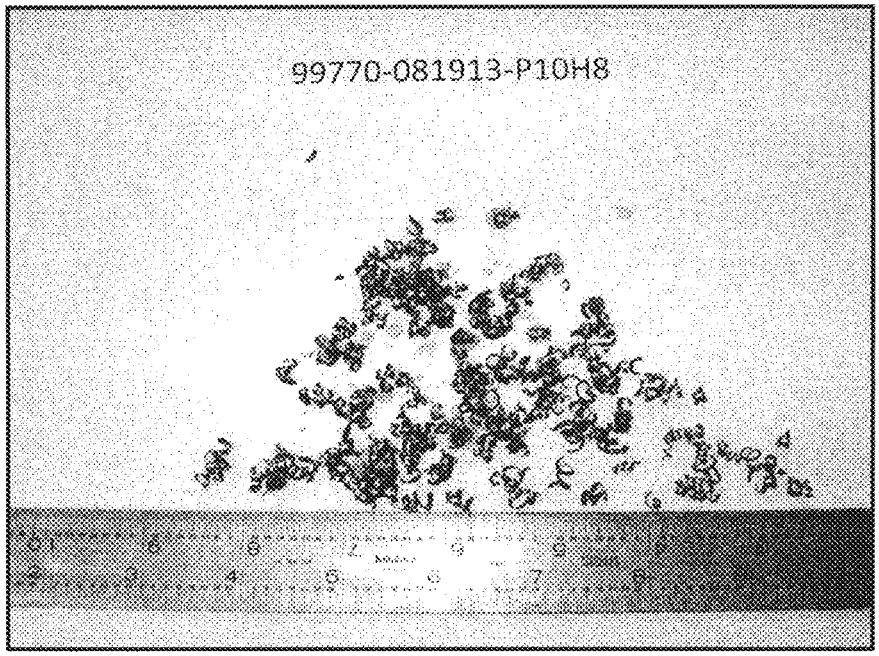

FIG. 23A gives compositions of C99760 alloys used for machinability evaluation. FIGS. 23 B-D show chip morphologies. FIG. 24A gives compositions of C99770 alloys used for machinability evaluation. FIGS. 24 B-D show chip morphologies It is believed that a combination of sulfur, antimony, and carbon have helped to improve the machinability of C99760 and C99770.

It is believed that CCG alone does not improve chip morphology. Antimony or antimony+sulfur are effective in improving machinability. Of these two additions, antimony+sulfur has an edge in getting slightly better chip morphology. If no additions of antimony, carbon, and sulfur: chip quality is very poor.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

We claim:

1. A composition comprising:
61 wt %-67 wt % copper,
8 wt %-12 wt % nickel,
8 wt %-14 wt % zinc,
10 wt %-16 wt % manganese,
greater than 0 wt % sulfur and less than or equal to 0.25 wt % sulfur, and
0.1 wt %-1.0 wt % antimony
0.2 wt %-1.0 wt % tin
greater than 0 wt % iron and less than or equal to than 0.6 wt % iron
greater than 0 wt % aluminum and less than or equal to 0.6 wt % aluminum
greater than 0 wt % phosphorous and less than or equal to 0.05 wt % phosphorous
greater than 0 wt % lead and less than or equal to 0.09 wt % lead
greater than 0 wt % silicon and less than or equal to 0.05 wt % silicon, and
greater than 0 wt % carbon and less than or equal to 0.10 wt % carbon.

2. The composition of claim 1, further comprising 0.6 wt % iron.

3. The composition of claim 1, further comprising 0.6 wt % aluminum.

4. The composition of claim 1, further comprising 0.05 wt % phosphorous.

5. The composition of claim 1, further comprising 0.09 wt % lead.

6. The composition of claim 1, further comprising 0.05 wt % silicon.

7. The composition of claim 1, further comprising 0.10 wt % carbon.

8. A composition comprising:
66 wt %-70 wt % copper,
3 wt %-6 wt % nickel,
8 wt %-14 wt % zinc,
10 wt %-16 wt % manganese,
greater than 0 wt % sulfur and less than or equal to 0.25 wt % sulfur, and
0.1 wt %-1.0 wt % antimony
0.2 wt %-1.0 wt % tin;
greater than 0 wt % iron and less than or equal to 0.6 wt % iron
greater than 0 wt % aluminum and less than or equal to 0.6 wt % aluminum
greater than 0 wt % phosphorous and less than or equal to 0.05 wt % phosphorous
greater than 0 wt % lead and less than or equal to 0.09 wt % lead
greater than 0 wt % silicon and less than or equal to 0.05 wt % silicon, and
greater than 0 wt % carbon and less than or equal to 0.10 wt % carbon.

9. The composition of claim 8, further comprising 0.6 wt % iron.

10. The composition of claim 8, further comprising 0.6 wt % aluminum.

11. The composition of claim 8, further comprising 0.05 wt % phosphorous.

12. The composition of claim 8, further comprising 0.09 wt % lead.

13. The composition of claim 8, further comprising 0.05 wt % silicon.

14. The composition of claim 8, further comprising 0.10 wt % carbon.

* * * * *